US005969478A

United States Patent [19]

Shino et al.

[11] Patent Number: 5,969,478

[45] Date of Patent: Oct. 19, 1999

[54] GAS DISCHARGE DISPLAY APPARATUS AND METHOD FOR DRIVING THE SAME

[75] Inventors: Taichi Shino, Nara-ken; Takio Okamoto, Kusatsu; Kazunori Hirao, Yao; Koichi Itsuda; Yukiharu Ito, both of Takatsuki; Takao Wakitani, Akashi; Toru Hirayama, Osaka, all of Japan

[73] Assignee: Matsushita Electronics Corporation, Takatsuki, Japan

[21] Appl. No.: 09/108,577

[22] Filed: Jul. 1, 1998

Related U.S. Application Data

[62] Division of application No. 08/745,074, Nov. 7, 1996, which is a division of application No. 08/428,575, Apr. 25, 1995, Pat. No. 5,656,893.

[30] Foreign Application Priority Data

| | | | |
|---|---|---|---|
| Apr. 28, 1994 | [JP] | Japan | 6-90787 |
| May 16, 1994 | [JP] | Japan | 6-100336 |
| May 26, 1994 | [JP] | Japan | 6-138398 |
| May 26, 1994 | [JP] | Japan | 6-157852 |
| Jul. 15, 1994 | [JP] | Japan | 6-163850 |
| Jul. 18, 1994 | [JP] | Japan | 6-165463 |
| Aug. 25, 1994 | [JP] | Japan | 6-200013 |
| Feb. 9, 1995 | [JP] | Japan | 7-21760 |

[51] Int. Cl.[6] ..... G09G 3/28

[52] U.S. Cl. ..... 315/169.4; 313/582; 345/55

[58] Field of Search ..... 315/169.1, 169.3, 315/169.4; 313/582, 584, 585, 586, 587; 345/55

[56] References Cited

U.S. PATENT DOCUMENTS

| | | | |
|---|---|---|---|
| 3,886,404 | 5/1975 | Kurahashi et al. | 345/67 |
| 4,342,993 | 8/1982 | Holz | 340/779 |
| 4,390,808 | 6/1983 | De Vries et al. | 313/584 |
| 4,613,794 | 9/1986 | Oida | 315/169.4 |
| 4,692,665 | 9/1987 | Sakuma | 315/169.4 |
| 5,663,741 | 9/1997 | Kanazawa | 345/66 |

FOREIGN PATENT DOCUMENTS

| | | |
|---|---|---|
| 0549275 | 6/1993 | European Pat. Off. . |
| 59-79938 | 5/1984 | Japan . |
| 61-39341 | 2/1986 | Japan . |
| 62-31775 | 7/1987 | Japan . |
| 62-61278 | 12/1987 | Japan . |
| 4170581 | 6/1992 | Japan . |
| 2674304 | 11/1997 | Japan . |

OTHER PUBLICATIONS

European Search Report dated Apr. 20, 1998 relating to Application No. 95/06246.2.

*Primary Examiner*—David H. Vu
*Attorney, Agent, or Firm*—Renner, Otto, Boisselle & Sklar, P.L.L.

[57] ABSTRACT

A plurality of scanning electrodes and a plurality of sustaining electrodes parallel to each other are located on an inner face of a first glass substrate. Each of the scanning electrodes and each of the sustaining electrodes form a pair. A dielectric layer and a protection layer are formed on the first glass substrate in this order, covering the electrodes. A plurality of data electrodes perpendicular to the scanning electrodes and the sustaining electrodes are located on an inner face of a second glass substrate which is located opposed to the first glass substrate with a discharge space interposed therebetween. In an AC-type PDP having such a structure, at least one of the plurality of scanning electrodes and the plurality of sustaining electrodes are divided into a plurality of groups, and pulses having different phases are applied to the electrodes in different groups, thereby causing sustaining discharge. The scanning electrodes and the sustaining electrodes may be comb-like with teeth. The comb-like scanning electrodes and the comb-like sustaining electrodes are opposed to each other with a small gap interposed therebetween in the manner that the teeth thereof are in engagement with each other. In such a case, the data electrodes are located opposed to and in a longitudinal direction of the teeth of the scanning electrodes.

2 Claims, 41 Drawing Sheets

Prior Art 1000

*FIG. 4* Prior Art
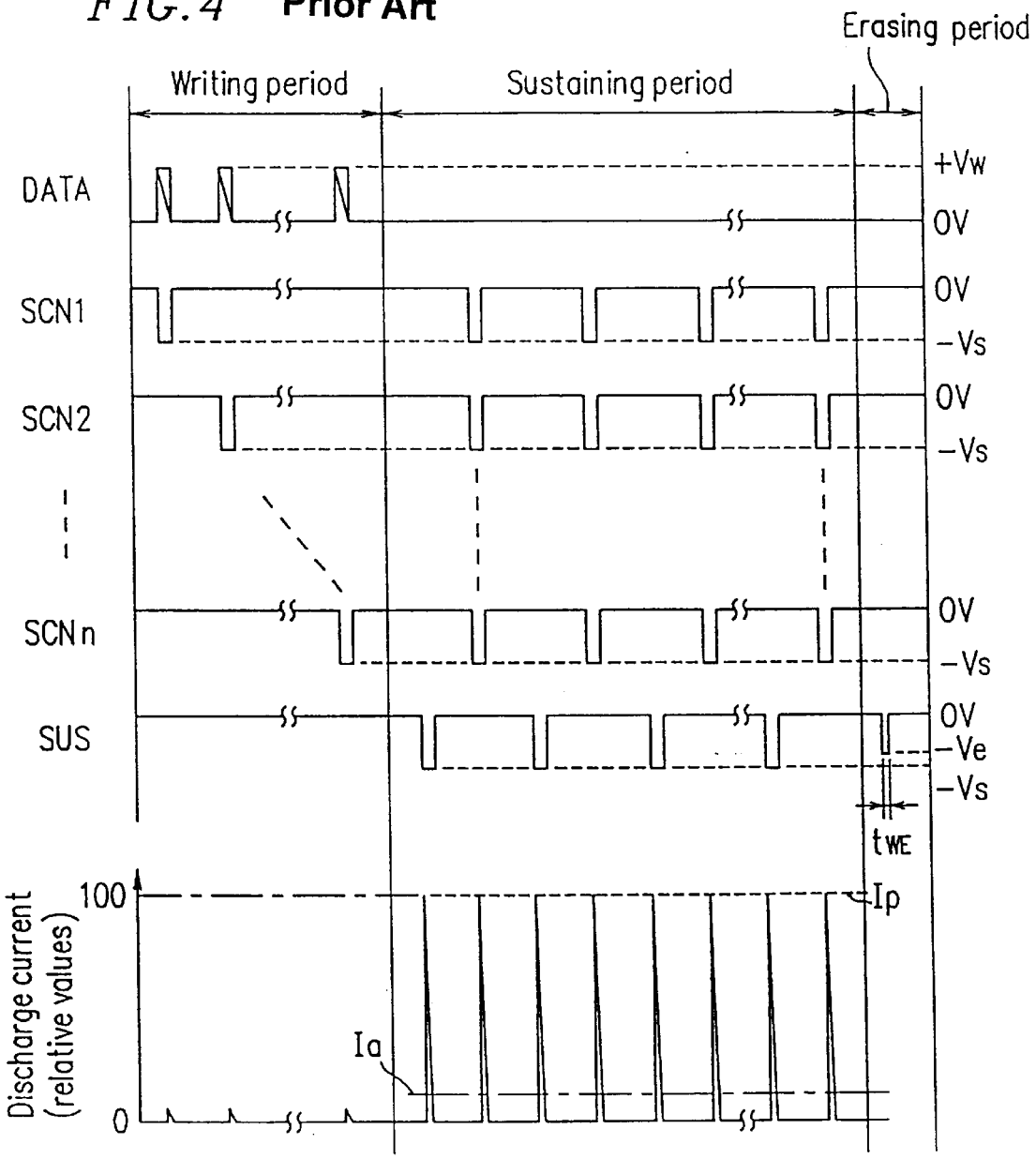

7 Data electrode
R(G,B)
8
9
6
5
4
3
1 Scanning electrode
OV OV
2 Sustaining electrode OV
Initial state
OV
OV +Vw
7 9
5
-Vs 1
2 OV +Vw
7 9
Writing period
5
-Vs 1
2 OV OV
7 9
2
5
1
OV
-Vs
Sustaining period OV
7 9
2
5
1
-Vs
OV OV
7 9
Erasing period
2
5
1
OV
-Vs (Narrow pulse)

*FIG. 6* Prior Art
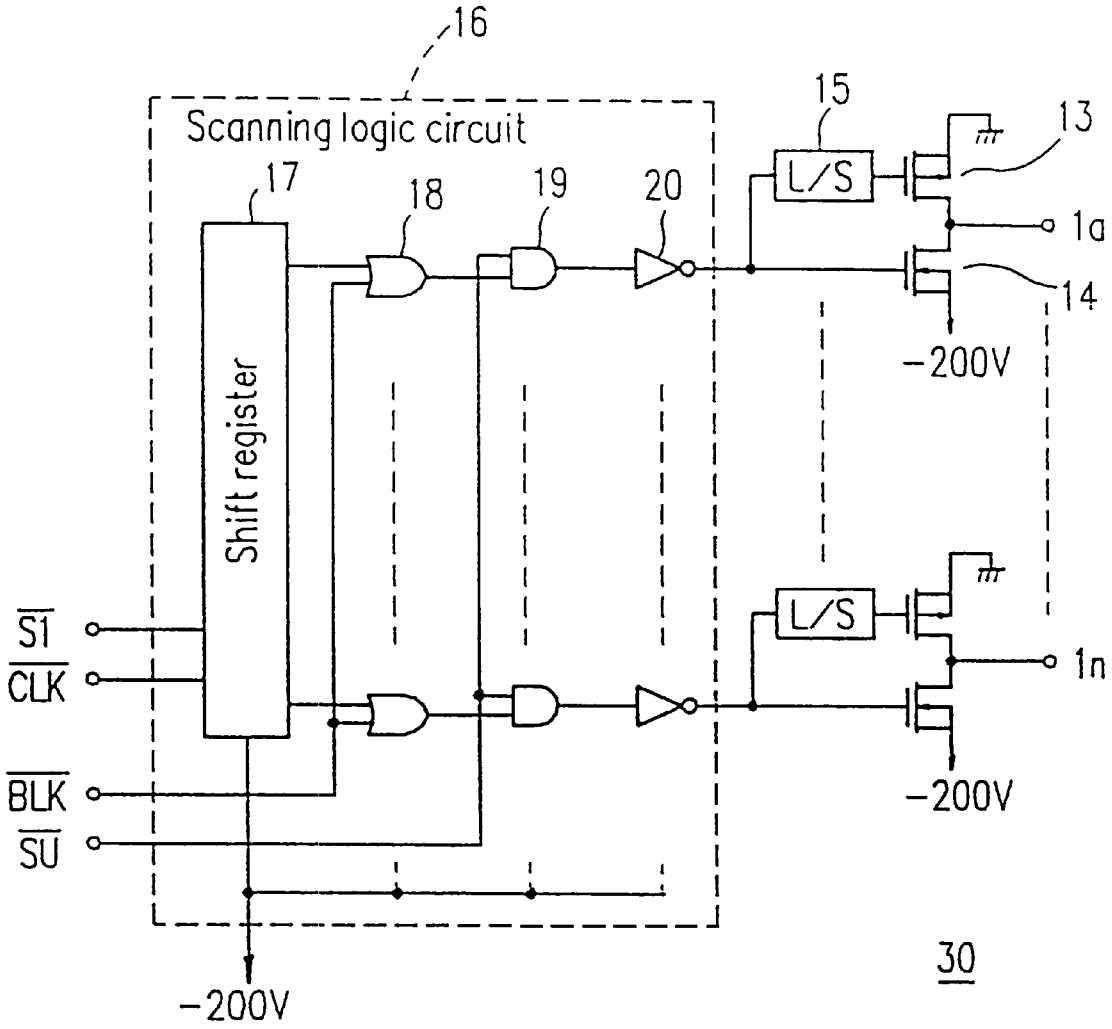

*FIG. 7* Prior Art
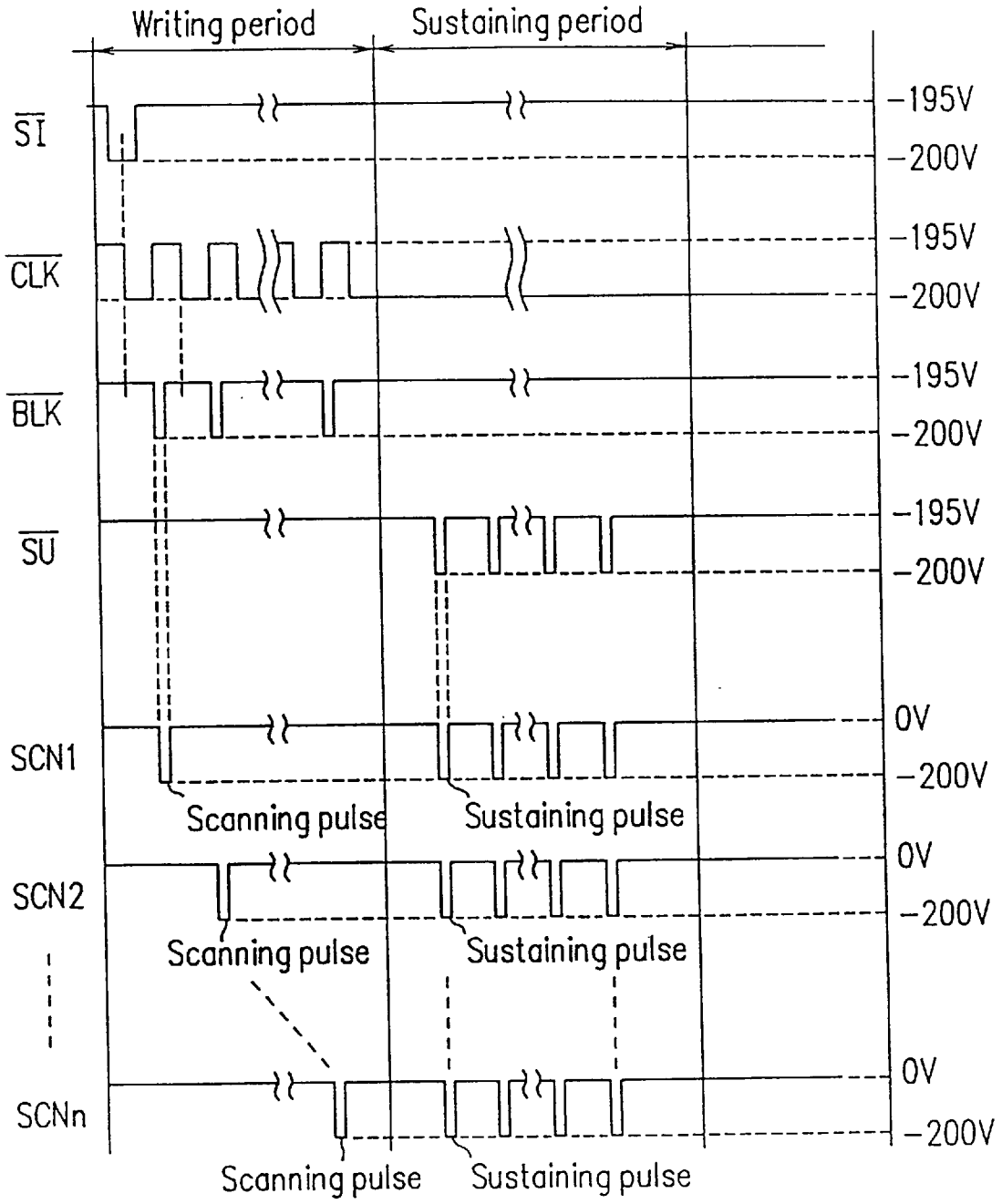

FIG. 8 Prior Art
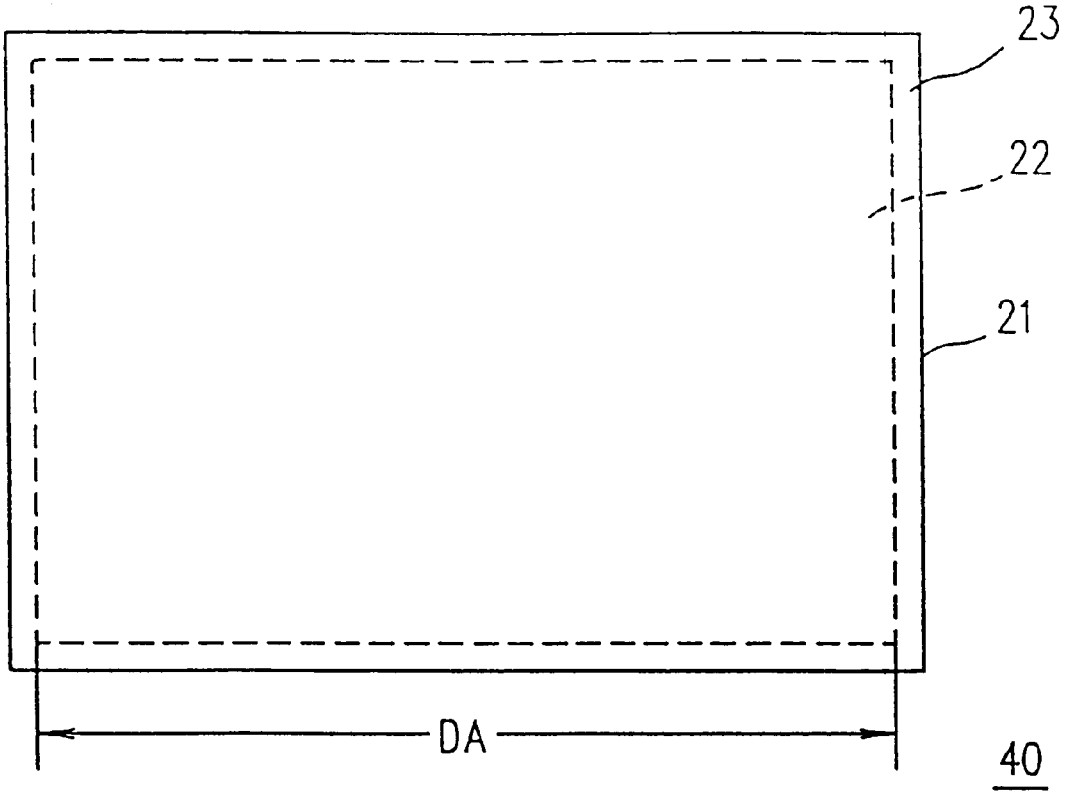

Sustaining period

GAS DISCHARGE DISPLAY APPARATUS AND METHOD FOR DRIVING THE SAME

This application is a divisional of Ser. No. 08/745,074 filed Nov. 7, 1996 which is a divisional of Ser. No. 08/425,575 filed Mar. 25, 1995 now U.S. Pat. No. 5,656,893.

BACKGROUND OF THE INVENTION

1. Field of the Invention

The present invention relates to a gas discharge display apparatus for displaying a character or an image by light emission utilizing gas discharge which is for use in an image display apparatus such as a television or an advertizing display panel, and a method for driving the same. In particular, the present invention relates to a gas discharge apparatus used in the form of an AC-type plasma display panel (hereinafter, referred to as a "PDP") and a method for driving the same.

2. Description of the Related Art

Gas discharge display apparatuses have a large display area despite a small depth thereof and realize color display. For such advantages, use of gas discharge display apparatuses is now being extended rapidly. Gas discharge display apparatuses are available in various types. One type of gas apparatus suitable for image display is an AC-type PDP. Gas discharge display apparatuses of this type, which are disclosed in Japanese Laid-Open Patent Publication Nos. 59-79938 and 61-39341, and Japanese Patent Publication No. 62-31775, have a memory function.

Briefly referring to FIGS. 1A and 1B, a conventional AC-type PDP 1000 will be described. FIG. 1A is a plan view of the AC-type PDP 1000, illustrating an arrangement of electrodes. FIG. 1B is a cross sectional view of the AC-type PDP 1000 taken along line 1B–1B' in FIG. 1A.

As is shown in FIG. 1B, the AC-type PDP 1000 includes a first glass substrate 3 and a second glass substrate 8 opposed to each other. The first glass substrate 3 and the second glass substrate 8 form an outer casing of the AC-type PDP 1000 together. On an inner face of the first glass substrate 3, a first electrode group including a plurality of scanning electrodes (first discharge electrodes) 1 and a plurality of sustaining electrodes (second discharge electrodes) 2 is located. A dielectric layer 4 is located on the first glass substrate 3, covering the first electrode group, and a protection layer 5 is located on the dielectric layer 4. On an inner face of the second glass substrate 8, a second electrode group including a plurality of data electrodes (third discharge electrodes; also referred to as "address electrodes") 7 is located.

As is illustrated in FIG. 1A, the scanning electrodes 1*a* through 1*n* (only 1*a*, 1*b* and 1*c* are shown here) and the sustaining electrodes 2*a* through 2*n* (only 2*a*, 2*b* and 2*c* are shown here) are provided in parallel alternately. The data electrodes 7*a* through 7*m* (only 7*a* and 7*b* are shown here) are provided in parallel so as to perpendicularly cross the scanning electrodes 1*a* through 1*n* and the sustaining electrodes 2*a* through 2*n*. Adjacent scanning electrode and sustaining electrode (for example, 1*a* and 2*a*) form a pair. A projecting area of the scanning electrode and a projecting area of the sustaining electrode forming a pair are opposed to each other in an area S (FIG. 1A), where sustaining discharge occurs. The area S will be referred to as a "discharge area".

The second electrode group including the data electrodes 7*a* through 7*m* is opposed to the protection layer 5 with a discharge space 6 full of discharge gas interposed therebetween. The dielectric layer 4 is formed of borosilicate glass or the like, and the protection layer 5 is formed of MgO or the like.

As is illustrated in FIG. 2, the scanning electrodes 1*a* through 1*n*, the sustaining electrodes 1*a* through 1*n*, and the data electrodes 1*a* through 1*m* are arranged orthogonally in a lattice. The scanning electrodes 1*a* through 1*n* are connected to a scanning electrode driving circuit 10, the sustaining electrodes 2*a* through 2*n* are connected to a sustaining electrode driving circuit 11, and the data electrodes 7*a* through 7*m* are connected to a data electrode driving circuit 12.

Another conventional AC-type PDP 2000 will be described with reference to FIGS. 3A and 3B. FIG. 3A is a plan view of the AC-type PDP 2000, illustrating an arrangement of electrodes, and FIG. 3B is a cross sectional view of the AC-type PDP 2000 taken along line 3B–3B' in FIG. 3A. In FIG. 3A, the letter P denotes a pixel area, and letter S denotes a discharge area. In FIGS. 3A and 3B, the same elements as those in FIGS. 1A and 1B bear the same reference numerals therewith.

As is illustrated in FIG. 3B, the AC-type PDP 2000 includes three types of phosphor layers R, G and B for emitting light of red, green and blue which are located on the inner face of the second glass substrate 8 in order to perform a color display. The phosphor layers R, G and B are located in positional correspondence with discharge areas S shown in FIG. 1A, and are excited to emit light upon receiving ultraviolet rays generated by discharge caused in the discharge areas S.

A method for driving such AC-type PDPs 1000 and 2000 is disclosed in, for example, Japanese Patent Publication No. 62-61278 and Japanese Laid-Open Patent Publication No. 4-170581. In the latter publication, the driving method is described as a method for driving a dot matrix display panel.

With reference to FIG. 4, a conventional method for driving an AC-type (1000 or 2000) PDP will be described.

First, in the writing operation performed in a writing period, a positive writing pulse having an amplitude of +Vw shown in waveform DATA in FIG. 4 is applied to at least one data electrode selected from the data electrodes 7*a* through 7*m* (for example, the data electrode 7*a*) which corresponds to a pixel for displaying an image in accordance with the scanning electrode 1*a*. Simultaneously, a negative scanning pulse having an amplitude of −Vs shown in waveform SCN1 is applied to the scanning electrode 1*a*. By such application, discharge occurs at an intersection W1 (FIG. 1A) of the data electrode 7*a* and the scanning electrode 1*a*, and thus a positive charge is stored in an area of a surface of the protection layer 5, the area positionally corresponding to the intersection W1. In other words, such an area acts as a write cell.

Next, a positive writing pulse having an amplitude of +Vw shown in waveform DATA is applied to at least one data electrode selected from the data electrodes 7*a* through 7*m* (for example, the data electrode 7*a*) which corresponds to a pixel for displaying an image in accordance with the scanning electrode 1*b*. Simultaneously, a negative scanning pulse having an amplitude of −Vs shown in waveform SCN2 is applied to the scanning electrode 1*b*. By such application, discharge occurs at an intersection W2 (FIG. 1A) of the data electrode 7*a* and the scanning electrode 1*b*, and thus a positive charge is stored in an area of the surface of the protection layer 5, the area positionally corresponding to the intersection W2. In other words, such an area acts as a write cell.

In this manner, during the process of applying negative scanning pulses having an amplitude of −Vs shown in waveforms SCN1 through SCNn to the scanning electrodes 1*a* through 1*n* respectively, a positive writing pulse having an amplitude of +Vw is applied to at least one selected data electrode which corresponds to a pixel for displaying an image in accordance with the respective scanning electrode. Thus, a positive charge is stored in a prescribed area (write cell) of the surface of the protection layer 5.

The writing operation is followed by the sustaining operation performed in a sustaining period. In the sustaining operation, a negative sustaining pulse having an amplitude of −Vs shown in waveform SUS is applied to all the sustaining electrodes 2, and negative sustaining pulses having an amplitude of −Vs shown in waveforms SCN1 through SCNn are applied to all the scanning electrodes 1, respectively. The pulse application to the sustaining electrodes 2 and the pulse application to the scanning electrodes 1 are performed alternately. The application of the first sustaining pulse to each sustaining electrode 2 discharges the positive charge stored on the protection layer 5, and thus sustaining discharge occurs on the discharge area S which belongs to the same discharge cell as the respective intersection. The alternate application of the negative sustaining pulse to each sustaining electrode 2 and each scanning electrode 1 continues the sustaining discharge on the respective discharge area S. By light emission caused by such sustaining discharge, characters and images are displayed.

In the erasing operation performed in an erasing period, a negative erasing pulse having an amplitude of −Ve and a small width $t_{WE}$ shown in waveform SUS is applied to all the sustaining electrodes 2. (Hereinafter, a pulse having a small width will be referred to as a "narrow pulse".) By such application, erasing discharge occurs, and thus the charge stored on the protection layer 5 by sustaining discharge is completely erased. As a result, the sustaining discharge does not continue even if a sustaining pulse is applied. Thus, the sustaining operation is terminated.

Conventionally, the erasing pulse applied to the sustaining electrodes has an absolute value of the amplitude which is smaller than the that of the sustaining pulse, or has a width smaller than that of the sustaining pulse. In order to enlarge the margin for the erasing operation, both of the absolute value of the amplitude and the width of the erasing pulse need to be smaller than those of the sustaining pulse. Alternatively, a plurality of erasing pulses having small but different widths may be applied.

In order to stabilize the writing, sustaining and erasing operations, the rise and fall of each of the writing, scanning, sustaining and erasing pulses are applied with steep rise and fall. The time period required for the change in the voltage at the rise and fall is generally set to be as short as several hundred nanoseconds.

The luminance of light obtained by performing sustaining discharge once is determined by the amplitude of the sustaining pulse, the capacitance between the scanning electrodes 1*a* through 1*n* and the surface of the protection layer 5, the capacitance between the sustaining electrodes 2*a* through 2*n* and the surface of the protection layer 5, and the like. However, the amplitude of each pulse is substantially determined by characteristics of the AC-type PDP and thus cannot be changed arbitrarily. The structure of the AC-type PDP, the material of the electrodes, the type of the discharge gas, the sealing pressure and the like cannot be changed after the AC-type PDP is produced. Accordingly, the luminance of light can be controlled simply by changing the number of times the sustaining discharges is repeated (namely, the number of pulses) per time unit.

Next, the above-described operations will be described in detail with reference to FIGS. 5A through 5G. FIGS. 5A through 5G illustrate existing and moving states of the wall charges in a discharge cell in each step of the above-described operations.

FIGS. 5A through 5G are cross sectional views of a conventional AC-type PDP which is similar to the AC-type PDPs shown in FIGS. 1B and 3B. In FIGS. 5A through 5G, the data electrode 7 on the inner face of the second glass substrate 8 is covered with a second dielectric layer 9, and the phosphor layers R, G and B (only R is shown in FIG. 5A) are located on the second dielectric layer 9. The AC-type PDP illustrated in FIGS. 5A through 5G has the same structure as the structure of the AC-type PDPs 1000 and 2000 shown in FIGS. 1B and 3B except for the above-described points. The same elements as in the AC-type PDPs 1000 and 2000 bear the same reference numerals therewith.

FIG. 5A shows an initial state before the AC-type PDP is turned on. The discharge cell of the AC-type PDP has no wall charge.

As is shown in FIG. 5B, in the writing period after the AC-type PDP is turned on, a writing pulse having an amplitude of +Vw (V) is applied to the data electrode 7 and a negative scanning pulse having an amplitude of −Vs (V) is applied to the scanning electrode 1. Then, writing discharge occurs at the intersection of the data electrode 7 and the scanning electrode 1. A negative wall charge is stored in an area of a surface of the second dielectric layer 9 corresponding to the data electrode 7, and a positive wall charge is stored in an area of the surface of the protection layer 5 corresponding to the scanning electrode 1.

As is shown in FIG. 5C, in the sustaining period, a negative sustaining pulse having an amplitude of −Vs (V) is applied to the sustaining electrode 2. Thus, a positive wall charge is stored in an area of the surface of the protection layer 5 corresponding to the sustaining electrode 1. The voltage generated by the positive wall charge is superimposed on the voltage of the sustaining pulse and applied between the area of the surface of the protection layer 5 corresponding to the scanning electrode 1 and the area of the protection layer 5 corresponding to the sustaining electrode 2. Accordingly, sustaining discharge occurs between the above-mentioned two areas. As a result, a negative wall charge is stored on the area of the protection layer 5 corresponding to the scanning electrode 1, and a positive wall change stored on the area of the protection layer 5 corresponding to the sustaining electrode 2.

Further in the sustaining period, as is shown in FIG. 5D, a negative sustaining pulse having an amplitude of −Vs (V) is applied to the scanning electrode 1. Then, the voltage generated by the negative wall charge stored on the area of the protection layer 5 corresponding to the scanning electrode 1 by the sustaining discharge and the voltage generated by the positive wall charge stored on the area of the protection layer 5 corresponding to the sustaining electrode 2 are superimposed on the voltage of the sustaining pulse and applied between the area of the protection layer 5 corresponding to the scanning electrode 1 and the area of the protection layer 5 corresponding to the sustaining electrode 2. Thus, sustaining discharge occurs again between the above-mentioned two areas but in the opposite direction. As a result, a negative wall charge is stored on the area of the protection layer 5 corresponding to the sustaining electrode 2, and a positive wall charge is stored on the area of the protection layer 5 corresponding to the scanning electrode 1.

Still further in the sustaining period, as is shown in FIG. 5C again, a negative sustaining pulse having an amplitude of −Vs (V) is applied to the sustaining electrode 2. Then, the voltage generated by the negative wall charge stored on the area of the protection layer 5 corresponding to the sustaining electrode 2 by the sustaining discharge and the voltage generated by the positive wall charge stored on the area of the protection layer 5 corresponding to the scanning electrode 1 are superimposed on the voltage of the sustaining pulse and applied between the area of the protection layer 5 corresponding to the scanning electrode 1 and the area of the protection layer 5 corresponding to the sustaining electrode 2. Accordingly, sustaining discharge occurs again between the above-mentioned two areas. As a result, a negative wall charge is stored on the area of the protection layer corresponding to the scanning electrode 1, and a positive wall charge is stored on the area of the protection layer 5 corresponding to the sustaining electrode 2.

In this manner, sustaining discharge (movement of charges) occurs repeatedly in the sustaining period as is shown in FIGS. 5C and 5D, and the phosphor layers R, G and B are excited by ultraviolet rays generated by the repeated sustaining discharge, thereby performing display.

As is shown in FIG. 5E, in the erasing period, a negative narrow erasing pulse having an amplitude of −Vs (V) is applied to the sustaining electrode 2. Then, the voltage generated by the negative wall charge stored on the area of the protection layer 5 corresponding to the sustaining electrode 2 by the sustaining discharge and the voltage generated by the positive wall charge stored on the area of the protection layer 5 corresponding to the scanning electrode 1 are superimposed on the voltage of the negative narrow erasing pulse and applied between the area of the protection layer 5 corresponding to the scanning electrode 1 and the area of the protection layer 5 corresponding to the sustaining electrode 2. Accordingly, erasing discharge occurs again between the above-mentioned two areas. However, since such erasing discharge is maintained for a short period of time due to the narrow pulse, the discharge is terminated midway. Accordingly, by setting the width of the narrow erasing pulse to be optimum, the wall charge on the area of the protection layer corresponding to the sustaining electrode 1 and the wall charge on the area of the protection layer 5 corresponding to the scanning electrode 2 can be neutralized. Thereafter, sustaining discharge does not occur even if a sustaining pulse is applied unless a writing pulse is applied again. Accordingly, discharge is kept in a pause. The level of the residual wall charge in FIG. 5E is less than the level of the residual wall charge in FIG. 5B because the wall charge is partially extinguished during the sustaining discharge.

As is shown in FIG. 5F, in the writing period, a positive pulse having an amplitude of +Vw (V) is applied to the data electrode 7 and a negative scanning pulse having an amplitude of −Vs (V) is applied to the scanning electrode 1. Then, writing discharge occurs between an area of the second dielectric layer 9 corresponding to the data electrode 7 and the area of the protection layer 5 corresponding to the scanning electrode 1. By such writing discharge, a negative wall charge is stored on the area of the second dielectric layer 9 corresponding to the data electrode 7, and a positive wall charge is stored on the area of the second dielectric layer 9 corresponding to the scanning electrode 1 in addition to the residual wall charge shown in FIG. 5E. As a result, the level of the charge in FIG. 5E becomes equal to the level of the charge in FIG. 5B. By repeating the operation illustrated in FIGS. 5F, 5C, 5D and 5E in this manner, an image is displayed.

In the above-described conventional example, a method for driving the AC-type PDP in which the date electrodes 7 are covered with the second dielectric layer 9 and phosphor layers R, G and B are provided on the second dielectric layer 9 is described. The same method can be used for driving an AC-type PDP in which display is performed directly utilizing light emitted by discharge and thus has no phosphor layer. The same method can also be used for driving an AC-type PDP in which the data electrodes 7 are directly covered with a phosphor layer without the second dielectric layer 9. In such a case, the phosphor layer acts in the same manner as the second dielectric layer 9. The same method can still be used for driving an AC-type PDP in which the data electrodes 7 are exposed to the discharge space 6 without the second dielectric 9 or the phosphor layer. In such a case, although no wall charge is stored on the area of the second dielectric layer 9 corresponding to the data electrodes 7, an equivalent wall charge is stored on the area of the protection layer 5 corresponding to the scanning electrode 1.

A conventional scanning electrode driving circuit 30 will be described with reference to FIGS. 6 and 7. FIG. 6 is a circuit diagram of the scanning electrode driving circuit 30. The scanning electrode driving circuit 30 includes p-channel MOSFETs 13 withstanding a high voltage and n-channel MOSFETs 14 also withstanding a high voltage. The p-channel MOSFETs 13 are respectively connected to scanning electrodes 1*a* through 1*n* through a drain electrode thereof, and the n-channel MOSFETs 14 are also respectively connected to scanning electrodes 1*a* through 1*n* through a drain electrode thereof. A source of each p-channel MOSFET 13 is grounded, and a source of each n-channel MOSFET 14 is connected to a high voltage power source of −200 V. Each p-channel MOSFET 13 and each n-channel MOSFET 14 form an output section of a push-pull system withstanding a high voltage.

The p-channel MOSFETs 13 are connected to a scanning logic circuit 16 via a level shift (L/S) circuit 15 withstanding a high voltage, and the n-channel MOSFETs 14 are directly connected to the scanning logic circuit 16.

The scanning logic circuit 16 includes a shift register 17, a first gate 18, a second gate 19 and an inverter 20. A common line which is the basis for a signal level in the scanning logic circuit 16 is connected to the high voltage power source of −200 V.

FIG. 7 is a timing chart illustrating operation in the scanning electrode driving circuit 30.

When a scanning data signal $\overline{SI}$ and a clock signal $\overline{CLK}$ are input to the shift register 17, the scanning data signal $\overline{SI}$ is taken in at the falling edge of the clock signal $\overline{CLK}$. The level of outputs from the shift register 17 becomes low one by one, and a scanning signal is output. Only while the level of a blanking signal $\overline{BLK}$ is low, the scanning signal passes through the first gate 18, the second gate 19, the inverter 20, and the level shift circuit 15 and is applied to each p-channel MOSFET 13 and each n-channel MOSFET 14. Thus, a scanning pulse is applied to the scanning electrode 1*a* through 1*n* one by one.

In the sustaining period, when a sustaining signal $\overline{SU}$, is input to the second gate 19, a sustaining pulse is applied to all the scanning electrodes 1*a* through 1*n* simultaneously.

Conventionally, in order to reduce the size of the scanning electrode driving circuit 30 illustrated in FIG. 6, the scanning electrode driving circuit 30 is divided into an appropriate number of blocks to form a monolithic IC.

The conventional AC-type PDPs which are described above have the following problems.

(1) The conditions for setting the erasing operation are stringent as is described above. If the conditions are set inappropriately, right image reproduction cannot be performed due to the influence of the residual charge. The potential in the discharge area S is dispersed easily by different discharge cells, and discharge characteristics change over time.

In addition, since the width of the erasing pulse is small, the start of erasing discharge can be delayed by fluctuation in the width of the erasing pulse when the erasing pulse is applied. In such a case, the charge stored in the discharge area S cannot be erased completely.

In detail, the tolerance for the fluctuation in the width $t_{WE}$ and the amplitude −Ve of the erasing pulse cannot be large. Accordingly, if the characteristics are dispersed in different discharge cells, erasing discharge can be performed excessively or insufficiently in some discharge cells. Since the charge stored on the protection layer 5 is not completely erased in such discharge cells, a sufficient margin for erasing operation cannot be obtained. Excessive erasing discharge means that, after the charge stored on the protection layer 5 is erased, a charge having an opposite polarity is stored. Insufficient erasing discharge means that the charge stored on the protection layer 5 cannot be reduced to zero.

(2) When the positive charge stored on the area of the protection layer 5 corresponding to the intersection (for example, W1 or W2 in FIG. 1A) of a scanning electrode and a data electrode moves to the discharge area S, the level of the charge moving to sub-area $S_1$ is different from the level of the charge moving to sub-area $S_2$ because sub-area $S_1$ is closer to the intersection W1 than sub-area $S_2$. Accordingly, the charge distribution in the discharge area S is not uniform. As a result, when an erasing pulse is applied, the level of the charge is non-uniform in the area of the protection layer 5 corresponding to the discharge area S. Thus, the erasing operation cannot be uniform in the entire discharge area S.

(3) In the case of color display, if the widths of the scanning electrodes and the sustaining electrodes opposed to each other in the discharge area S are reduced in order to obtain a pixel area P which is substantially square, the discharge area S is also reduced. As a result, sufficient luminance cannot be obtained especially in a large color display apparatus.

(4) Even when the discharge is set to be performed 60 times per second as is generally done in a personal computer, a television and the like, the luminance is excessively high when the efficiency of the AC-type PDP is high. Under the circumstances, images can be displayed at a high luminance but not at a low luminance.

(5) Discharge current flowing during the sustaining period concentrates when the level of the sustaining pulse is changed as is shown in FIG. 4. Accordingly, the peak value Ip of the discharge current is excessively large compared with the average value Ia. As a result, the circuit for supplying a power source requires a capacitor having a large capacity for smoothing the current and a switching transistor for supplying a large peak current. Further, in order to prevent an adverse effect of noise generated by such a large peak current on the circuit operation, a noise removal circuit and a multiple-layer substrate are required.

(6) In the conventional scanning electrode driving circuit 30, an output section of a push-pull system withstanding a high voltage including the p-channel MOSFET 13 and the n-channel MOSFET 14 is required for each of the scanning electrodes 1*a* through 1*n*. The level shift circuit 15 withstanding a high voltage is also required. Accordingly, incorporation of the scanning electrode driving circuit 30 into an IC is difficult. Even if the scanning electrode driving circuit 30 is incorporated into an IC, the chip area is sufficiently large to raise production cost. If a shortcircuit occurs between the scanning electrodes 1*a* through 1*n*, the scanning electrode driving circuit 30 breaks down.

(7) The writing operation shown in FIG. 5F requires writing discharge caused in the state where the residual wall charge remains after the erasing period shown in FIG. 5E is terminated. However, the residual wall charge acts in the direction to counteract the voltage of the writing pulse, writing discharge is more difficult to be realized when compared with the state shown in FIG. 5B. Even if writing discharge occurs, the difference between the wall charge on the area of the protection layer 5 corresponding to the scanning electrode 1 and the wall charge on the area of the protection layer 5 corresponding to the sustaining electrode 2 is too small to easily start sustaining discharge. As a result, no light is emitted in some discharge cells.

In the case that the AC-type PDP is turned on to start operating in the state where the wall charge has already been distributed as is shown in FIG. 5G, namely, in the state where a negative wall charge is stored on the area of the second dielectric layer 9 corresponding to the data electrodes 7 and a positive wall charge is stored on the area of the protection layer 5 corresponding to the scanning electrodes 1 and the sustaining electrodes 2, the wall charges act in a direction counteracting the voltage of the writing pulse. Accordingly, writing discharge and sustaining discharge are both difficult to occur, and the discharge operation is not performed until the wall charges shown in FIG. 5G are naturally extinguished. As a result, the rising time for the display after the AC-type PDP is turned on, namely, the time period which is required for the AC-type PDP to perform normal display after the AC-type PDP is turned on is extended.

FIG. 8 is a plan view of a conventional image display panel 40 such as a PDP, a liquid crystal display (LCD) panel, a panel using an electroluminescent lamp (EL), or a panel using a fluorescent display tube. As is illustrated in FIG. 8, such a panel includes a flat casing 21 having a rectangular front wall 22. An image display area DA is set on the rectangular front wall 22. Inside the flat casing 21, electrodes for display are sealed. The front wall 22 is formed of a glass plate. A mosaic-like large display screen is formed by arranging a plurality of such image display panels 40 in a lattice, in a plurality of lines and a plurality of columns. Such a large display screen is used for a television or an advertising display panel.

In forming a large display screen by a plurality of such image display panels 40, the panels 40 are arranged two dimensionally so that there is no gap between two adjacent panels 40. However, since the front wall 22 is formed of glass, a non-display area 23 shaped as a rectangular frame and surrounding each image display panel 40, namely, a side wall of the flat casing 21 and the sealing material such as frit glass, appear through the front wall 22. Accordingly, such a non-display area 23 inevitably appears on the large display screen as non-light emitting dark lines in a lattice. Such a lattice significantly spoil the display quality.

In the case when one image display panel 40 has only a small number of pixels, for example, two, the dark lines are not very disturbing from far since the lines are scattered on the large display screen. However, display devices which are used for a high precision image display apparatus and an image display apparatus for indoor use, a great number of pixels are used at a high density. In such a state, the junction between two adjacent image display panel 40 is conspicuous as a dark lattice, and moreover the reproduced image is distorted.

SUMMARY OF THE INVENTION

In one aspect of the present invention, a gas discharge display apparatus includes a first substrate and a second substrate located opposed to each other with a discharge space interposed therebetween to form an outer casing; a first electrode group including a plurality of scanning electrodes and a plurality of sustaining electrodes located parallel to each other on an inner face of the first substrate, each of the plurality of scanning electrodes and each of the plurality of sustaining electrodes forming a pair; a dielectric layer covering the first electrode group; and a second electrode group including a plurality of data electrodes and a plurality of erasing electrodes located parallel to each other on an inner face of the second substrate in a direction perpendicular to the first electrode group, each of the plurality of data electrodes and each of the plurality of erasing electrodes forming a pair.

In another aspect of the present invention, a method for driving a gas discharge display apparatus includes the steps of applying a voltage pulse to the plurality of scanning electrodes and the plurality of sustaining electrodes included in the first electrode group alternately, thereby causing sustaining discharge between each pair of scanning electrode and sustaining electrode; and causing erasing discharge between the plurality of sustaining electrodes and the plurality of erasing electrodes, thereby erasing a residual charge.

In still another aspect of the present invention, a gas discharge display apparatus includes a first substrate and a second substrate located opposed to each other with a discharge space interposed therebetween to form an outer casing; a first electrode group including a plurality of scanning electrodes and a plurality of sustaining electrodes located on an inner face of the first substrate, each of the plurality of scanning electrodes and each of the plurality of sustaining electrodes forming a pair; a dielectric layer covering the first electrode group; and a second electrode group including a plurality of data electrodes located on an inner face of the second substrate parallel to one another in a direction perpendicular to the first electrode group. The plurality of scanning electrodes and the plurality of sustaining electrodes each have a comb-like shape with teeth. The scanning electrode and the sustaining electrode in each pair are opposed to each other with a small gap interposed therebetween in the manner that the teeth thereof are in engagement with each other. The plurality of data electrodes are located opposed to and in a longitudinal direction of the teeth of the plurality of scanning electrodes.

In one embodiment of the invention, the second electrode group includes a plurality of erasing electrodes located parallel to the plurality of data electrodes, respectively.

In one embodiment of the invention, the plurality of erasing electrodes are formed of a cathode material.

In still another aspect of the present invention, a gas discharge display apparatus includes a first substrate and a second substrate located opposed to each other with a discharge space interposed therebetween to form an outer casing; a first electrode group including a plurality of scanning electrodes and a plurality of sustaining electrodes located parallel to each other on an inner face of the first substrate, each of the plurality of scanning electrodes and each of the plurality of sustaining electrodes forming a pair; a dielectric layer covering the first electrode group; and a second electrode group including a plurality of data electrodes located parallel to one another on an inner face of the second substrate in a direction perpendicular to the first electrode group. At least one of the plurality of scanning electrodes and the plurality of sustaining electrodes are each divided into a plurality of areas, and terminals respectively connected to the areas are drawn outside the outer casing.

In still another aspect of the present invention, a method for driving a gas discharge display apparatus includes the step of dividing at least one of the plurality of scanning electrodes and the plurality of sustaining electrodes into a plurality of groups, and applying pulses having different phases to the at least one of the plurality of scanning electrodes and the plurality of sustaining electrodes in different groups, thereby causing sustaining discharge.

In still another aspect of the present invention, a method for driving a gas discharge display apparatus includes the step of applying an erasing pulse having an instantaneous voltage which changes slowly in one of an increasing manner and a decreasing manner to at least one of the plurality of scanning electrodes and the plurality of sustaining electrodes, thereby increasing a voltage between the scanning electrodes and the sustaining electrodes slowly to perform an erasing operation.

In one embodiment of the invention, a time period required for the instantaneous voltage of the erasing pulse to change between 10% and 90% of an amplitude thereof is set to be between 10 $\mu$s and 10 ms inclusive.

In still another aspect of the present invention, a gas discharge display apparatus includes a plurality of data electrodes; a plurality of scanning electrodes located in a direction perpendicular to the plurality of data electrodes; a plurality of switching devices withstanding a high voltage, the switching devices respectively having first main electrodes which are connected to the plurality of scanning electrodes respectively and independently; a plurality of reverse conductive diodes connected in parallel to the plurality of switching devices, respectively; a scanning logic circuit connected to a control electrode of each of the plurality of switching devices; and a push-pull circuit withstanding a high voltage which has an output connected to a second main electrode of each of the plurality of switching devices and to a common line which is the basis of the signal level in the scanning logic circuit.

In one embodiment of the invention, the plurality of switching devices are each an n-channel MOSFET withstanding a high voltage, and the plurality of reverse conductive diodes are each a parasitic diode formed in each n-channel MOSFET.

In one embodiment of the invention, the plurality of switching devices are each an npn bipolar transistor withstanding a high voltage.

In still another aspect of the present invention, a method for driving a gas discharge display apparatus includes a writing step of applying a writing pulse to the plurality of data electrodes and applying a scanning pulse having an opposite polarity to the polarity of the writing pulse to the plurality of scanning electrodes; a sustaining step of applying a sustaining pulse to the plurality of sustaining electrodes and the plurality of scanning electrodes; and an erasing step of applying an erasing pulse. Prior to the writing step, the initiating step is performed of applying an initiating pulse having a prescribed polarity to prescribed electrodes selected from the group consisting of the plurality of data electrodes, the plurality of sustaining electrodes and the plurality of scanning electrodes.

In one embodiment of the invention, the initiating step includes the step of applying an initiating pulse having an opposite polarity to the polarity of the scanning pulse applied in the writing step to at least one of the plurality of scanning electrodes and the plurality of sustaining electrodes.

In one embodiment of the invention, the initiating step includes the step of applying an initiating pulse having an opposite polarity to the polarity of the writing pulse applied in the writing step to the plurality of data electrodes.

In one embodiment of the invention, a time period required for the instantaneous voltage of the initiating pulse to change between 10% and 90% of an amplitude thereof is set to be between 5 $\mu$s and 10 ms inclusive.

In one embodiment of the invention, the initiating step includes the step of applying an assisting pulse, to the plurality of scanning electrodes and the plurality of sustaining electrodes, having an identical polarity and an identical amplitude with the polarity and the amplitude of the initiating pulse to the plurality of data electrodes.

In one embodiment of the invention, the initiating step includes the step of applying an assisting pulse, to the plurality of data electrodes, having an identical polarity and an identical amplitude with the polarity and the amplitude of the initiating pulse to the plurality of scanning electrodes and the plurality of sustaining electrodes.

In one embodiment of the invention, a time period required for the instantaneous voltage of the assisting pulse to change between 10% and 90% of an amplitude thereof is set between 5 $\mu$s and 10 ms inclusive.

In still another aspect of the present invention, an image display apparatus includes a large screen including a plurality of image display panels arranged two dimensionally, the plurality of image display panels each including a plurality of display units in a plurality of lines and a plurality of columns, the plurality of display units each acting as a pixel. The plurality of display units are arranged at an equal distance in a direction of the lines and a direction of the columns in each of the plurality of image display panels, and the display unit in a peripheral area of the corresponding image display panel which is most proximate to the adjacent image display panel is shorter than the other display units in at least one of the direction of the lines and the direction of the columns.

In still another aspect of the present invention, an image display apparatus includes an image display panel including a flat outer casing having a rectangular light-transmitting front wall and electrodes for display sealed in the image display panel, the image display panel further having an image display area surrounded by a non-display area having a shape of a rectangular frame and set on the front wall; and a rectangular transparent plate laminated on an outer face of the front wall. An outer periphery of a front face of the transparent plate corresponding to the non-display area has such a shape as to allow the outer periphery to act as a lens.

Thus, the invention described herein makes possible the advantages of (1) providing a gas discharge display apparatus for performing the erasing operation with certainty and a method for driving the same, (2) providing a gas discharge display apparatus for realizing both of an image of a high luminance and an image of a low luminance efficiently and a method for driving the same, (3) providing a method for driving a gas discharge display apparatus for reducing the peak value of the discharge current during a sustaining period, (4) providing a method for driving a gas discharge display apparatus for supplying a sufficiently large tolerance for the fluctuation of the width and the amplitude of an erasing pulse to obtain a sufficient margin for the erasing operation even if the characteristics are dispersed in different discharge cells, (5) providing a gas discharge display apparatus equipped with a driving circuit which is easily incorporated into an IC and which avoids breakdown even if a shortcircuit occurs between scanning electrodes, (6) providing a method for driving a gas discharge display apparatus for shortening the rising time of the gas discharge display apparatus for display after the apparatus is turned on and preventing generation of a discharge cell where no light emission occurs, and (7) providing a gas discharge display apparatus for which the mosaic-like large display screen is not visually influenced in an unfavorable manner by a non-display area of each of a great number of image display panels which are arranged in a lattice at a high density to form the large display screen and thus images are displayed with no distortion.

These and other advantages of the present invention will become apparent to those skilled in the art upon reading and understanding the following detailed description with reference to the accompanying figures.

BRIEF DESCRIPTION OF THE DRAWINGS

FIG. 4 is a timing chart illustrating a method for driving a conventional AC-type PDP.

FIG. 6 is a circuit diagram for a conventional scanning electrode driving circuit.

FIG. 7 is a timing chart illustrating operation of the scanning electrode driving circuit shown in FIG. 6.

FIG. 8 is a plan view of a conventional image display panel.

DESCRIPTION OF THE PREFERRED EMBODIMENTS

Hereinafter, the present invention will be described by way of illustrative examples with reference to the accompanying drawings.

Example 1

Figure 1A:
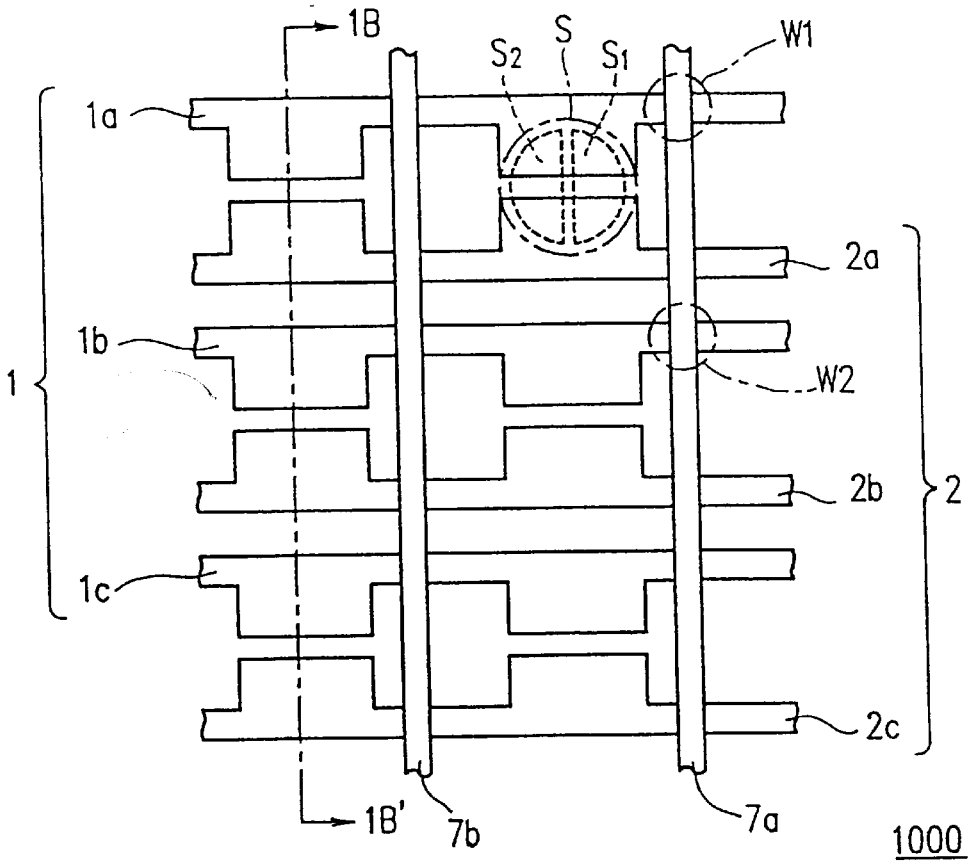
FIG.1A Prior Art
FIG. 1A is a plan view of a conventional AC-type PDP, illustrating an arrangement of electrodes.
Figure 1B:
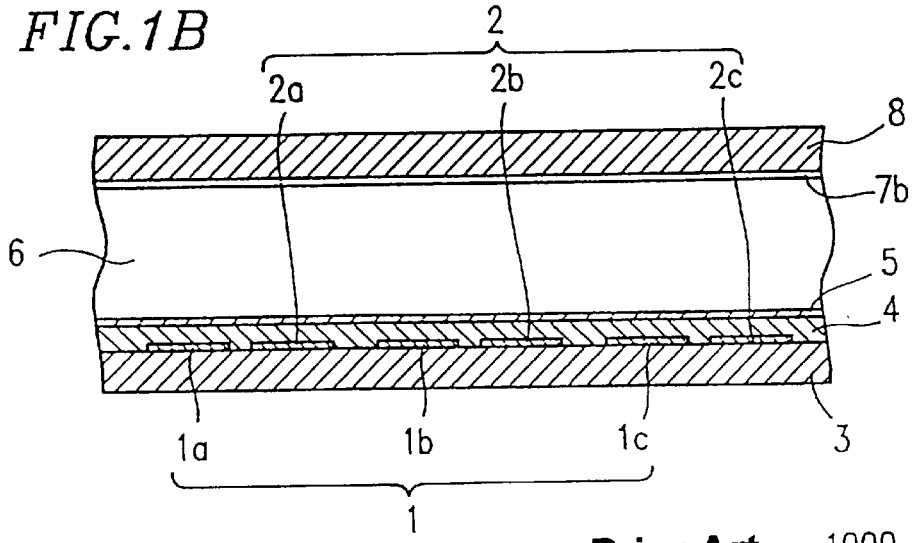
FIG. 1B is a cross sectional view of the AC-type PDP in FIG. 1A taken along line 1B–1B' in FIG. 1A.
Figure 2:
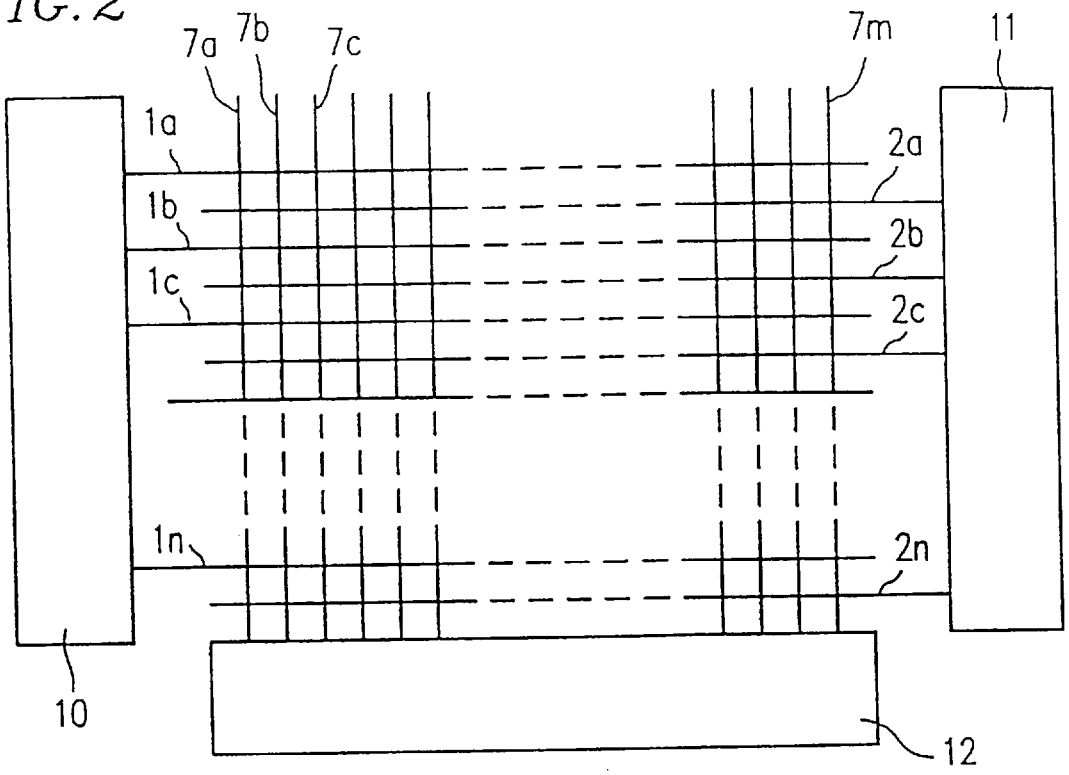
Prior Art FIG. 2
FIG. 2 is a schematic view illustrating the arrangement of the electrodes in the conventional AC-type PDP in FIG. 1A.
Figure 3A:
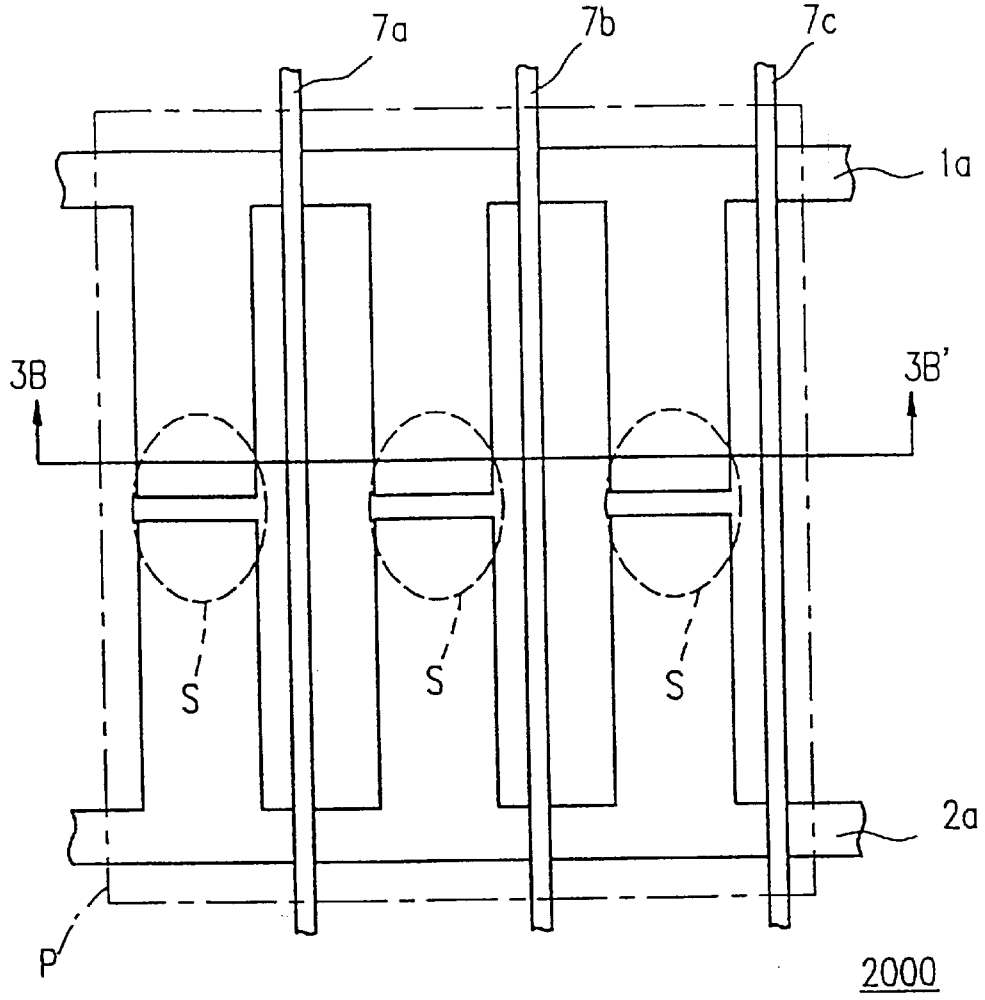
FIG. 3A Prior Art
FIG. 3A is a plan view of another conventional AC-type PDP, illustrating an arrangement of electrodes.
Figure 3B:
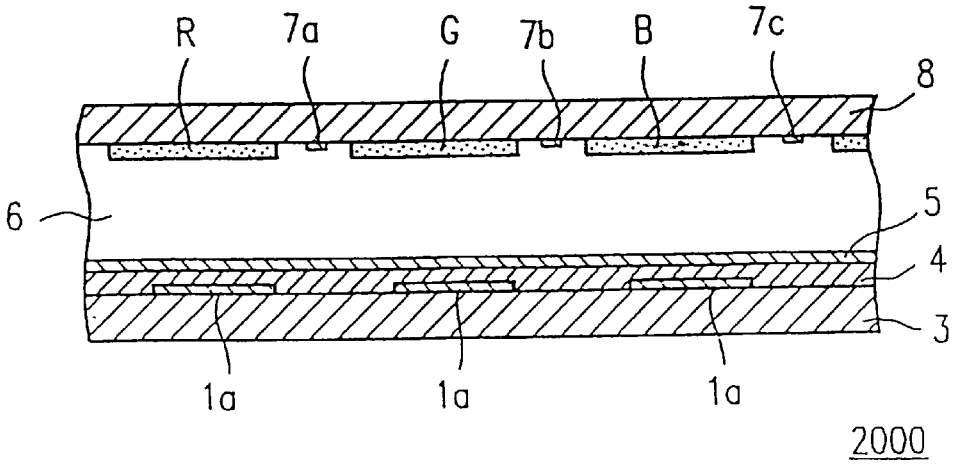
FIG. 3B Prior Art
FIG. 3B is a cross sectional view of the AC-type PDP in FIG. 3B taken along line 3B–3B' in FIG. 3A.
Figures 5A, 5B, 5C, 5D, 5E, 5F, 5G:
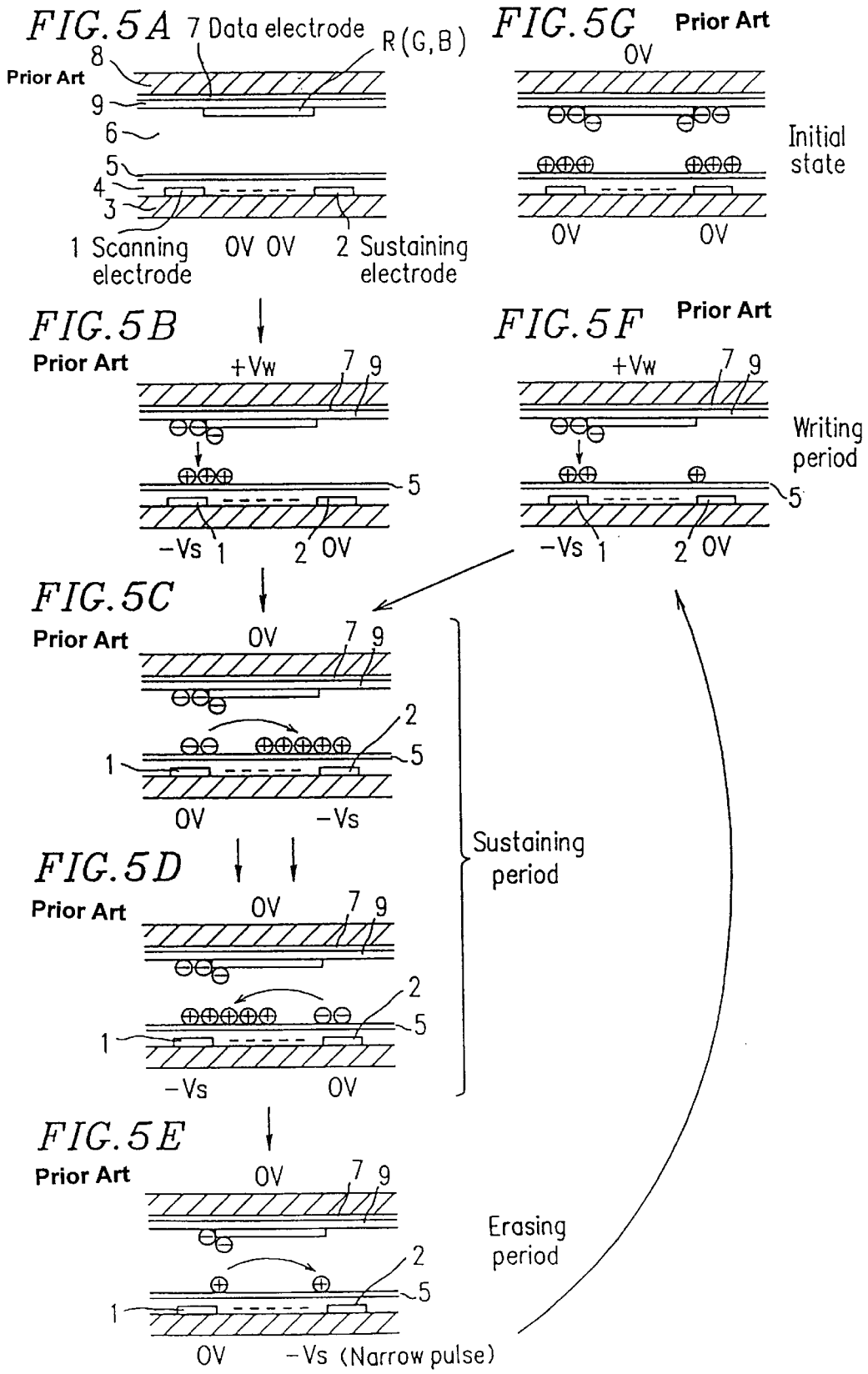
FIG. 5A Prior Art
FIG. 5G Prior Art
FIG. 5B Prior Art
FIG. 5F Prior Art
FIG. 5C Prior Art
FIG. 5D Prior Art
FIG. 5E Prior Art
FIGS. 5A through 5G are cross sectional views of a conventional AC-type PDP, illustrating the existing and moving state of charges in a discharge cell while the AC-type PDP is operating.
Figure 9A:
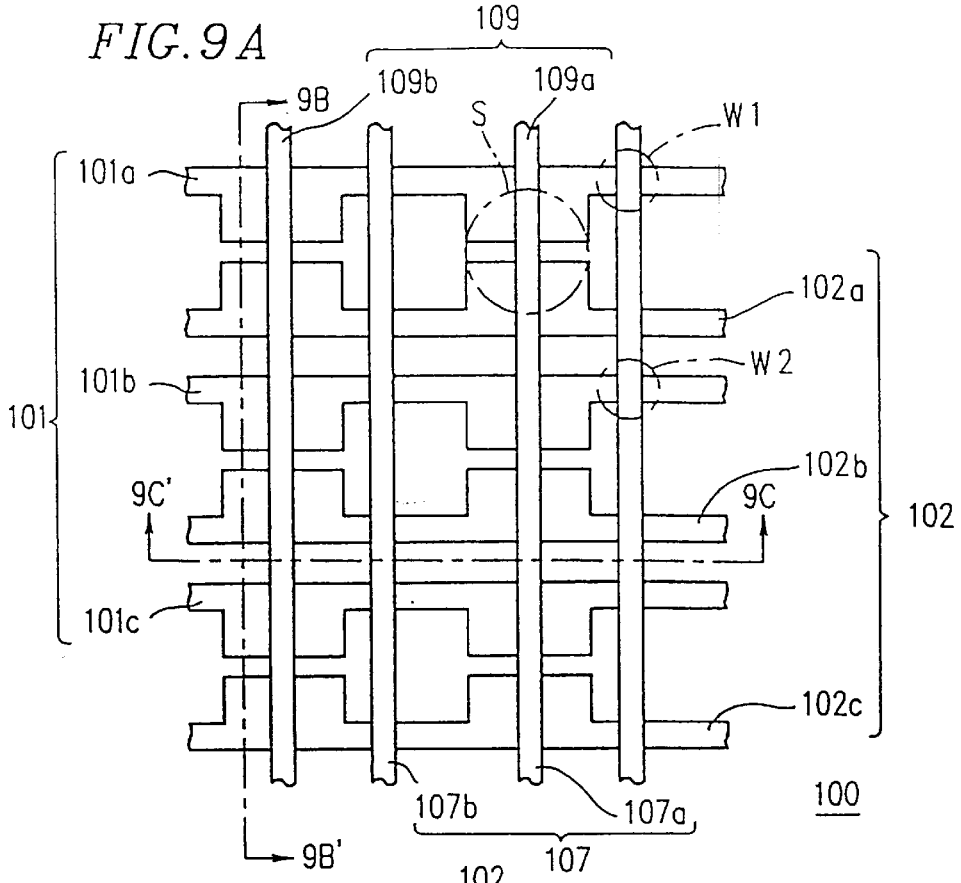
FIG. 9A is a partial plan view of an AC-type PDP in a first example according to the present invention, illustrating an arrangement of electrodes.
Figure 9B:
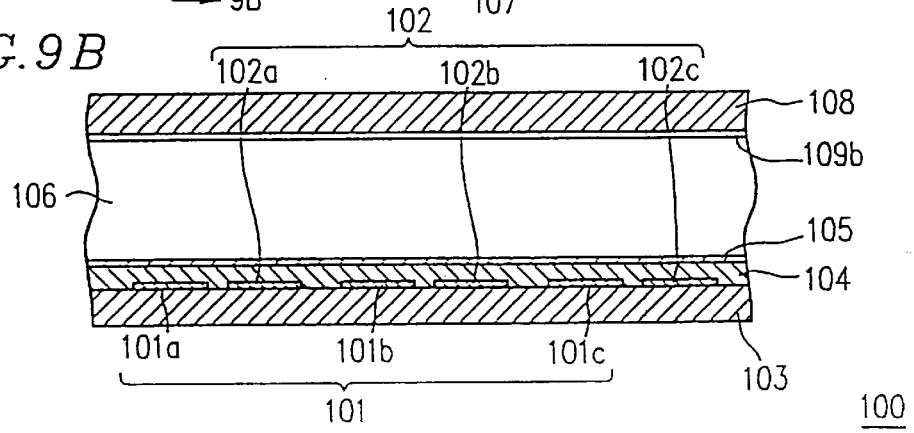
FIG. 9B is a cross sectional view of the AC-type PDP in FIG. 9A taken along line 9B–9B' in FIG. 9A.

An AC-type PDP in a first example according to the present invention will be described with reference to FIGS. 9A through 9C and 10A and 10B. FIG. 9A is a partial plan view of an AC-type PDP 100 in the first example, illustrating an arrangement of electrodes. FIG. 9B is a cross sectional view of the AC-type PDP 100 taken along line 9B–9B' in FIG. 9A, and FIG. 9C is a cross sectional view of the AC-type PDP 100 taken along line 9C–9C' in FIG. 9A.

Figure 9C:
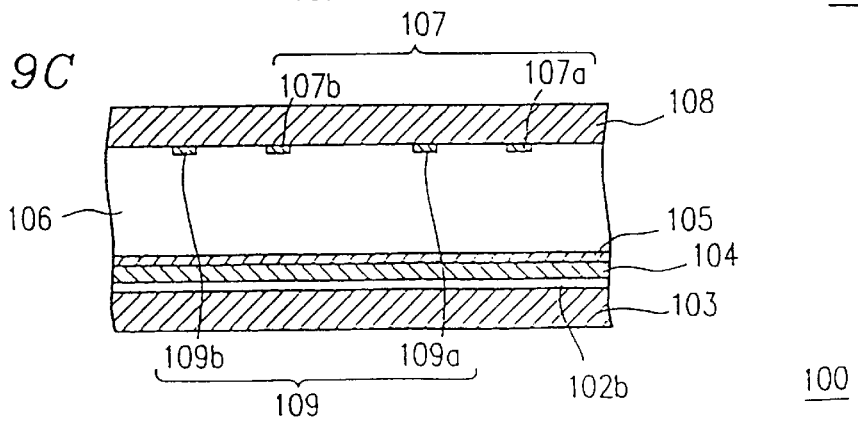
FIG. 9C is a cross sectional view of the AC-type PDP in FIG. 9A taken along line 9C–9C' in FIG. 9A.

As is shown in FIGS. 9B and 9C, the AC-type PDP 100 includes a first glass substrate 103 and a second glass substrate 108 opposed to each other. The first glass substrate 103 and the second glass substrate 108 form an outer casing of the AC-type PDP 100 together. On an inner face of the first glass substrate 103, a first electrode group including a plurality of scanning electrodes (first discharge electrodes) 101 and a plurality of sustaining electrodes (second discharge electrodes) 102 is located. A dielectric layer 104 is located on the first glass substrate 103, covering the first electrode group, and a protection layer 105 is located on the dielectric layer 104. On an inner face of the second glass substrate 108, a second electrode group including a plurality of data electrodes (third discharge electrodes; also referred to as "address electrodes") 107 and a plurality of erasing electrodes 109 is located.

As is illustrated in FIG. 9A, the scanning electrodes 101*a* through 101*n* (only 101*a*, 101*b* and 101*c* are shown here) and the sustaining electrodes 102*a* through 102*n* (only 102*a*, 102*b* and 102*c* are shown here) are provided in parallel alternately. The data electrodes 107*a* through 107*m* (only 107*a* and 107*b* are shown here) and the erasing electrodes 109*a* through 109*m* (only 109*a* and 109*b* are shown here) are both provided in parallel alternately so as to perpendicularly cross the scanning electrodes 101*a* through 101*n* and the sustaining electrodes 102*a* through 102*n*. Adjacent scanning electrode and sustaining electrode (for example, 101*a* and 102*a*) form a pair, and adjacent data electrode and erasing electrode (for example, 107*a* and 109*a*) form a pair. A projecting area of the scanning electrode and a projecting area of the sustaining electrode forming a pair are opposed to each other in an area S (FIG. 9A), where sustaining discharge occurs. The area S will be referred to as a "discharge area".

The data electrodes 107*a* through 107*m* and the erasing electrodes 109*a* through 109*m* are strip-shaped, and are formed of a material having a satisfactory conductivity such as Ag, Ni, ITO or $SnO_2$. The erasing electrodes 109*a* through 109*m* are each located so as to cross a middle part of the respective discharge area S.

The second electrode group including the data electrodes 107*a* through 107*m* and the erasing electrodes 109*a* through 109*m* is opposed to the protection layer 105 with a discharge space 106 full of discharge gas interposed therebetween. The dielectric layer 104 is formed of borosilicate glass or the like, and the protection layer 105 is formed of MgO or the like.

In the above-described example, the protection layer 105 is provided on the dielectric layer 104, but the protection layer 105 may be eliminated if the dielectric layer 104 can sufficiently withstand the discharge. The substrates 103 and 108 may be formed of ceramic instead of glass if a sufficient strength is provided. At least one of the substrates 103 or 108 needs to be a transparent substrate in order to allow discharge light to transmit therethrough.

Figure 10A:
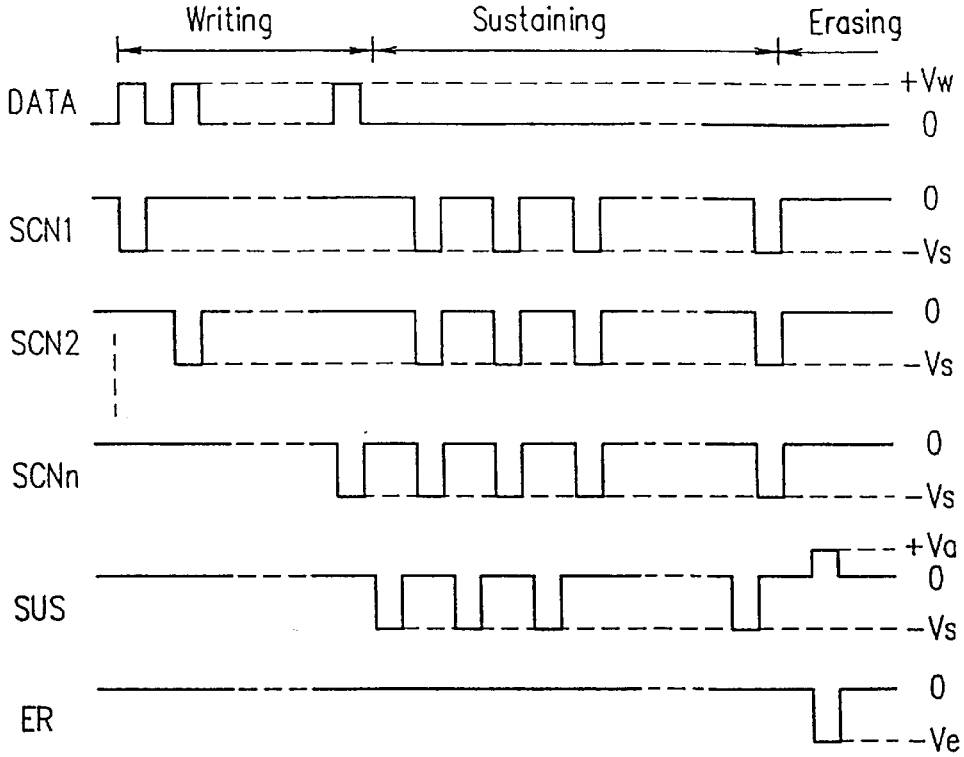
FIGS. 10A and 10B are timing charts illustrating a method for driving the AC-type PDP shown in FIG. 9A.
Figure 10B:
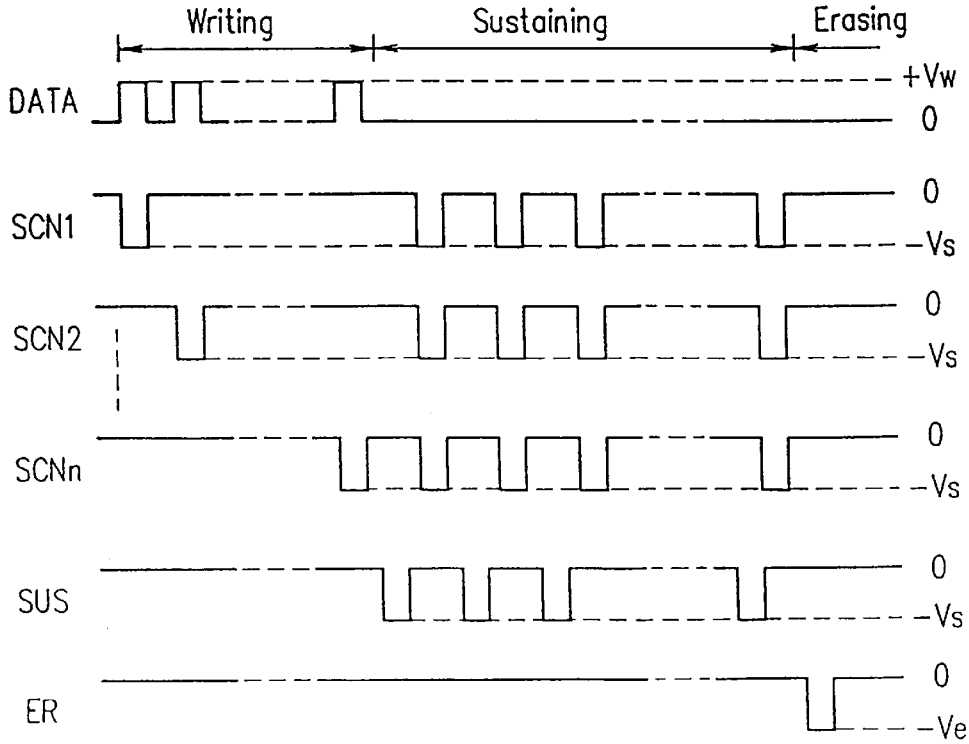

Hereinafter, a method for driving the AC-type PDP 100 will be described with reference to FIGS. 10A and 10B. FIGS. 10A and 10B are timing charts illustrating the operation of the AC-type PDP 100.

First, in the writing operation, a positive writing pulse having an amplitude of +Vw shown in waveform DATA in FIG. 10A is applied to at least one data electrode selected from the data electrodes 107*a* through 107*m* (for example, the data electrode 107*a*) which corresponds to a pixel for displaying an image in accordance with the scanning electrode 101*a*. Simultaneously, a negative scanning pulse having an amplitude of −Vs shown in waveform SCN1 is applied to the scanning electrode 101*a*. By such application, discharge occurs at an intersection W1 (FIG. 9A) of the data electrode 107*a* and the scanning electrode 101*a*, and thus a positive charge is stored in an area of a surface of the protection layer 105, the area positionally corresponding to the intersection W1. In other words, such an area acts as a write cell.

Next, a positive writing pulse having an amplitude of +Vw shown in waveform DATA is applied to at least one data electrode selected from the data electrodes 107*a* through 107*m* (for example, the data electrode 107*a*) which corresponds to a pixel for displaying an image in accordance with the scanning electrode 101*b*. Simultaneously, a negative scanning pulse having an amplitude of −Vs shown in waveform SCN2 is applied to the scanning electrode 101*b*. By such application, discharge occurs at an intersection W2 (FIG. 9A) of the data electrode 107*a* and the scanning electrode 101*b*, and thus a positive charge is stored in an area of the surface of the protection layer 105, the area positionally corresponding to the intersection W2. In other words, such an area acts as a write cell.

In this manner, during the process of applying negative scanning pulses having an amplitude of −Vs shown in waveforms SCN1 through SCNn to the scanning electrodes 101*a* through 101*n* respectively, a positive writing pulse having an amplitude of +Vw is applied to at least one selected data electrode which corresponds to a pixel for displaying an image in accordance with the respective scanning electrode. Thus, a positive charge is stored in a prescribed area (write cell) of the surface of the protection layer 105.

The writing operation is followed by the sustaining operation. In the sustaining operation, a negative sustaining pulse having an amplitude of −Vs shown in waveform SUS is applied to all the sustaining electrodes 102, and negative sustaining pulses having an amplitude of −Vs shown in waveforms SCN1 through SCNn are applied to all the scanning electrodes 101, respectively. The pulse application to the sustaining electrodes 102 and the pulse application to the scanning electrodes 101 are performed alternately. The application of the first sustaining pulse to each sustaining electrode 102 discharges the positive charge stored on the protection layer 105, and thus sustaining discharge occurs on the discharge area S which belongs to the same discharge cell as the respective intersection. The alternate application of the negative sustaining pulse to each sustaining electrode 102 and each scanning electrode 101 continues the sustaining discharge on the respective discharge area S. By light emission caused by such sustaining discharge, characters and images are displayed.

In the erasing operation, a positive erasing pulse having an amplitude of +Va shown in waveform SUS is applied to all the sustaining electrodes 102. Simultaneously a negative erasing pulse having an amplitude of −Ve shown in waveform EXT is applied to all the erasing electrodes 109. By such application, erasing discharge occurs between the sustaining electrodes 102 and the erasing electrodes 109, and thus the charge stored on the protection layer 105 by sustaining discharge is completely erased. As a result, the sustaining discharge does not continue even if a sustaining pulse is applied. Thus, the sustaining operation is terminated.

As is described above, in the erasing operation, the erasing discharge occurs between the sustaining electrodes 102 and the erasing electrodes 109 which are opposed to each other with the discharge space 106 interposed therebetween. At this point, discharge is induced also between the erasing electrodes 109 and the scanning electrodes 101 opposed thereto. Accordingly, when the discharge is finished, the protection layer 105 has a surface potential which is equal to the potential required for stopping the discharge, both in the area corresponding to a projecting area of the scanning electrode 101 and in the area corresponding to a projecting area of the sustaining electrode 102 in each discharge area S. In other words, the area of the protection layer 105 corresponding to a projecting area of the scanning electrode 101 and the area of a protection layer 105 corresponding to the projecting area of the sustaining electrode 102 have an equal potential in each discharge area S. Such a uniform potential eliminates the necessity of precise adjustment of the pulse voltage or the pulse width. Accordingly, the erasing operation can be performed accurately.

The erasing electrodes 109, which are supplied with a negative pulse, act as a cathode. If the erasing electrodes 109 are formed of a cathode material which is generally used for a cathode, a stable discharge effect can be obtained even if the pulse applied during the erasing operation is low. In other words, as is shown in FIG. 10A, at least one of the negative erasing pulse having an amplitude of −Ve shown in waveform ER and the positive scanning pulse having an amplitude of +Va may be lower. Accordingly, the erasing operation can be performed reliably at a lower power consumption. Preferable materials for the erasing electrodes 109 include metals such as Al, Ni and $LaB_6$ and oxides such as $La_{(x)}Sr_{(1-x)}CoO_3$, and $La_{(x)}Sr_{(1-x)}MnO_3$.

In a driving method shown in FIG. 10B, the negative erasing pulse having an amplitude of −Ve is applied to the erasing electrodes 109, but application of the positive erasing pulse having an amplitude of +Va to the sustaining electrodes 102 is eliminated. Such a manner of application is sufficient to erase the residual charge on the protection layer 105 if the erasing electrodes 109 are formed of one of the above-mentioned materials. In such a case, the sustaining electrodes 102 are supplied with a negative pulse but not with a positive pulse. This simplifies the structure of the driving circuit for the AC-type PDP 100 and reduces power consumption.

As is described above, in the AC-type PDP 100, the scanning electrodes 101 and the sustaining electrodes 102 are covered with the dielectric layer 104 and the protection layer 105. The data electrodes 107 and the erasing electrodes 109 are provided opposed to the protection layer 105 with the discharge space 106 interposed therebetween. By such a structure, erasing pulses can be applied to the sustaining electrodes 102 and the erasing electrodes 109 during the erasing operation to cause discharge between the sustaining electrodes 102 and the erasing electrodes 109. Thus, the residual charge on the protection layer 105 can be completely erased. As a result, the surface potential of the protection layer 105 obtained after the sustaining discharge can be uniform in each discharge area S even if the potential required for stopping the discharge is varied among different discharge cells or such a potential changes over time. Accordingly, a more highly reliable AC-type PDP can be obtained which reproduces characters and images accurately by eliminating influence of the residual charge. Since the erasing operation is performed by discharge caused between the sustaining electrodes 102 and the erasing electrodes 109 which are opposed to each other with the discharge space 106 interposed therebetween, it is not necessary to reduce the width of the erasing pulse as is in the conventional PDPs. Thus, insufficient erasing caused by fluctuation in the width of the narrow pulse can be prevented.

Example 2

Figure 11A:
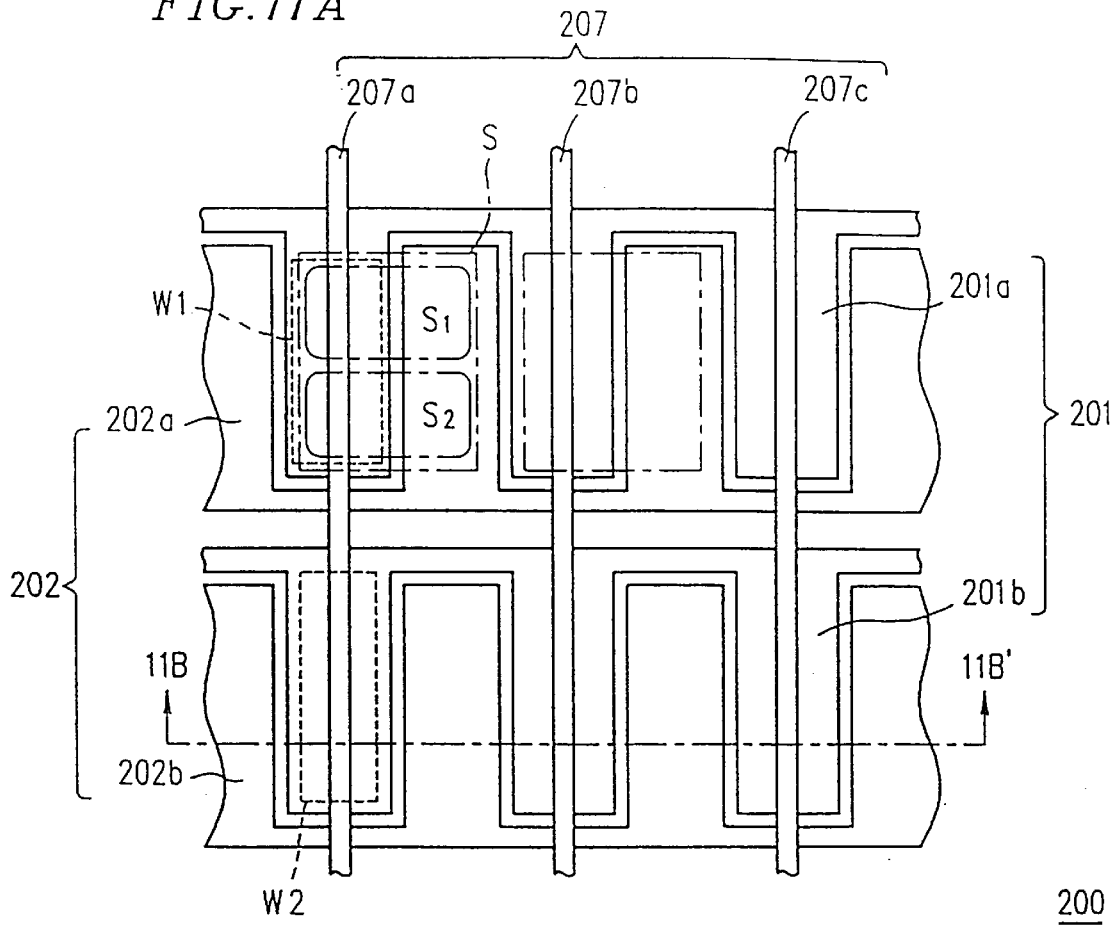
FIG. 11A is a partial plan view of an AC-type PDP in a second example according to the present invention, illustrating an arrangement of electrodes.
Figure 11B:
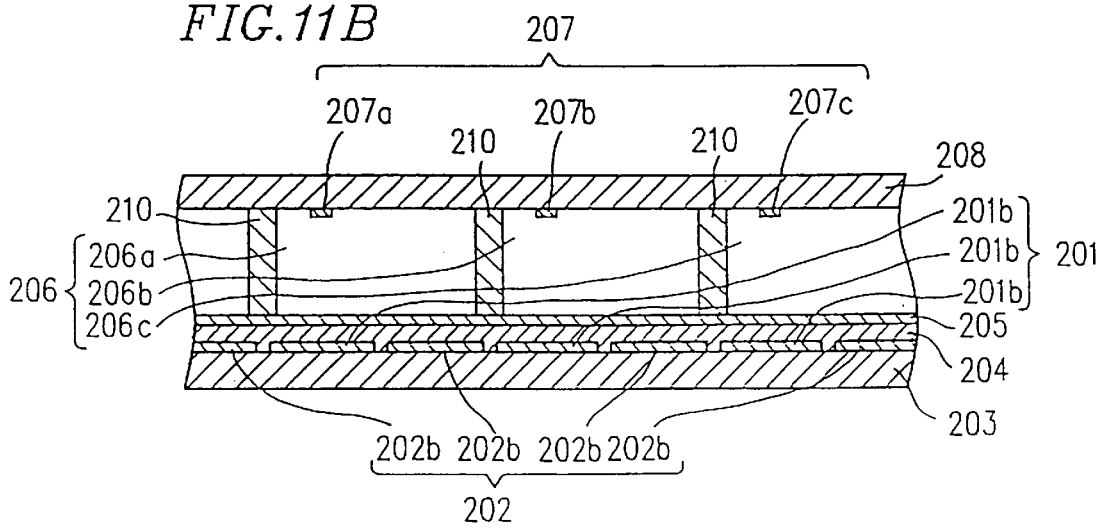
FIG. 11B is a cross sectional view of the AC-type PDP in FIG. 11A taken along line 11B–11B' in FIG. 11A.

An AC-type PDP in a second example according to the present invention will be described with reference to FIGS. 11A, 11B and 12. FIG. 11A is a partial plan view of an AC-type PDP 200 in the second example, illustrating an arrangement of electrodes. FIG. 11B is a cross sectional view of the AC-type PDP 200 taken along line 11B–11B'.

As is illustrated in FIG. 11B, an AC-type PDP 200 includes a first glass substrate 203 and a second glass substrate 208 opposed to each other. The first glass substrate 203 and the second glass substrate 208 form an outer casing of the AC-type PDP 200 together. On an inner face of the first glass substrate 203, a first electrode group including a plurality of comb-like scanning electrodes having teeth (first discharge electrodes) 201 and a plurality of comb-like sustaining electrodes having teeth (second discharge electrodes) 202 is located. A dielectric layer 204 is located on the first glass substrate 203, covering the first electrode group, and a protection layer 205 is located on the dielectric layer 204. On an inner face of the second glass substrate 208, a second electrode group including a plurality of data electrodes (third discharge electrodes; also referred to as "address electrodes") 207 is located. The data electrodes 207 are opposed to the protection layer 205 with a discharge space 206 interposed therebetween.

As is illustrated in FIG. 11A, the scanning electrodes 201*a* through 201*n* (only 202*a* and 202*b* are shown here) and the sustaining electrodes 202*a* through 202*n* (only 202*a* and 202*b* are shown here) are provided alternately. Adjacent scanning electrode and sustaining electrode (for example, 201*a* and 202*a*) are located opposed to each other with a small gap interposed therebetween so that teeth thereof are in engagement with each other.

The data electrodes 207*a* through 207*m* (only 207*a* through 207*c* are shown here) are provided opposed to and in the longitudinal direction of the teeth of the scanning electrodes 201*a* through 201*n*. As is illustrated in FIG. 11B, a plurality of insulation walls 210 are provided in the discharge space 206 to divide the discharge space 206 into a plurality of areas (for example, 206*a*, 206*b*, and 206*c*) of an appropriate size. (In FIG. 11A, the insulation walls 210 are eliminated for simplicity.) The dielectric layer 204 is formed of borosilicate glass or the like, and the protection layer 205 is formed of MgO or the like.

Hereinafter, a method for driving the AC-type PDP 200 will be described with reference to FIG. 12. FIG. 12 is a timing chart illustrating the operation of the AC-type PDP 200.

Figure 12:
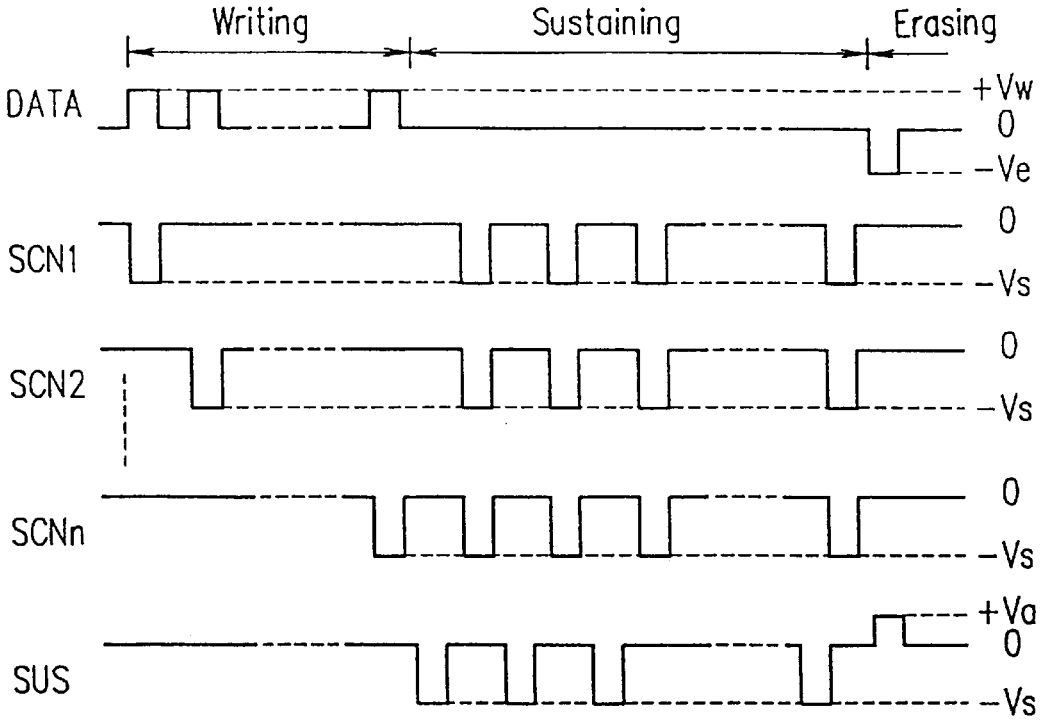
FIG. 12 is a timing chart illustrating a method for driving the AC-type PDP in FIG. 11A.

First, in the writing operation, a positive writing pulse having an amplitude of +Vw shown in waveform DATA in FIG. 12 is applied to at least one data electrode selected from the data electrodes 207*a* through 207*m* (for example, data electrode 207*a*) which corresponds to a pixel for displaying an image in accordance with the scanning electrode 201*a*. Simultaneously, a negative scanning pulse having an amplitude of −Vs shown in waveform SCN1 is applied to the scanning electrode 201*a*. By such application, uniform writing discharge occurs entirely on an intersection region W1 (FIG. 11A) where the data electrode 207*a* is opposed to the scanning electrode 201*a*. Thus, a positive charge is stored in an area of a surface of the protection layer 205, the area positionally corresponding to the intersection region W1, namely a tooth of the scanning electrode 201*a*. In other words, such an area acts as a write cell.

Next, a positive writing pulse having an amplitude of +Vw shown in waveform DATA is applied to at least one data electrode selected from the data electrodes 207*a* through 207*m* (for example, data electrode 207*a*) which corresponds to a pixel for displaying an image in accordance with the scanning electrode 201*b*. Simultaneously, a negative scanning pulse having an amplitude of −Vs shown in waveform SCN2 is applied to the scanning electrode 201*b*. By such application, uniform discharge occurs entirely on an intersection region W2 (FIG. 11A) where the data electrode 207*a* is opposed to the scanning electrode 201*a*. Thus, a positive charge is stored in an area of the surface of the protection layer 205, the area positionally corresponding to the intersection region W2, namely, a tooth of the scanning electrode 201*b*. In other words, such an area acts as a write cell.

In this manner, in the process of applying negative scanning pulses having an amplitude of −Vs shown in waveforms SCN1 through SCNn to the scanning electrodes 201*a* through 201*n* respectively, a positive writing pulse having an amplitude of +Vw is applied to at least one selected data electrode which corresponds to a pixel for displaying an image in accordance with the respective scanning electrode. Thus, uniform writing discharge occurs on the intersection region where the data electrode 207 and the scanning electrode 201 are opposed to each other. As a result, a positive charge is uniformly distributed in the area of the surface of the protection layer 205 corresponding to each tooth of the scanning electrodes 201 (write cell).

The writing operation is followed by the sustaining operation. In the sustaining operation, a negative sustaining pulse having an amplitude of −Vs shown in waveform SUS is applied to all the sustaining electrodes 202, and negative sustaining pulses having an amplitude of −Vs shown in waveforms SCN1 through SCNn are applied to all the scanning electrodes 201. The pulse application to the sustaining electrodes 202 and the pulse application to the scanning electrodes 201 are performed alternately. The application of the first sustaining pulse to each sustaining electrode 202 discharges the positive charge stored on the protection layer 205, and thus sustaining discharge occurs on a discharge area S (FIG. 11A) which belongs to the same discharge cell as the respective intersection region (for example, the region W1). The alternate application of the negative sustaining pulse to the sustaining electrodes 202 and the scanning electrodes 201 continues the sustaining discharge on the discharge area S. By light emission caused by such sustaining discharge, characters and images are displayed.

Since the scanning electrodes 201 and the sustaining electrodes 202 are arranged so that the teeth thereof are in engagement with each other, the sustaining discharge occurs uniformly on the entire discharge area S, with no difference between parts S1 and S2. Accordingly, movement of the charge during the sustaining operation (sustaining discharge) is performed uniformly in each discharge area S.

In the erasing operation, a positive erasing pulse having an amplitude of +Va shown in waveform SUS is applied to all the sustaining electrodes 202. Simultaneously, a negative erasing pulse having an amplitude of −Ve shown in waveform DATA is applied to all the data electrodes 207. By such application, erasing discharge occurs between the data electrodes 207 and the sustaining electrodes 202, and thus the charge stored on the protection layer 205 by the sustaining discharge is completely erased. As a result, the sustaining discharge does not continue even if a sustaining pulse is applied. Thus, the sustaining operation is terminated.

As is described above, in the erasing operation, erasing discharge occurs between the sustaining electrodes 202 and the data electrodes 207 which are opposed to each other with the discharge space 206 interposed therebetween. At this point, discharge is induced also between the data electrodes 207 and the scanning electrodes 201 opposed thereto. Accordingly, the residual charge on each discharge areas S on the protection layer 205 is erased completely and uniformly. In other words, the voltage between the area of the protection layer 205 corresponding to the scanning electrode 201 and the data electrode 207 can be equal to the voltage between the area of the protection layer 205 corresponding to the sustaining electrode 202 and the data electrode 207 in each discharge area S. Moreover, since the erasing discharge occurs between the data electrodes 207 and the sustaining electrodes 202 opposed to each other, it is not necessary to use a narrow erasing pulse. Accordingly, delay in starting the erasing discharge caused by fluctuation in the width of the narrow pulse can be prevented. Thus, reliability of the erasing operation is enhanced.

Figure 13A:
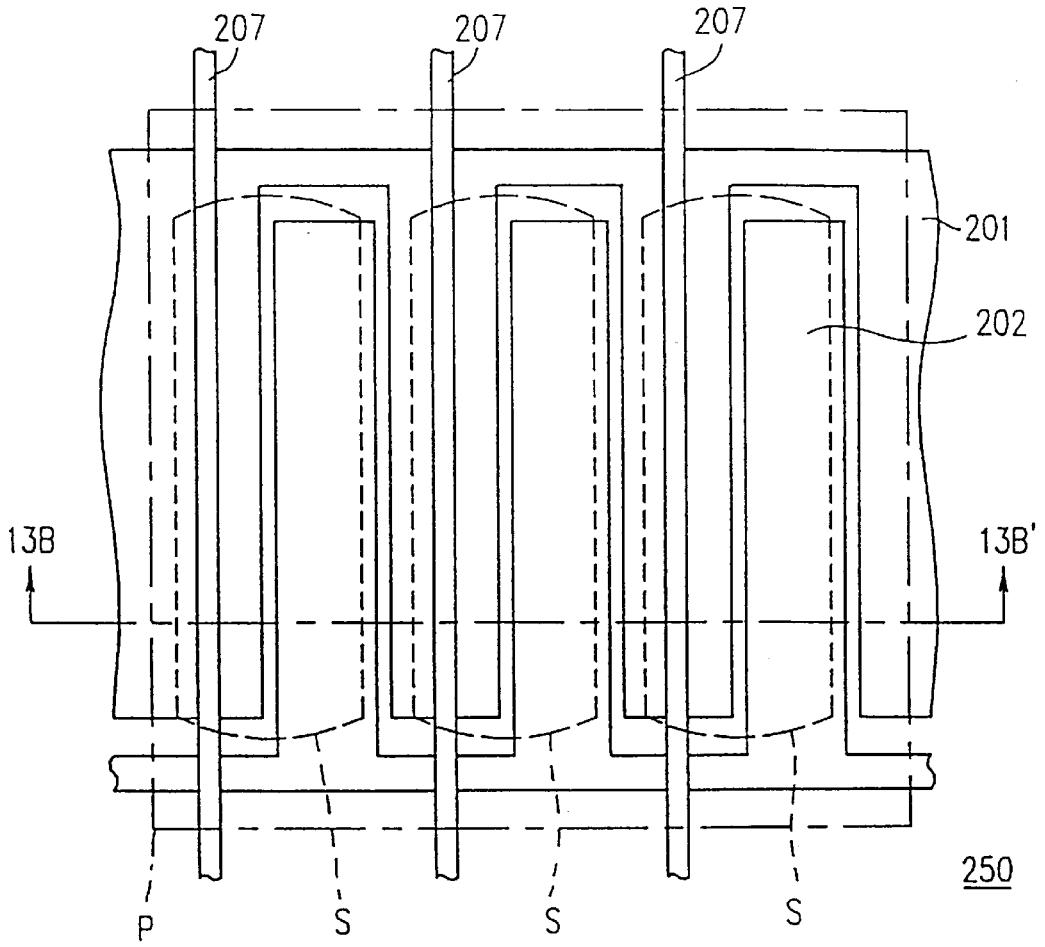
FIG. 13A is a partial plan view of an AC-type PDP in a modification of the second example, illustrating an arrangement of electrodes.
Figure 13B:
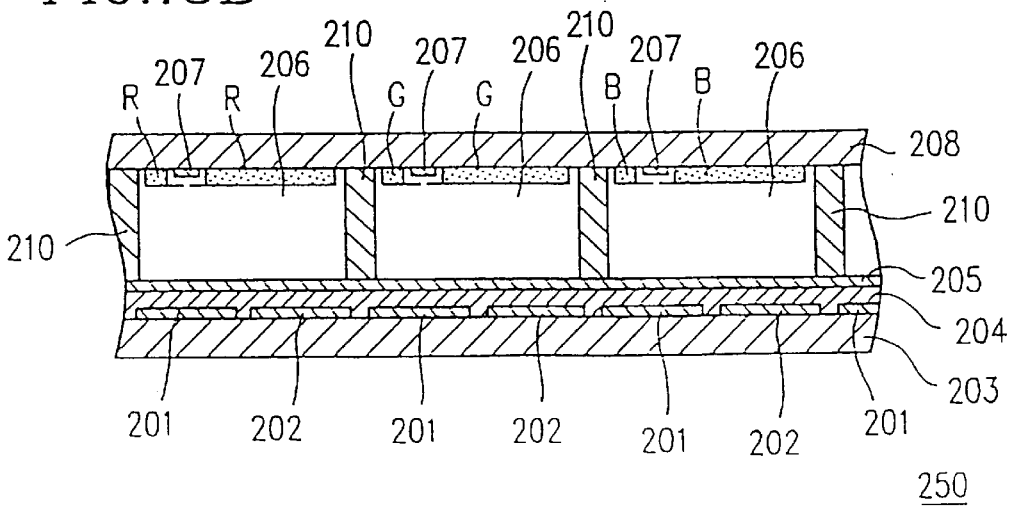
FIG. 13B is a cross sectional view of the AC-type PDP in FIG. 13A taken along line 13B–13B' in FIG. 13A.

With reference to FIGS. 13A and 13B, an AC-type PDP in a modification of the second example according to the present invention will be described. FIG. 13A is a partial plan view of an AC-type PDP 250 in the modification, illustrating an arrangement of electrodes. FIG. 13B is a cross sectional view of the AC-type PDP 250 taken along line 13B–13B'. The same element as those in FIGS. 11A and 11B bear the same reference numerals.

In the AC-type PDP 250, three types of phosphor layers R, G and B for emitting light of red, green and blue respectively are located on the inner face of the second glass substrate 208. The AC-type PDP 250 has the same structure as that of the AC-type PDP 200 except for the phosphor layers R, G and B. The phosphor layers R, G and B are respectively in substantial positional correspondence with three discharge areas S in one pixel area P (FIG. 13A) which is substantially square, and are excited to emit light upon receiving ultraviolet rays generated by discharge in the areas S.

Since the data electrodes 207 of the AC-type PDP 250 are located opposed to and in the longitudinal direction of the teeth of the scanning electrodes 201, each discharge area S is enlarged. The luminance of the light is raised in accordance with the enlargement. Although the phosphor layers R, G and B do not cover the data electrodes 207 in FIG. 13B, the phosphor layers R, G and B may cover the data electrodes 207 completely.

Figure 14A:
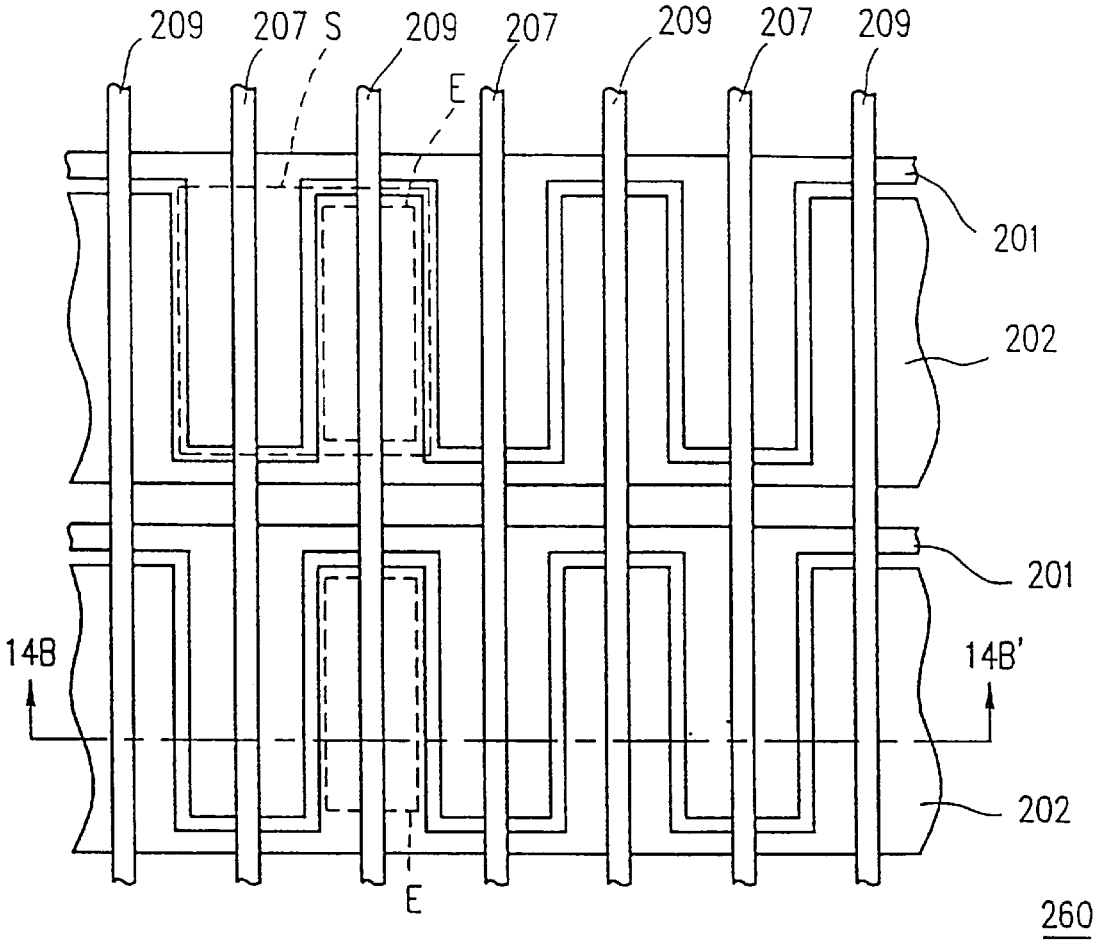
FIG. 14A is a partial plan view of an AC-type PDP in another modification of the second example, illustrating an arrangement of electrodes.
Figure 14B:
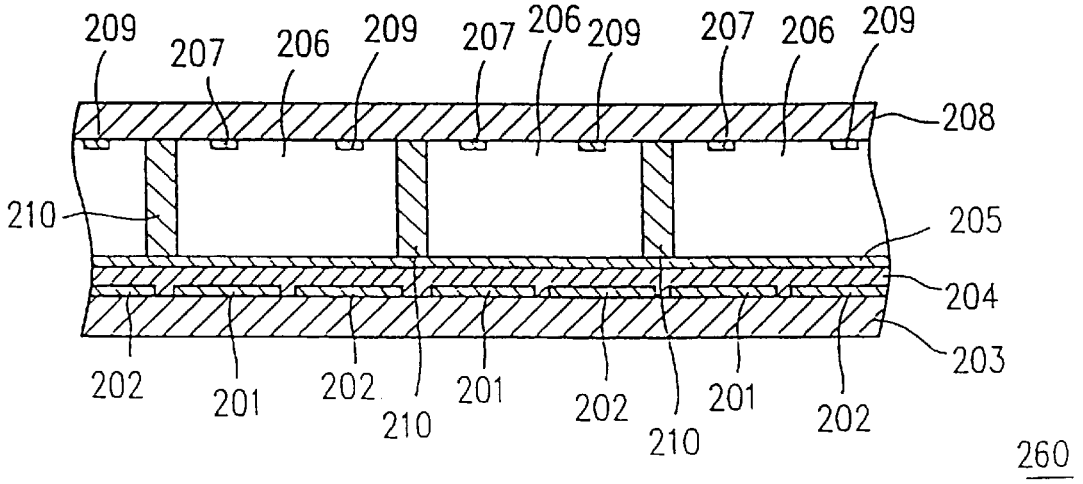
FIG. 14B is a cross sectional view of the AC-type PDP in FIG. 14A taken along line 14B–14B' in FIG. 14A.

With reference to FIGS. 14A and 14B, an AC-type PDP 260 in another modification of the second example according to the present invention will be described. FIG. 14A is a partial plan view of the AC-type PDP 260, illustrating an arrangement of electrodes. FIG. 14B is a cross sectional view of the AC-type PDP 260 taken along line 14B–14B'. The AC-type PDP 260 has the structure of the AC-type PDP 200 and is also provided with the erasing electrodes 209 described in the first example.

The erasing electrodes 209 are provided in parallel on the inner face of the second glass substrate 208 so as to be adjacent to the data electrodes 207, respectively. The erasing electrodes 209 are arranged opposed to and in the longitudinal direction of the teeth of the sustaining electrodes 202. The AC-type PDP 260 has the same structure as that of the AC-type PDP 200 except for the above-described point. The same elements as those of the AC-type 200 in FIGS. 11A and 11B bear the same reference numerals.

In order to use the AC-type PDP 260 for color display, the phosphor layers R, G and B are provided on the inner face of the second glass substrate 208 so as to be in positional correspondence with the respective discharge area S as is shown in FIG. 13A.

The AC-type PDP 260 is driven by the same method described with reference to FIGS. 10A and 10B. Accordingly, detailed description thereof will be omitted here.

In the AC-type PDP 260, the erasing electrodes 209 and the teeth of the sustaining electrodes 202 are provided in parallel and opposed to each other with the discharge space 206 interposed therebetween. Due to such a structure, discharge between the erasing electrodes 209 and the sustaining electrodes 202 occur uniformly in an entire area E (FIG. 14A). As a result, the difference between the surface potential of the area of the protection layer 205 corresponding to the tooth of the scanning electrode 201 and the surface potential of the area of the protection layer 205 corresponding to the tooth of the sustaining electrode 202 in each discharge area S can be eliminated more reliably. Since it is not necessary to apply both positive and negative pulses to the data electrodes 207, the circuit for applying pulses to the data electrodes 207 can be simplified.

Figure 15A:
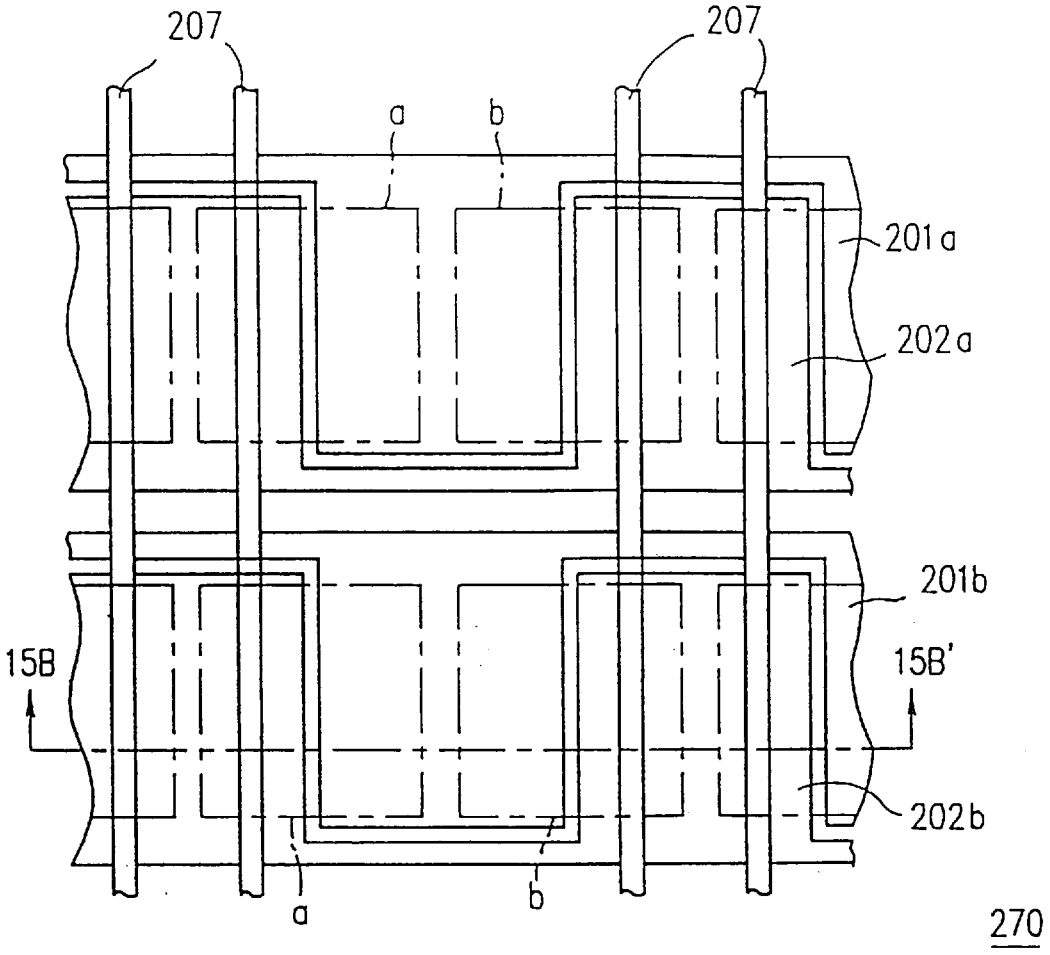
FIG. 15A is a partial plan view of an AC-type PDP in still another modification of the second example, illustrating an arrangement of electrodes.
Figure 15B:
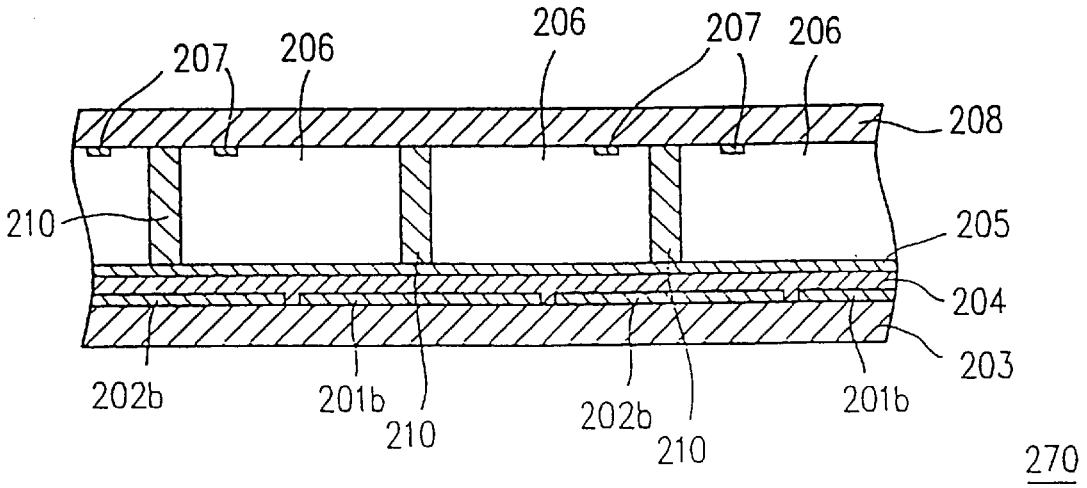
FIG. 15B is a cross sectional view of the AC-type PDP in FIG. 15A taken along line 15B–15B' in FIG. 15A.

An AC-type PDP 270 in still another modification will be described with reference to FIGS. 15A and 15B. FIG. 15A is a partial plan view of the AC-type PDP 270, illustrating an arrangement of electrodes. FIG. 15B is a cross sectional view of the AC-type PDP 270 taken along line 15B–15B'. The same elements as those in FIGS. 11A and 11B bear the same reference numerals.

As is illustrated in FIG. 15A, in the AC-type PDP 270, the scanning electrodes 201 and the sustaining electrodes 202 each have teeth. Half of a tooth of one scanning electrode (for example, 201*a*) and half of a tooth of one sustaining electrode (for example, 202*a*) which are adjacent to each other form a discharge area a. In the same manner, half of the tooth of the sustaining electrode 202*a* and half of another tooth of the scanning electrode 201*a* form a discharge area b. Due to such a structure, the number of teeth which need to be formed is reduced to half. Accordingly, the scanning electrodes 201 and the sustaining electrodes 202 are formed more easily, and production yield is raised.

Figure 16A:
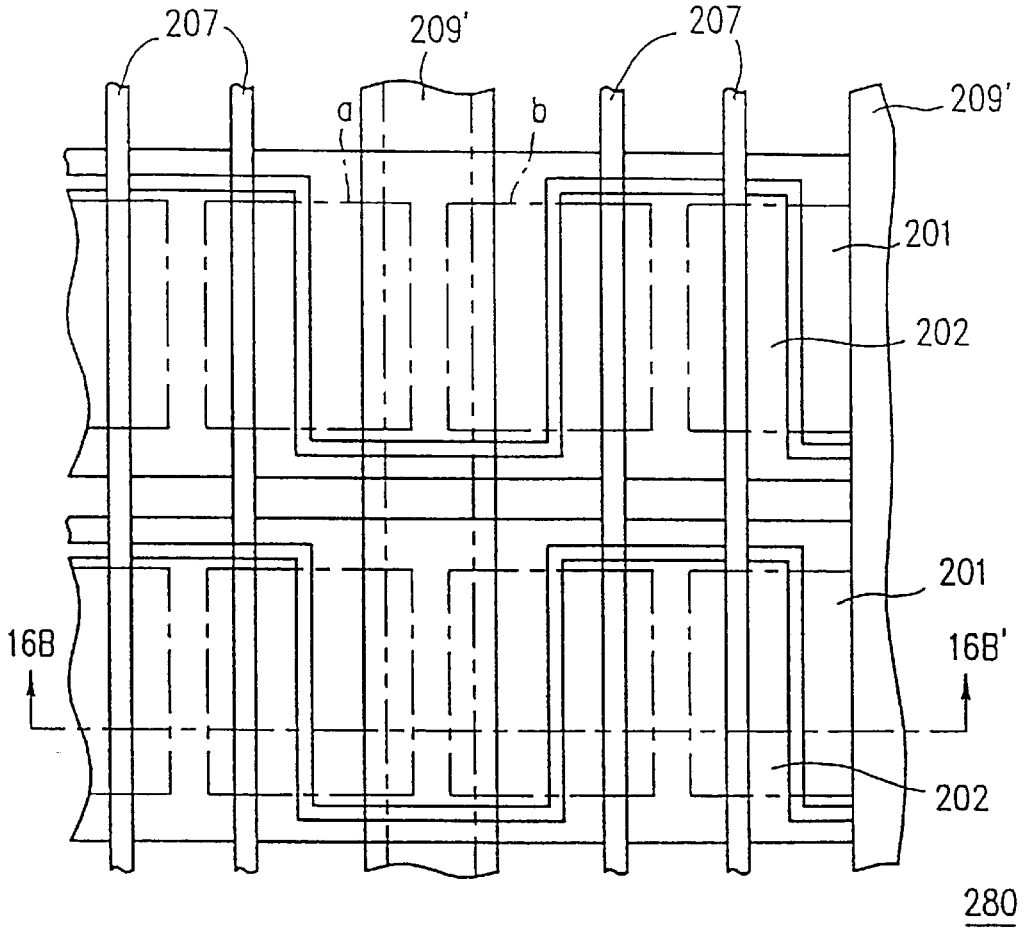
FIG. 16A is a partial plan view of an AC-type PDP, illustrating an arrangement of electrodes.
Figure 16B:
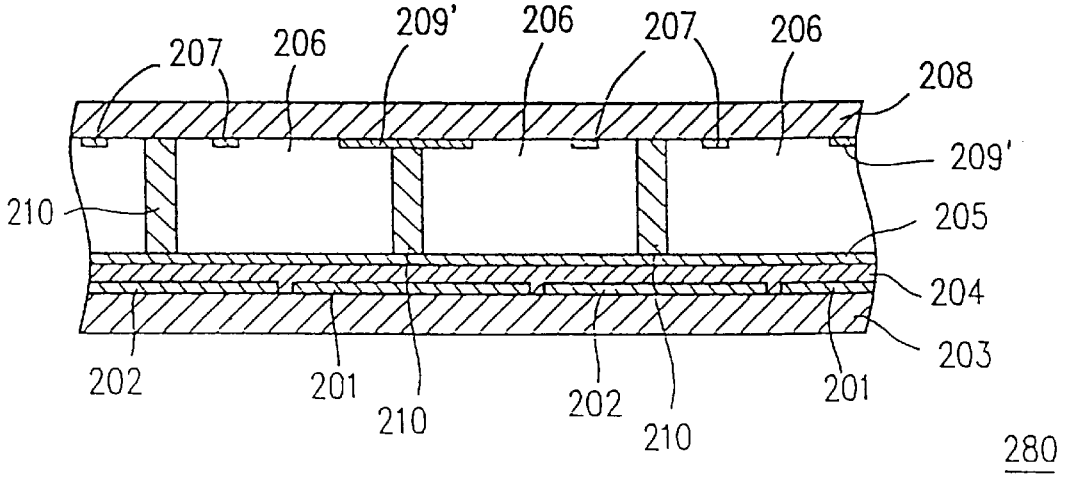
FIG. 16B is a cross sectional view of the AC-type PDP in FIG. 16A taken along line 16B–16B' in FIG. 16A.

FIGS. 16A and 16B show an AC-type PDP 280 in still another modification of the second example. The AC-type PDP 280 has the structure of the AC-type PDP 270 and is also provided with the erasing electrodes 209'. FIG. 16A is a partial plan view of the AC-type PDP 280, illustrating an arrangement of electrodes. FIG. 16B is a cross sectional view of the AC-type PDP 280 taken along line 16B–16B'. The same elements as those in FIGS. 11A and 11B bear the same reference numerals.

As is illustrated in FIG. 16A, each erasing electrode 209' is provided so as to cover both an end of the discharge area a and an end of the discharge area b. Each erasing electrode 209' may be formed of two thin lines as is indicated by the two-dot chain line in FIG. 16A. Since the same voltage is applied to these two thin lines, the erasing electrodes 209' as is indicated by the solid line in FIG. 16A is easier to produce and raises production yield.

The AC-type PDPs 270 and 280 are driven by the same method as the AC-type PDP 200. Needless to say, the phosphor layers R, G and B may be provided in the AC-type PDPs 270 and 280 in the same manner as in FIG. 13B.

As has been described so far, in the second example according to the present invention, the scanning electrodes 201 and the sustaining electrodes 202 have teeth and are in engagement with each other with a small gap interposed therebetween. The data electrodes 207 are arranged opposed to and in the longitudinal direction of the teeth of the scanning electrodes 201. By such a structure, the writing charge generated by writing discharge is distributed uniformly in the entire area of the surface of the protection layer 205 corresponding to each tooth of the scanning electrodes 201.

Further, movement of the charge between the scanning electrodes 201 and the sustaining electrodes 202 during the sustaining operation (sustaining discharge) is performed uniformly on each area where two adjacent teeth of the scanning electrode 201 and the sustaining electrode 202 are engaged with each other. Thus, the residual charge on the area of the surface of the protection layer 205 corresponding to each discharge area can be erased uniformly and completely by the erasing operation.

When positive and negative pulses are applied to the data electrodes 207 and the sustaining electrodes 202 respectively to cause erasing discharge, discharge is easily induced between the data electrodes 207 and the scanning electrodes 201. As a result, the difference between the surface potential of the area of the protection layer 205 corresponding to the scanning electrode 201 and the surface potential of the area of the protection layer 205 corresponding to the sustaining electrode 202 in each discharge area can be reliably reduced to null.

By forming the scanning electrodes 201 and the sustaining electrodes 202 to have teeth and arranging the electrodes to be in engagement with each other, sustaining discharge and erasing discharge occur uniformly on the area of the surface of the protection layer 205 corresponding to two adjacent teeth of the engaging scanning electrode and sustaining electrode. As a consequence, the sustaining operation and the erasing operation are performed reliably. Accordingly, satisfactory image reproduction can be realized, and a color image having a high luminance can be displayed efficiently.

Example 3

Figure 17A:
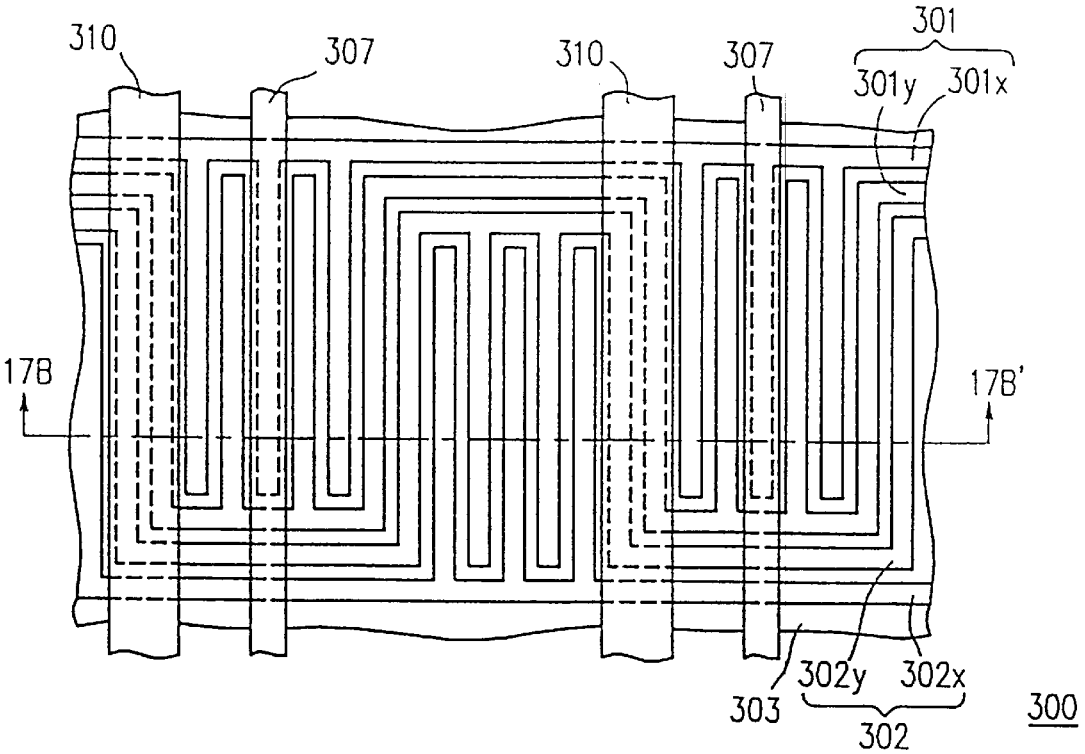
FIG. 17A is a partial plan view of an AC-type PDP in a third example according to the present invention, illustrating an arrangement of electrodes.
Figure 17B:
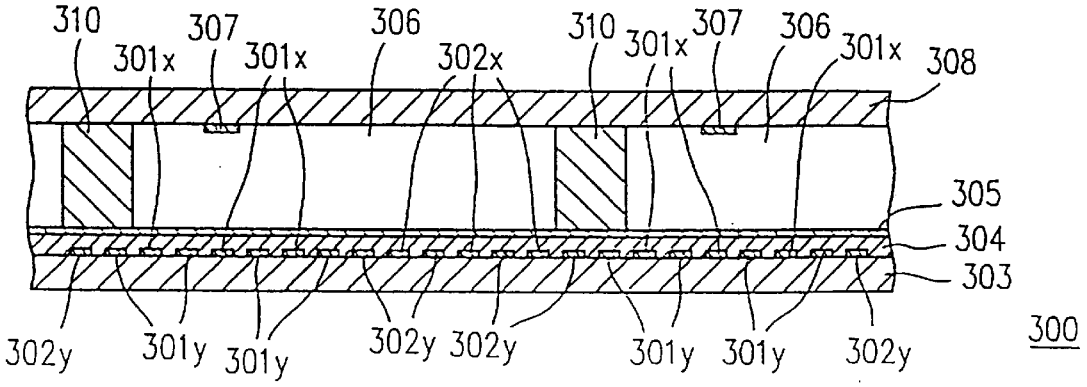
FIG. 17B is a cross sectional view of the AC-type PDP in FIG. 17A taken along line 17B–17B' in FIG. 17A.

An AC-type PDP 300 in a third example according to the present invention will be described with reference to FIGS. 17A and 17B. FIG. 17A is a partial plan view of an AC-type PDP 300 in the third example, illustrating an arrangement of electrodes. FIG. 17B is a cross sectional view of the AC-type PDP 300 taken along line 17B–17B'.

As is illustrated in FIG. 17A, scanning electrodes 301 and sustaining electrodes 302 are each divided into a plurality of areas. The AC-type PDP 300 has the same structure as those of the AC-type PDP 200 in the second example except for this point.

In detail, each scanning electrode 301 located on an inner face of a first glass substrate 303 is divided into a first area 301*x* and a second area 301*y*. The first area 301*x* and the second area 301*y* are both tooth-like and are in engagement with each other with a small gap interposed therebetween. Each sustaining electrode 302 adjacent to the scanning electrode 301 is divided into a first area 302*x* and a second area 302*y*. The first area 302*x* and the second area 302*y* are both tooth-like and are in engagement with each other with a small gap interposed therebetween. A terminal connected to each of the first areas 301*x* and 302*x* and the second areas 301*y* and 302*y* is drawn externally separately.

In FIGS. 17A and 17B, reference numeral 304 denotes a dielectric layer, reference numeral 305 denotes a protection layer, reference numeral 306 denotes a discharge space, reference numeral 307 denotes a data electrode, and reference numeral 308 denotes a second glass substrate.

A method for driving the AC-type PDP 300 will be described.

In the writing operation, a positive writing pulse is applied to a selected data electrode 307, and a negative scanning pulse is applied to a prescribed scanning electrode 301. By such application, discharge occurs on an intersection region where the selected data electrode 307 is opposed to the prescribed scanning electrode 301. Thus, a positive charge is stored in an area of a surface of the protection layer 305 corresponding to the intersection region.

In the sustaining operation following the writing operation, a negative sustaining pulse is applied to the sustaining electrodes 302 and the scanning electrodes 301 alternately, and thus sustaining discharge is continued. By light emission caused by such sustaining discharge, characters and images are displayed.

In such a structure, the capacitance between one of the first area 301*x* and the second area 301*y* of each scanning electrode 301 and the protection layer 305 is approximately half of the capacitance between both of the first area 301*x* and the second area 301*y* and the protection layer 305. The capacitance between one of the first area 302*x* and the second area 302*y* of each sustaining electrode 302 and the protection layer 305 is approximately half of the capacitance between both of the first area 302*x* and the second area 302*y* and the protection layer 305. Accordingly, the luminance of light emitted by discharge caused by applying a pulse to one of the first area 301*x* and the second area 301*y* and one of the first area 302*x* and the second area 302*y* is half of the luminance of light emitted by discharge caused by applying a pulse to both of the first area 301*x* and the second area 301*y* and both of the first area 302*x* and the second area 302*y*.

The luminance of light emitted by discharge caused by applying a pulse to one of the first area 301*x* and the second area 301*y* of the scanning electrode 301 and both of the first area 302*x* and the second area 302*y* of the sustaining electrodes 302 is intermediate between the luminance of light emitted by discharge caused by applying a pulse to both of the first area 301*x* and the second area 301*y* of the scanning electrode 301 and both of the first area 302*x* and the second area 302*y* of the sustaining electrodes 302 and half of such a luminance. The luminance of light emitted by discharge caused by applying a pulse to one of the first area 302*x* and the second area 302*y* and both of the first area 301*x* and the second area 301*y* is also intermediate between the luminance of light emitted by discharge caused by applying a pulse to both of the first area 301*x* and the second area 301*y* and both of the first area 302*x* and the second area 302*y* and half of such a luminance.

Although the scanning electrodes 301 and the sustaining electrodes 302 are each divided into two areas having an equal size in the above-described example, each electrode may be divided into three or more areas, and the ratio of the areas may be determined arbitrarily. The areas 301*x*, 301*y*, 302*x* and 302*y* may have other shapes. A similar effect can be achieved if the scanning electrodes 301 or the sustaining electrodes 302 are divided into a plurality of areas.

The AC-type PDP 300 has been described as being obtained as a result of a modification of the AC-type PDP 300. The same modification may be applied to the AC-type PDP 250, 260, 270 and 280. The same modification may also be applied to the AC-type PDP 100 where the projecting areas of the scanning electrodes 101 are opposed to the projecting areas of the sustaining electrodes 102.

As has been described so far, in the third example, at least one of the scanning electrodes 301 and the sustaining electrodes 302 are divided into a plurality of areas. The capacitance between the scanning electrodes 301 and the protection layer 305 and the capacitance between the sustaining electrodes 302 and the protection layer 305 can be arbitrarily varied by using the divided electrodes and the undivided electrodes in various combinations.

The discharge current flowing between the scanning electrodes 301 and the sustaining electrodes 302 is substantially in proportion to the above-mentioned capacitance. The luminance of light emitted as a result of discharge is substantially in proportion to the above-mentioned capacitance. The luminance of light emitted by discharge can be changed depending on whether a pulse is to be applied to one of the areas or a plurality of the areas. In the resultant AC-type PDP, the luminance of light can be adjusted in a wide range. Since the luminance of light emitted by performing discharge once can be arbitrarily selected, the luminance of the image can be selected in accordance with the environment or the like.

Example 4

A method for driving an AC-type PDP in a fourth example according to the present invention will be described with reference to FIG. 18.

The method in the fourth example mainly relates to application of a sustaining pulse performed in a sustaining period. The application of a writing pulse and an erasing pulse is performed in the same manner as is described in the first example.

Figure 18:
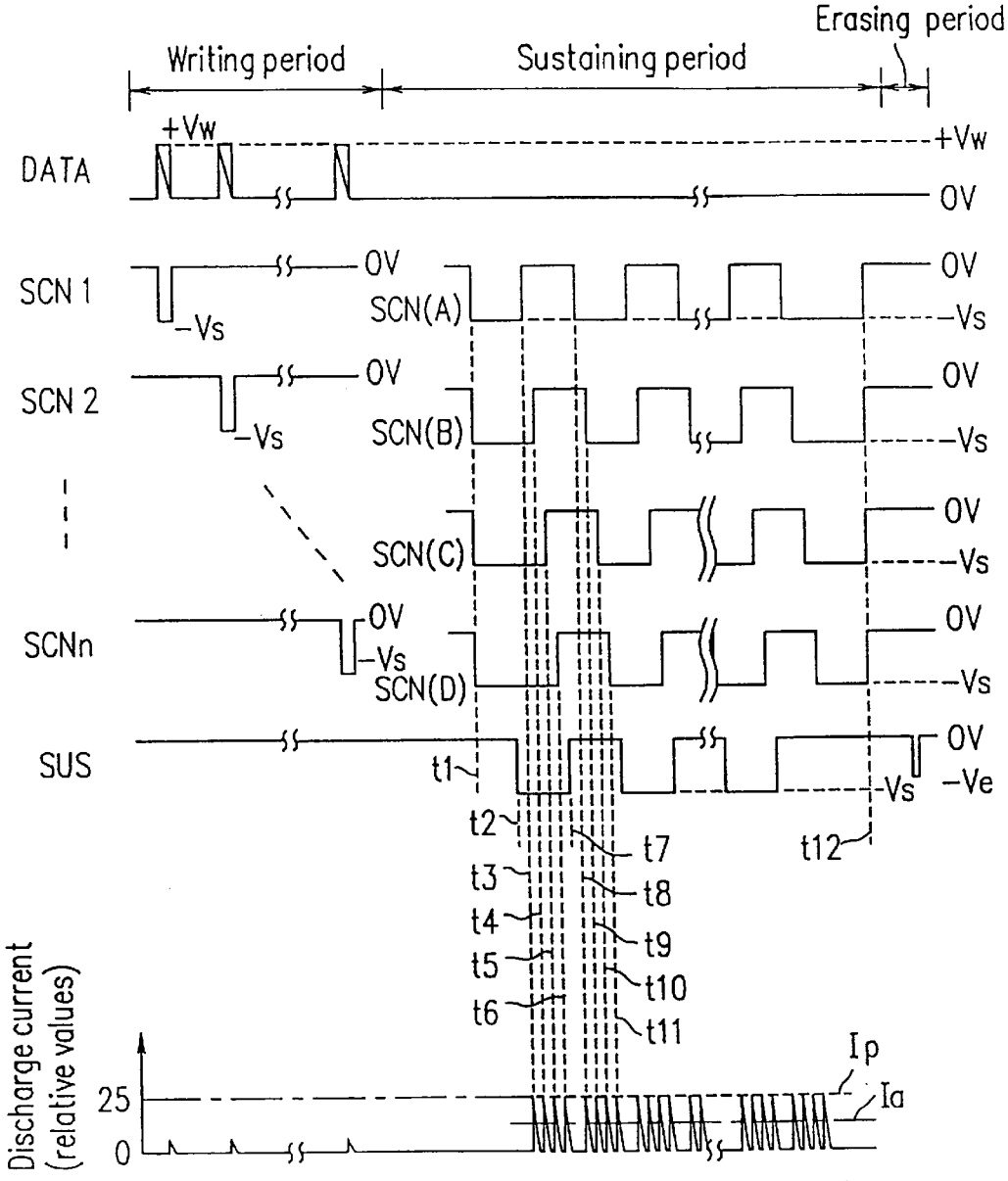
FIG. 18 is a timing chart illustrating a method for driving an AC-type PDP in a fourth example according to the present invention.

In the writing operation performed in a writing period, a positive writing pulse having an amplitude of +Vw shown in waveform DATA in FIG. 18 is applied to at least one data electrode selected from all the data electrodes which corresponds to a pixel for displaying an image in accordance with one scanning electrode (for example, the scanning electrode 102*a* in FIG. 9A). Simultaneously, a negative scanning pulse having an amplitude of −Vs shown in waveform SCN1 is applied to the scanning electrode 102*a*. By such application, discharge occurs at an intersection of the data electrode and the scanning electrode 102*a*, and thus a positive charge is stored in an area of a surface of the protection layer, the area positionally corresponding to the intersection. In other words, such an area acts as a write cell.

Next, a positive writing pulse having an amplitude of +Vw shown in waveform DATA is applied to at least one selected data electrode which corresponds to a pixel for displaying an image in accordance with the next scanning electrode (for example, the scanning electrode 102*b* in FIG. 9A). Simultaneously, a negative scanning pulse having an amplitude of −Vs shown in waveform SCN2 is applied to the scanning electrode 102*b*. By such application, discharge occurs at an intersection of the data electrode and the scanning electrode 102*b*. Thus, a positive charge is stored in an area of the surface of the protection layer, the area positionally corresponding to the intersection. In other words, such an area acts as a write cell.

In this manner, during the process of applying negative scanning pulses having an amplitude of −Vs shown in waveforms SCN1 through SCNn to the scanning electrodes respectively, a positive writing pulse having an amplitude of +Vw is applied to at least one selected data electrode which corresponds to a pixel for displaying an image in accordance with the respective scanning electrode. Thus, a positive charge is stored in a prescribed area (write cell) of the surface of the protection layer.

In a sustaining period following the writing period, the plurality of scanning electrodes are divided into four groups A through D. As is shown in waveforms SCN(A) through SCN(D), negative sustaining pulses having an amplitude of −Vs are applied to the scanning electrodes in groups A through D simultaneously, but the timing at which the amplitude of the pulse returns to 0 V is different group by group. In other words, the scanning electrodes in different groups are supplied with pulses having different phases.

In detail, at time t1, a negative sustaining pulse having an amplitude of −Vs is applied to all the scanning electrodes, thereby lowering the voltage in such scanning electrodes from 0 V to −Vs. Since this sustaining pulse is of the same polarity as the scanning pulse applied during the writing period, a voltage only corresponding to a difference between the voltage corresponding to the level of the charge stored on a surface of the protection layer and the amplitude −Vs of the sustaining pulse is applied between a pair of scanning electrode and sustaining electrode. Accordingly, sustaining discharge does not occur at time t1. As is appreciated from this, time t1 is not the time to cause the sustaining discharge but is the time to match the phase of the pulses to be applied to the scanning electrodes of groups A through D.

At time t2, a negative sustaining pulse having an amplitude of −Vs shown in waveform SUS in FIG. 18 is applied to all the sustaining electrodes. Since a voltage only corresponding to the level of the charge stored on the surface of the protection layer is applied between each pair of scanning electrode and sustaining electrode, sustaining discharge does not occur yet.

At time t3, the level of the voltage in the scanning electrodes in group A is raised from −Vs to 0 V as is shown in waveform SCN(A). By such a change, a voltage corresponding to the sum of a positive voltage corresponding to the level of the charge stored on the protection layer and the amplitude −Vs of the negative sustaining pulse is applied between each scanning electrode in group A and the sustaining electrode forming a pair therewith. By such application, sustaining discharge occurs between such pairs.

In the same manner, at time t4 when the level of the voltage in the scanning electrodes in group B is raised from −Vs to 0 V as is shown in waveform SCN(B), sustaining discharge occurs between each scanning electrode in group B and the sustaining electrode forming a pair therewith. At time t5 and t6 respectively when the level of the voltage in the scanning electrodes in each of groups C and D is raised from −V to 0 V as is shown in waveforms SCN(C) and SCN(D), sustaining discharge occurs between each scanning electrode in each of groups C and D and the sustaining electrode forming a pair therewith.

By time t7 when the level of the voltage in all the sustaining electrodes is raised from −Vs to 0 V, the voltage in each scanning electrode has already been changed to 0 V. Accordingly, sustaining discharge does not occur.

At time t8, a negative sustaining pulse is applied to the scanning electrodes in group A as is shown in waveform SCN(A), and thus the level of the voltage in such scanning electrodes is lowered from 0 V to −Vs. By such a change, a voltage corresponding to the sum of the positive voltage corresponding to the level of the charge stored on the surface of the protection layer and the amplitude −Vs of the negative sustaining pulse is applied between each scanning electrode in group A and the sustaining electrode forming a pair therewith. By such a change, the sustaining discharge occurs again between such pairs.

In the same manner, at time t9, t10 and t11 respectively when the level of the voltage in the scanning electrodes in each of groups B, C and D is lowered from 0 V to −Vs as is shown in waveforms SCN(B), SCN(C) and SCN(D), sustaining discharge occurs between each scanning electrode in each of groups B, C and D and the sustaining electrode forming a pair therewith.

The sustaining operation from t2 to t11 is repeated during the sustaining period.

At time t12 in the final sustaining operation during the sustaining period, the level of the voltage in all the scanning electrodes is changed to 0 V to prepare for an erasing period. Since the voltage in all the sustaining electrodes has already been changed to 0 V by time t12, sustaining discharge does not occur at this point.

In the erasing operation during the erasing period, a narrow erasing pulse having an amplitude of −Ve is applied to all the sustaining electrodes. By such application, the charge stored on the protection layer is neutralized. Thus, the sustaining discharge is terminated.

As is described above, in the fourth example, all the scanning electrodes are divided into four groups A through D. The scanning electrodes of different groups are supplied with four types of negative pulses having different phases. In such a system, when the level of the pulse applied to the scanning electrode changes and the difference between the resultant level and the sustaining electrode forming a pair therewith is sufficiently large, sustaining discharge occurs between such pairs. Accordingly, the sustaining discharge occurs simultaneously in each quarter (25%) of the entire display screen but with a delay quarter by quarter. The sustaining discharge in the entire display screen is performed within the time period when the voltage of the sustaining electrodes is maintained at the same level. In such a manner of operation, the discharge current has a waveform illustrated in FIG. 18. The average value Ia is substantially equal to that of the conventional PDPs, but the peak value Ip is only 25% of that of the conventional PDPs. Moreover, although the sustaining electrodes are driven by one driving circuit, the maximum current of the driving circuit is reduced to 25%.

In the above-described example, the scanning electrodes are divided into four groups. The scanning electrodes may be divided into any number of groups.

Figure 19:
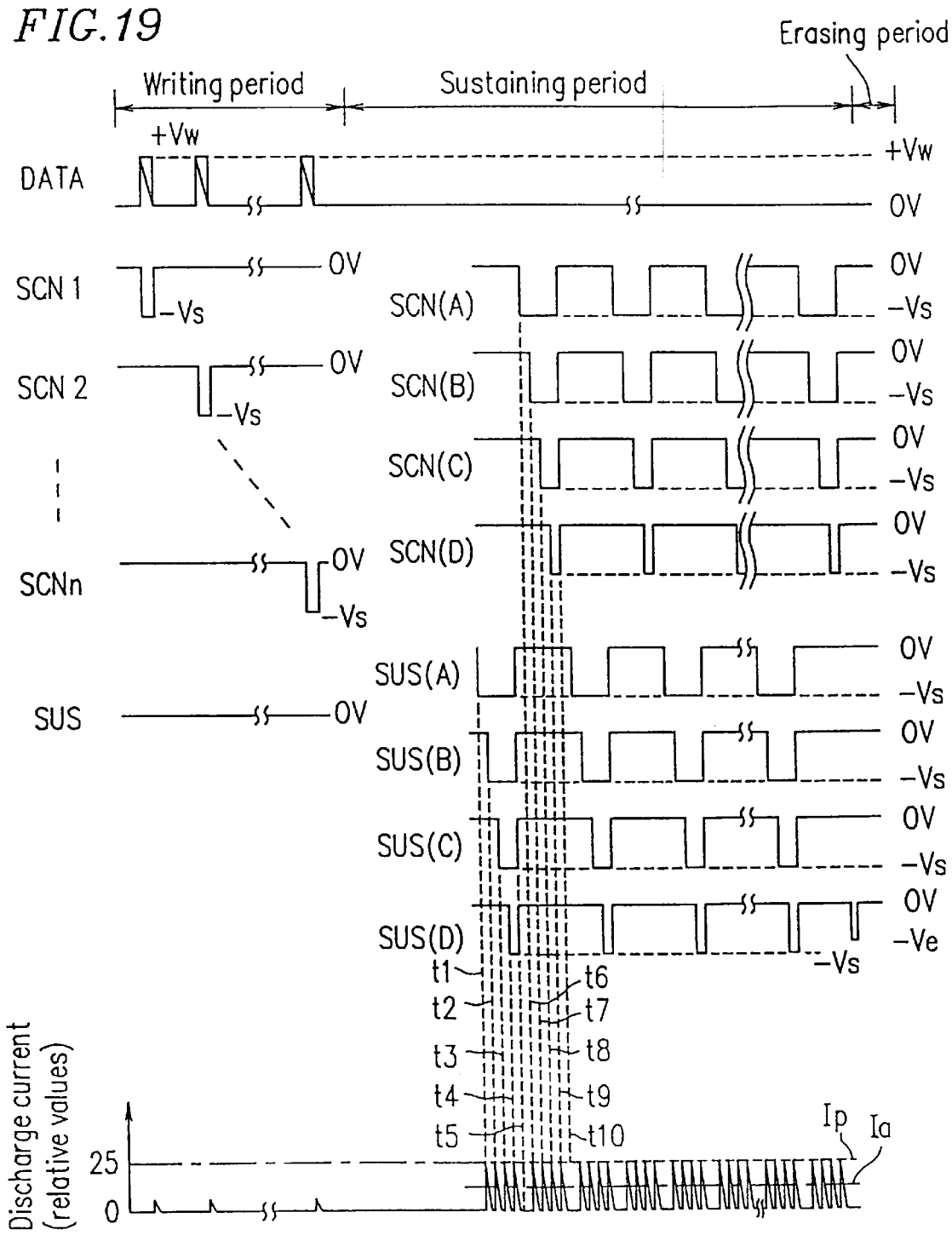
FIG. 19 is a timing chart illustrating a method for driving an AC-type PDP in a modification of the fourth example.

With reference to FIG. 19, a method for driving an AC-type PDP in a modification of the fourth example will be described.

The scanning electrodes are divided into four groups A through D, and the sustaining electrodes are also divided into four groups A through D. Negative sustaining pulses having an amplitude of −Vs shown in waveforms SCN(A) through SCN(D) are applied to the scanning electrodes in groups A through D, respectively. Negative sustaining pulses having an amplitude of −Vs shown in waveforms SUS(A) through SUS(D) are applied to the sustaining electrodes in groups A through D, respectively.

In detail, at time t1, a sustaining pulse having an amplitude of −Vs is applied to the sustaining electrodes in group A, thereby lowering the voltage in such scanning electrodes from 0 V to −Vs. By such a change, a voltage corresponding to the sum of a positive voltage corresponding to the level of charge stored on the surface of the protection layer and the amplitude −Vs of the negative sustaining pulse is applied between each sustaining electrode in group A and the scanning electrode forming a pair therewith. Thus, sustaining discharge occurs between such pairs.

In the same manner, at time t2, t3 and t4 respectively when the level of the voltage in the sustaining electrodes in each of groups B, C and D is lowered from 0 V to −Vs as is shown in waveforms SUS(B), SUS(C) and SUS(D), sustaining discharge occurs between each sustaining electrode in each of groups B, C and D and the scanning electrode forming a pair therewith.

At time t5, the level of the voltage in all the sustaining electrodes is raised from −Vs from 0 V as is shown in waveforms SUS(A) through SUS(D). Since the voltage of all the scanning electrodes is 0 V as is shown in waveforms SCN(A) through SCN(D) at time t5, sustaining discharge does not occur at this point.

At time t6, a sustaining pulse having an amplitude of −Vs is applied to the scanning electrodes in group A, thereby lowering the voltage in such scanning electrodes from 0 V to −Vs. By such a change, a voltage corresponding to the sum of a positive voltage corresponding to the level of charge stored on the surface of the protection layer and the amplitude −Vs of the negative sustaining pulse is applied between each scanning electrode in group A and the sustaining electrode forming a pair therewith. Thus, sustaining discharge occurs again between such pairs.

In the same manner, at time t7, t8 and t9 respectively when the level of the voltage in the scanning electrodes in each of groups B, C and D is lowered from 0 V to −Vs as is shown in waveforms SCN(B), SCN(C) and SCN(D), sustaining discharge occurs between each scanning electrode in each of groups B, C and D and the sustaining electrode forming a pair therewith.

At time t10, the level of the voltage in all the scanning electrodes is changed to 0 V as is shown in waveforms SCN(A) through SCN(D). Since the voltage in all the sustaining electrodes has already been changed to 0 V by time t10, sustaining discharge does not occur at this point.

The sustaining operation from t1 to t10 is repeated during the sustaining period. The erasing operation is performed in the same manner as is described with reference to FIG. 18.

In the above-described modification, all the scanning electrodes are divided into four groups A through D, and all the sustaining electrodes are also divided into four groups A through D. The scanning electrodes in groups A through D are respectively supplied with four types of negative pulses having different phases as is shown in waveforms SCN(A) through SCN(D). The sustaining electrodes in group A through D are respectively supplied with four types of negative pulses having different phases as is shown in waveforms SUS(A) through SUS(D). In such a system, when the level of the pulse applied to the scanning electrode changes and the difference between the resultant level and the sustaining electrode forming a pair therewith is sufficiently large, sustaining discharge occurs between such pairs. In the same manner, when the level of the pulse applied to the sustaining electrode changes and the difference between the resultant level and the scanning electrode forming a pair therewith is sufficiently large, sustaining discharge occurs between such pairs. Accordingly, the sustaining discharge occurs simultaneously in each quarter (25%) of the entire display screen but with a delay quarter by quarter. The sustaining discharge is performed within the time period, for example, between t5 and t10. In such a manner of operation, the discharge current has a waveform as illustrated in FIG. 19. The average value Ia is substantially equal to that of the conventional PDPs, but the peak value Ip is only 25% of that of the conventional PDPS. Moreover, although the sustaining electrodes are driven by one driving circuit, the maximum current of the driving circuit of the sustaining electrodes is reduced to 25%.

In the above-described example, the scanning electrodes are divided into four groups. The scanning electrodes may be divided into any number of groups.

As has been described so far, in the fourth example, the scanning electrodes and, if necessary, the sustaining electrodes are divided into a plurality of groups, and pulses having different phases (with a delay) are applied to the electrodes in different groups. In such a system, when the level of the pulse applied to the sustaining electrode changes and the difference between the resultant level and the scanning electrode forming a pair therewith is sufficiently large, sustaining discharge occurs between such pairs. By dividing each type of electrodes into the groups of the number "k", the peak value of the discharge current in the sustaining period is reduced to 1/k of that of a conventional PDP. As a result, the size of the circuit for supplying a power source and production cost can be reduced.

The method in the second example is applicable to an AC-type PDP having a conventional structure and also to the AC-type PDPs in the first through the third examples.

Example 5

A method for driving an AC-type PDP in a fifth example according to the present invention will be described with reference to FIG. 20.

The method in the fifth example mainly relates to application of an erasing pulse performed in the erasing period. The application of a writing pulse and a sustaining pulse is performed in the same manner as is described in the first example.

Figure 20:
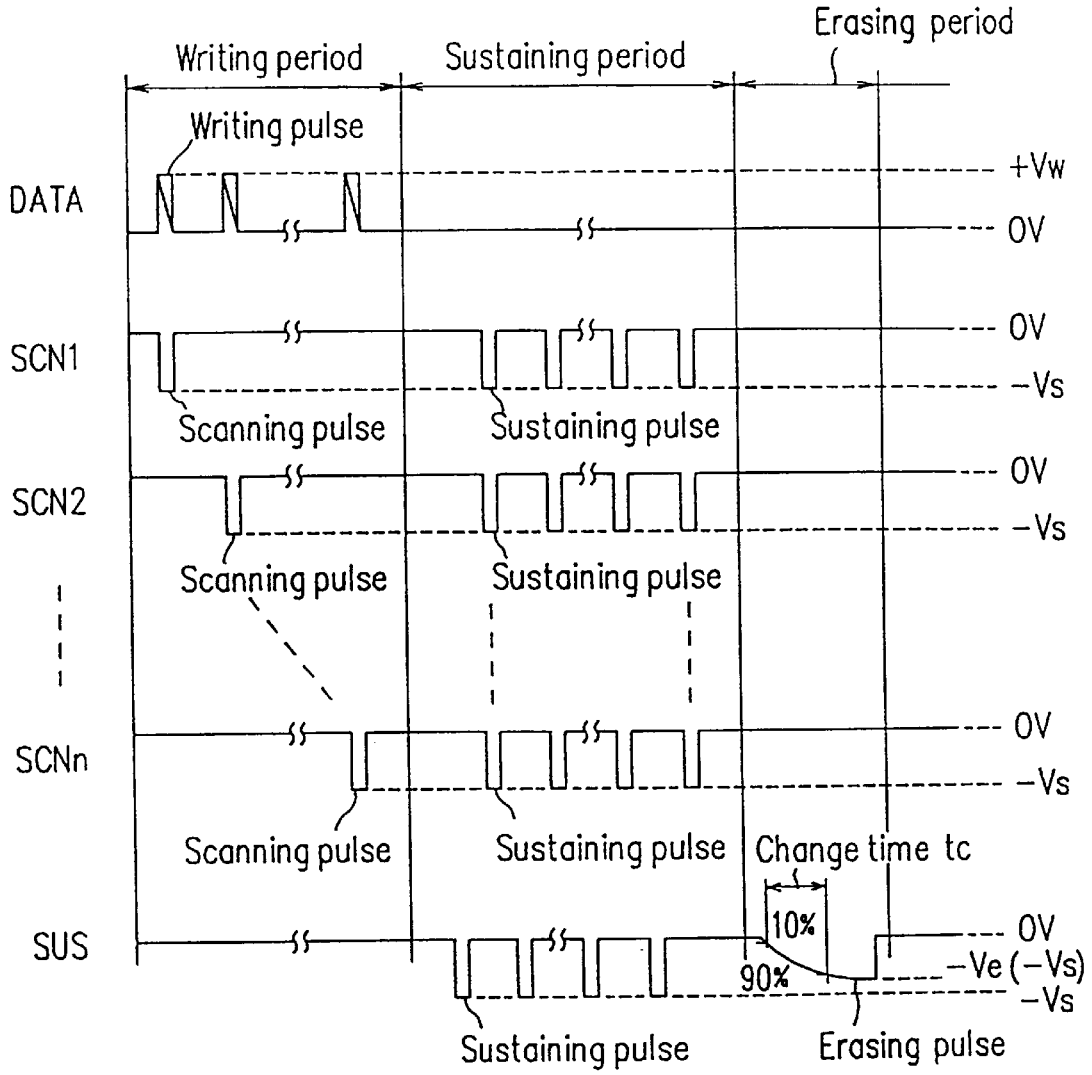
FIG. 20 is a timing chart illustrating a method for driving an AC-type PDP in a fifth example according to the present invention.

In the writing operation performed in the writing period, a positive writing pulse having an amplitude of +Vw shown in waveform DATA in FIG. 20 is applied to at least one data electrode selected from all the data electrodes which corresponds to a pixel for displaying an image in accordance with one scanning electrode (for example, the scanning electrode 102*a* in FIG. 9A). Simultaneously, a negative scanning pulse having an amplitude of −Vs shown in waveform SCN1 is applied to the scanning electrode 102*a*. By such application, discharge occurs at the intersection of the above-selected data electrode and the scanning electrode 102*a*, and thus a positive charge is stored in an area of a surface of the protection layer, the area positionally corresponding to the intersection. In other words, such an area acts as a write cell.

Next, a positive writing pulse having an amplitude of +Vw shown in waveform DATA is applied to at least one selected data electrode which corresponds to a pixel for displaying an image in accordance with the next scanning electrode (for example, the scanning electrode 102*b* in FIG. 9A). Simultaneously, a negative scanning pulse having an amplitude of −Vs shown in waveform SCN2 is applied to the scanning electrode 102*b*. By such application, discharge occurs at the intersection of the above-selected data electrode and the scanning electrode 102*b*. Thus, a positive charge is stored in an area of the surface of the protection layer, the area positionally corresponding to the intersection. In other words, such an area acts as a write cell.

In this manner, during the process of applying negative scanning pulses having an amplitude of −Vs shown in waveforms SCN1 through SCNn to the scanning electrodes respectively, a positive writing pulse having an amplitude of +Vw is applied to at least one selected data electrode which corresponds to a pixel for displaying an image in accordance with the respective scanning electrode. Thus, a positive charge is stored in a prescribed area (write cell) of the surface of the protection layer.

The writing operation is followed by the sustaining operation. In the sustaining operation, a negative sustaining pulse having an amplitude of −Vs shown in waveform SUS is applied to all the sustaining electrodes, and negative sustaining pulses having an amplitude of −Vs shown in waveforms SCN1 through SCNn are applied to all the scanning electrodes respectively. The pulse application to the sustaining electrodes and the pulse application to the scanning electrodes are performed alternately. The application of the first sustaining pulse to each sustaining electrode discharges the positive charge stored on the protection layer, and thus sustaining discharge occurs on a discharge area which belongs to the same discharge cell as the respective intersection. The alternate application of the negative sustaining pulse to the sustaining electrodes and the scanning electrodes continues the sustaining discharge on the discharge area. By light emission caused by such sustaining discharge, characters and images are displayed.

In order to stabilize the writing, sustaining and erasing operations, the writing, scanning and sustaining pulses are applied with drastic rise and fall. The time period required for the change in the voltage at the rise and fall is generally set to be as short as several hundred nanoseconds.

In the erasing period, a negative erasing pulse having an amplitude of −Ve is applied to all the sustaining electrodes. As is shown in waveform SUS in FIG. 20, a change time tc required for an instantaneous voltage to change from 10% to 90% of the amplitude of the erasing pulse is longer than several hundred nanoseconds. In other words, the voltage of such a pulse changes more slowly. While the voltage between each pair of scanning electrode and sustaining electrode changes slowly during such a long change time tc, erasing discharge for neutralizing the charge stored on the entire protection layer occurs at appropriate timing in accordance with the characteristics of each discharge cell. Thus, the charge stored on the surface of the protection layer is erased almost completely. The amplitude of the erasing pulse is −Ve in the above-described example, but may be −Vs, which is equal to the amplitude of the sustaining pulse. In such a case, the configuration of the driving circuit is simplified.

Hereinafter, a preferable range for the change time tc required for the instantaneous voltage of the erasing pulse to change as is described above will be described.

Figure 21:
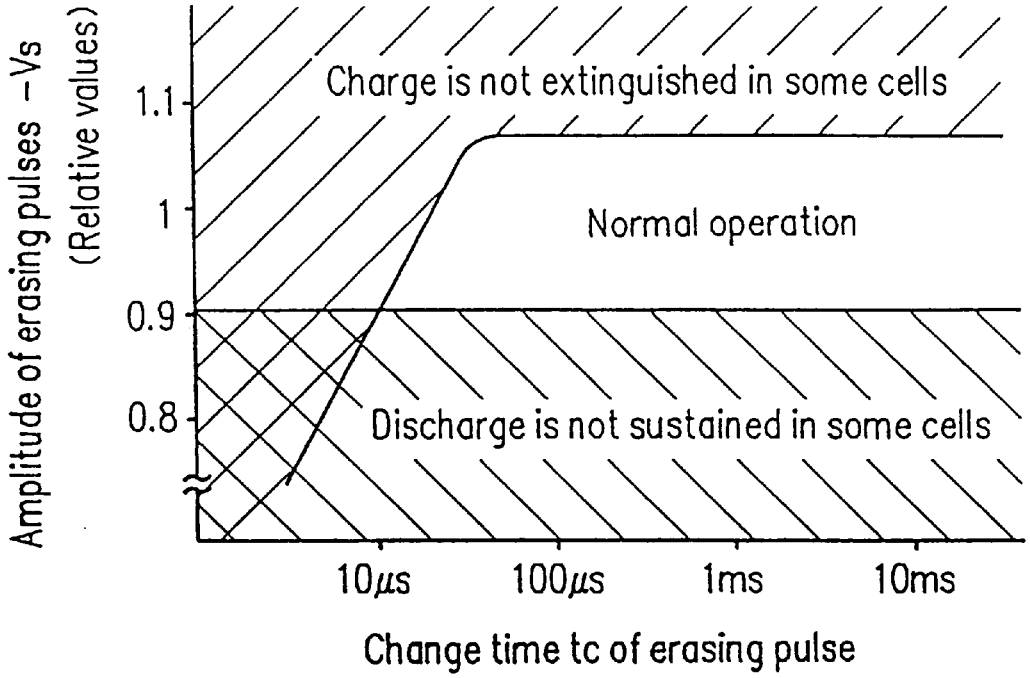
FIG. 21 is a graph illustrating discharge characteristics of an AC-type PDP with respect to a time period required for the voltage of an erasing pulse to change between certain levels.

FIG. 21 is a graph illustrating an example of the discharge state in accordance with the relationship between the change time tc of the erasing pulse and the amplitude of the erasing pulses. The discharge state illustrated in FIG. 21 is obtained when the amplitude of the erasing pulse is equal to the amplitude of the sustaining pulse (namely, −Vs) at the driving timing shown in FIG. 20. As is appreciated from FIG. 21, the lower limit of the change time tc which is required to obtain a normal operation is 10 μs. The upper limit of the change time tc which is required to obtain the normal operation is not determined by the relationship between the change time tc of the erasing pulse and the amplitude of the erasing pulses. However, considering the upper limit of a refreshing period of the display screen (sum of the writing, sustaining and erasing periods) is generally approximately 17 ms, the upper limit of the change time is approximately 10 ms in practical use. Accordingly, the preferable range of the change time tc which is practically usable is 10 μs to 10 ms inclusive.

The above-mentioned refreshing period is 1/60 second in the case of blank and white display. In the case of multiple tone display, the refreshing period is shorter because a sub-field method is used. For example, in the case of 256 tone display, eight refreshing periods are included within 1/60 second because one display screen includes eight sub-fields ($2^8$=256). (Each refreshing period is not necessarily obtained by equally dividing 1/60 second by eight.)

Figure 22:
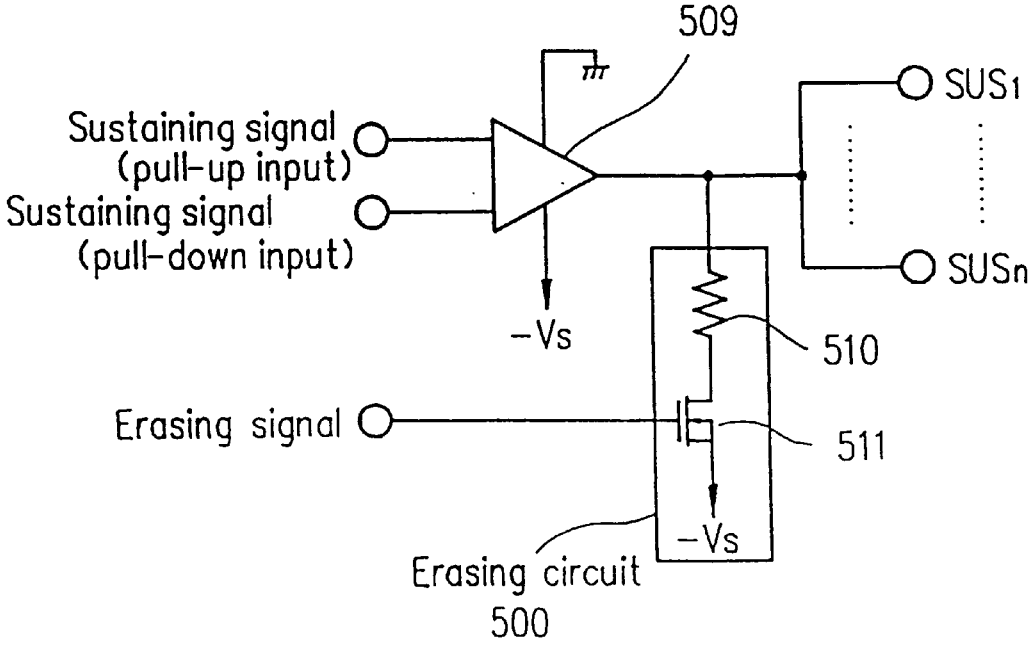
FIG. 22 is a diagram showing an erasing circuit for generating an erasing pulse in the fifth example.

FIG. 22 is a diagram showing an erasing circuit 500 for generating the erasing pulse illustrated in FIG. 20.

As is shown in FIG. 22, the erasing circuit 500 is connected to an output of a high-withstand voltage driver 509, for withstanding a high voltage, for driving all the sustaining electrodes SUS1 through SUSn. (Hereinafter, the voltage driver 509 will be referred to as the "high-withstand voltage driver 509".) The erasing circuit 500 includes a resistor 510 and an field effect transistor (FET) 511 which are connected to each other in series. Prior to the erasing operation, the output of the high-withstand voltage driver 509 is set to have a high impedance.

When the FET 511 is turned on by an erasing signal, an erasing pulse having a change time tc of as long as 10 μs to 10 ms inclusive can be obtained by the time constant of a stray capacitance component of the sustaining electrodes (SUS1 through SUSn) and the resistor 510. Then, the FET 511 is turned off, and the level of the output of the high-withstand voltage driver 509 is made high. Thus, the voltage of the sustaining electrodes returns to 0 V.

The high-withstand voltage driver 509 can control the state of the output thereof by changing two types of sustaining signals which are input thereto (signals to a pull-up input and to a pull-down input). By such control, preparation for formation of the sustaining pulse and the erasing pulse and other processes can be performed.

As has been described so far, in the fifth example, an erasing pulse having the change time tc (required for the instantaneous voltage to change from 10% to 90% of the amplitude of the erasing pulse) of 10 μs to 10 ms inclusive is applied to the sustaining electrodes. By such application, while the voltage between the scanning electrodes and the sustaining electrodes changes slowly, erasing discharge for neutralizing the charge stored on the entire protection layer occurs at appropriate timing in accordance with the characteristics of each discharge cell. Thus, the charge stored on the surface of the protection layer is erased almost completely. As a result, the tolerance for the fluctuation in the width and the amplitude of the erasing pulse can be enlarged. Accordingly, a sufficient margin for the erasing operation is obtained even if the characteristics of different discharge cells are dispersed.

Figure 23A:
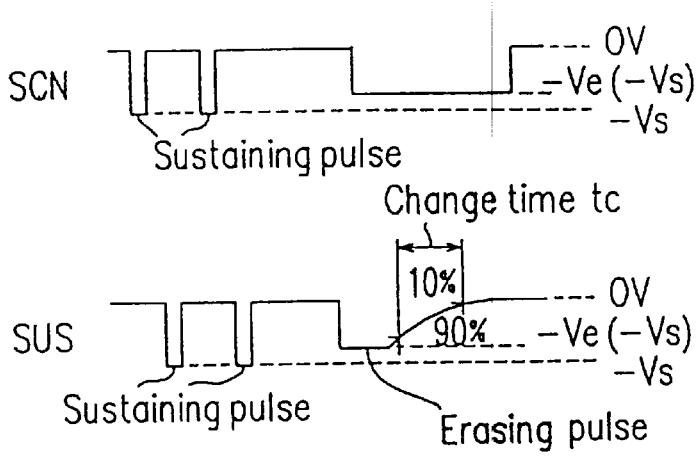
FIGS. 23A, 23B and 23C are timing charts illustrating different methods for applying an erasing pulse in various modifications of the fifth example.
Figure 23B:
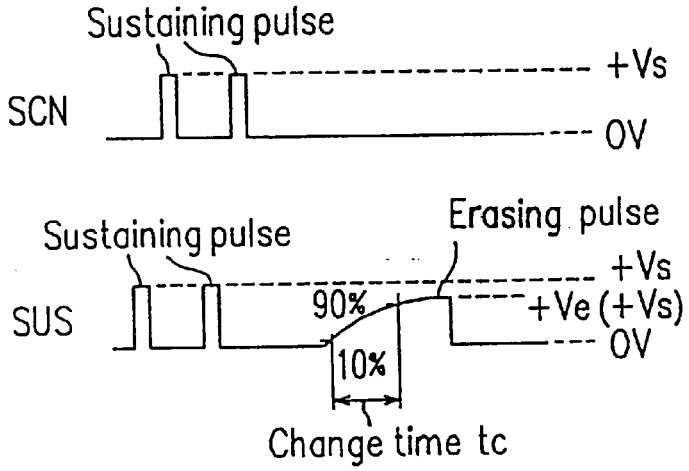
Figure 23C:
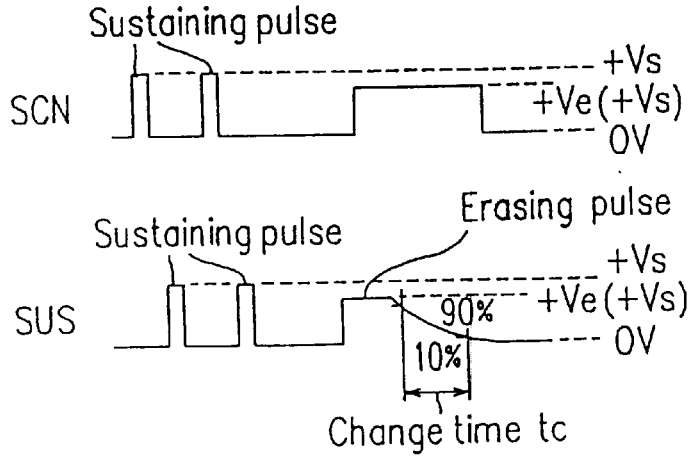

FIGS. 23A, 23B and 23C show different methods for applying an erasing pulse in various modifications of the fifth example.

In the case shown in FIG. 23A, as is shown in waveform SUS, an erasing pulse is applied to the sustaining electrodes so that the voltage of the sustaining electrodes first decreases steeply from 0 V to −Ve (or −Vs) and then slowly increases to 0 V. The change time tc which is required for the instantaneous voltage of the erasing pulse to change from −Ve (or −Vs) to 0 V is as long as a value within the above-described range. During such a slow change, erasing discharge occurs.

As is shown in waveform SCN, the voltage in the scanning electrodes decreases steeply from 0 V to −Ve (or −Vs) after the voltage of the erasing pulse decreases to −Ve (or −Vs) but before the voltage starts increasing to 0 V. At this point, the voltage in the sustaining electrodes is controlled to return to 0 V before the voltage in the scanning electrode returns to 0 V in order to prevent discharge from occurring when the voltage in the scanning electrode changes to 0 V. The timing for the other processes is the same as illustrated in FIG. 20. By such a manner of operation, the voltage between the scanning electrodes and the sustaining electrodes increases slowly. As a result, the AC-type PDP operates in the same manner as is described in FIG. 20.

FIG. 23B illustrates pulse application in the case where the polarities of all the pulses in FIG. 20 are inverted.

FIG. 23C illustrates pulse application in the case where the polarities of all the pulses in FIG. 23A are inverted.

In the methods for driving the AC-type PDP illustrated in FIGS. 23A through 23C, the change time tc of the erasing pulse required for the instantaneous voltage to change from 90% to 10% or 10% to 90% of the amplitude of the erasing pulse is between 10 μs and 10 ms inclusive as is described with reference to FIG. 20. By application of such an erasing pulse, erasing discharge for neutralizing the charge stored on the entire protection layer occurs at appropriate timing in accordance with the characteristics of each discharge cell while the voltage between the scanning electrode and the sustaining electrode changes slowly. Thus, the charge stored on the protection layer is erased substantially completely. Accordingly, the tolerance for the fluctuation in the width and the amplitude of the erasing pulse can be enlarged. As a result, a sufficient margin for the erasing operation can be obtained even if the characteristics are dispersed among different discharge cells.

In the fifth example, an erasing pulse is applied to the sustaining electrodes. The same effect is achieved if the erasing pulse is applied to the scanning electrodes. In the above-described example, the erasing pulse is applied to all the sustaining electrodes simultaneously. The same effect is achieved if the sustaining electrodes or the scanning electrodes are divided into a plurality of blocks and the erasing pulse is applied to the electrodes in different blocks with a delay.

As has been described, in the fifth example, an erasing pulse having an instantaneous voltage which increases or decreases slowly is applied to the scanning electrodes or the sustaining electrodes, thereby increasing the voltage between the scanning electrodes and the sustaining electrodes slowly. Accordingly, the tolerance for the fluctuation in the width and the amplitude of the erasing pulse can be enlarged. As a result, a sufficient margin for the erasing operation can be obtained even if the characteristics are dispersed among different discharge cells.

The methods in the fifth example are applicable to an AC-type PDP having a conventional structure and also to the AC-type PDPs in the first through the third examples. The methods in the fifth example may also be combined with the method in the fourth example.

Example 6

Figure 24:
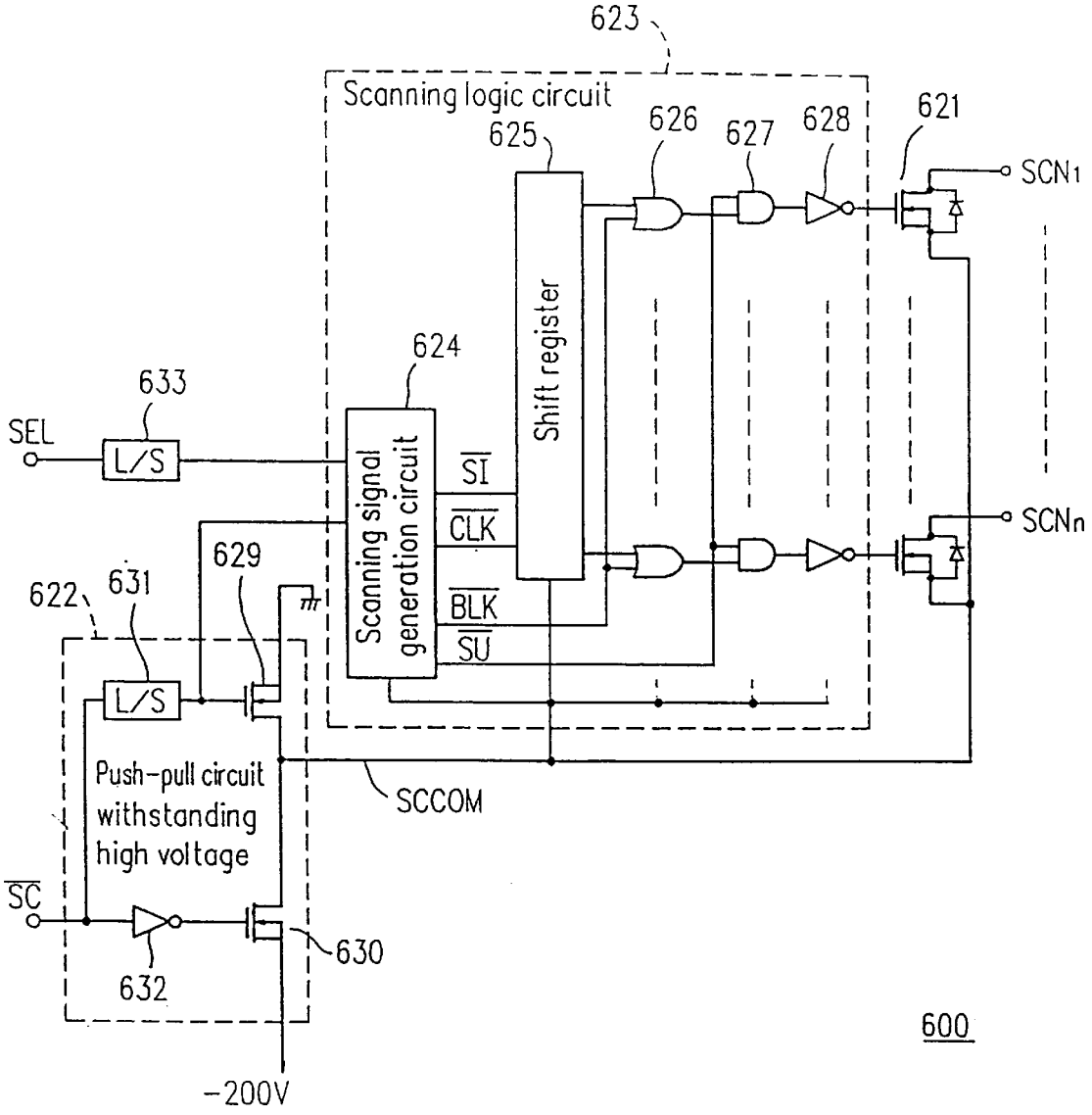
FIG. 24 is a circuit diagram of a scanning electrode driving circuit in a sixth example according to the present invention.

A driving circuit of an AC-type PDP in a sixth example according to the present invention will be described with reference to FIG. 24. FIG. 24 is a circuit diagram of a scanning electrode driving circuit 600 in the sixth example.

The scanning electrode driving circuit 600 includes n-channel MOSFETs 621 withstanding a high voltage (hereinafter, referred to simply as the "MOSFETs 621") which are respectively connected to scanning electrodes SCN1 through SCNn. Thus, an output section withstanding a high voltage is formed in an open drain system. All the MOSFETs 621 are connected to a scanning logic circuit 623 with a gate electrode thereof. The scanning logic circuit 623 includes a scanning signal generation circuit 624. A common line of the scanning logic circuit 623 is the basis of the signal level therein and is connected to a push-pull circuit 622 withstanding a high voltage via an output SCCOM thereof. The output SCCOM is also connected to a source electrode of each MOSFET 621.

In detail, each of the scanning electrodes SCN1 through SCNn is connected to a drain electrode (a first main electrode) of the respective MOSFET 621, and thus an output section withstanding a high voltage is formed in an open drain system. The source electrode (a second main electrode) of the MOSFET 621 is connected to the output SCCOM of the push-pull circuit 622 as is described above. The gate electrode (control electrode) of the MOSFET 621 is connected to an output of the scanning logic circuit 623.

The scanning logic circuit 623 includes the scanning signal generation circuit 624 for generating a scanning data signal $\overline{SI}$, a clock signal $\overline{CLK}$, a blanking signal $\overline{BLK}$, and a sustaining signal $\overline{SU}$, a shift register 625, a first gate 626, a second gate 627 and an inverter 628. As is described above, the common line of the scanning logic circuit 623 which is the basis of the signal level is connected to the output SCCOM of the push-pull circuit 622, in order to change the signal level in the scanning logic circuit 623 when the potential of the source electrode in the MOSFET 621 changes in accordance with a change in the output SCCOM of the push-pull circuit 622. By changing the signal level in this manner, the voltage between the gate electrode and the source electrode of the MOSFET 621 is maintained in a certain range, for example, 5 V level (0 V to +5 V) in order to avoid influence of a change (0 V to −200 V) in the voltage applied to the output SCCOM.

The push-pull circuit 622 includes an n-channel MOSFET 629 withstanding a high voltage (referred to as the "MOSFET 629") having a drain electrode which is grounded and an n-channel MOSFET 630 withstanding a high voltage (referred to as the "MOSFET 630") having a source electrode which is connected to a power source having a voltage as high as −200 V. The connecting point of the source electrode of the MOSFET 629 and the drain electrode of the MOSFET 630 is the output SCCOM of the push-pull circuit 622. A clock signal $\overline{SC}$ is input to the gate electrode of the MOSFET 629 via a level shift circuit (L/S) 631, and a clock signal $\overline{SC}$ is input to the gate electrode of the MOSFET 630 via an inverter 632. To the scanning logic circuit 623, a scanning/sustaining select signal $\overline{SEL}$ is input via a level shift circuit (L/S) 633 and a clock signal $\overline{SC}$ is input via the level shift circuit 631.

Figure 25:
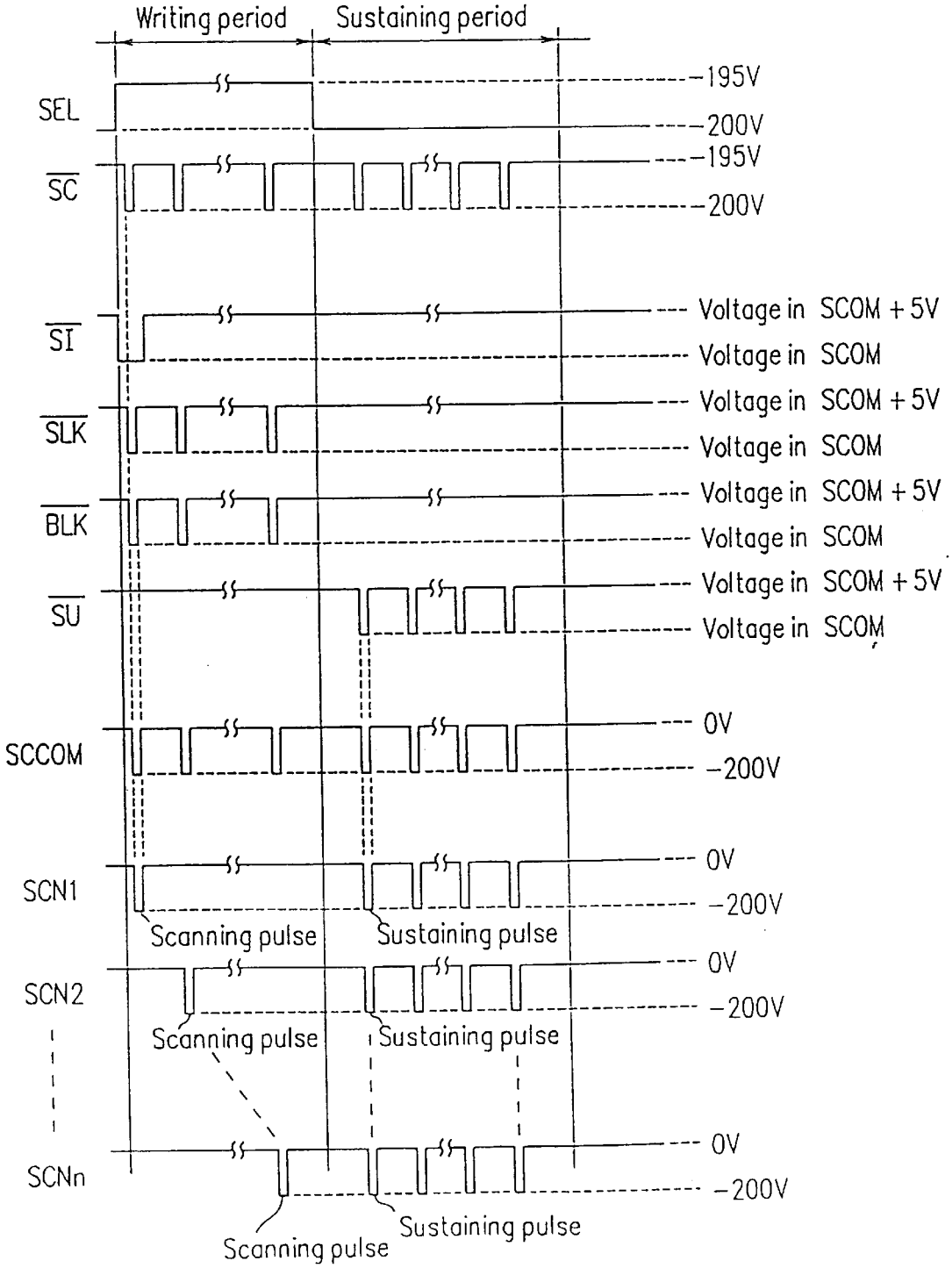
FIG. 25 is a timing chart illustrating a method for driving the scanning electrode driving circuit shown in FIG. 24.

With reference to FIG. 25, a method for driving the scanning electrode driving circuit 600 having the above-described configuration will be described. The values of the amplitude of the pulse described above and below are only examples, and other values may be used.

In the writing period, the level of the scanning/sustaining select signal $\overline{SEL}$ becomes high, and the clock signal $\overline{SC}$ is input to the push-pull circuit 622. The signals $\overline{SEL}$ and $\overline{SC}$ are input to the scanning signal generation circuit 624 via the level shift circuits 633 and 631, respectively. When the level of the scanning/sustaining select signal $\overline{SEL}$ is high, the scanning signal generation circuit 624 goes into the operation mode for the writing period and thus outputs the scanning data signal $\overline{SI}$, the clock signal $\overline{CLK}$ and the blanking signal $\overline{BLK}$.

When the scanning data signal $\overline{SI}$ and the clock signal $\overline{CLK}$ are input to the shift register 625, the scanning data signal $\overline{SI}$ is taken in at the falling edge of the clock signal $\overline{CLK}$. The level of outputs from the shift register 625 becomes low one by one, and a scanning signal is output. Only while the level of the blanking signal $\overline{BLK}$ is low, the scanning signal passes through the first gate 626, the second gate 627 and the inverter 628 and is applied to the gate electrode of each MOSFET 621.

One MOSFET 621 selected by the scanning signal (corresponding to the selected scanning electrode) is turned on, but the other MOSFETs 621 are maintained off. In such a state, when a negative pulse having an amplitude of −200 V is sent to the output SCCOM of the push-pull circuit 622 by a clock signal $\overline{SC}$, a negative scanning pulse having an amplitude of −200 V is applied only to the scanning electrode which is connected to the MOSFET 621 which has been turned on. The scanning electrodes connected to the other MOSFETs 621, which have been maintained off, retain the voltage due to the floating voltage thereof, and no scanning pulse is applied to the scanning electrodes connected to the others MOSFETs 621. Accordingly, the applied voltage is kept 0 V.

When the output SCCOM of the push-pull circuit 622 returns from −200 V to 0 V, the voltage in the scanning electrode connected to the MOSFET 621 which has been turned on is clamped to the voltage of the output SCCOM by a parasitic diode between the source electrode and the drain electrode of the MOSFET 621. Thus, the voltage in such a scanning electrode returns to 0 V.

The scanning pulse is applied to the scanning electrodes one by one by repeating the writing operation in this manner.

In the sustaining period following the writing period, the level of the scanning/sustaining select signal $\overline{SEL}$ becomes low, and a clock signal $\overline{SC}$ is input to the push-pull circuit 622. The signals $\overline{SEL}$ and $\overline{SC}$ are input to the scanning signal generation circuit 624 via the level shift circuits 633 and 631, respectively. When the level of the scanning/sustaining select signal $\overline{SEL}$ is low, the scanning signal generation circuit 624 goes into the operation mode for the sustaining period and thus outputs the sustaining signal $\overline{SU}$. The sustaining signal $\overline{SU}$ is input to the gate electrode of each MOSFET 621 via the second gate 627 and the inverter 628. Thus, all the MOSFETs 621 are turned on simultaneously.

In such a state, when a negative pulse having an amplitude of −200 V is sent to the output SCCOM of the push-pull circuit 622, a negative scanning pulse having an amplitude of −200 V is applied to all the scanning electrodes which are connected to all the MOSFETs 621, which have been turned on.

When the output SCCOM of the push-pull circuit 622 returns from −200 V to 0 V, the voltage in all the scanning electrodes connected to all the MOSFETs 621 which have been turned on is clamped to the voltage of the output SCCOM by a parasitic diode between the source electrode and the drain electrode of the MOSFETs 621. Thus, the voltage in such scanning electrodes returns to 0 V.

The sustaining pulse is applied to the scanning electrodes one by one by repeating the sustaining operation in this manner.

When a sustaining pulse is applied to the sustaining electrode during the sustaining period, a source current needs to flow from the scanning electrode driving circuit 600 to the scanning electrode. Such a current is supplied via the parasitic diode.

In the scanning electrode driving circuit 600 shown in FIG. 24, the MOSFETs 621 and the scanning logic circuit 623, for example, may be divided into an appropriate number of blocks to obtain a monolithic IC. Since the output section is of an open drain system, the IC can be formed easily with a reduced chip size, thus reducing the price thereof. The level shift circuit 633 and the push-pull circuit 622 are common to all the scanning electrodes. In the case when the driving capacity of either one of the circuits is limited, the smallest necessary number of circuits need to be prepared. The ratio of the price of such circuits with respect to the total price is low. Due to the open drain system of the output section withstanding a high voltage, the scanning electrode driving circuit 600 does not break down even if a shortcircuit occurs between the scanning electrodes.

A power source for the scanning logic circuit 623 can be easily produced based on a conventional scanning logic circuit with, for example, a charge pump system.

As is described above, the scanning electrode driving circuit 600 includes the plurality of n-channel MOSFETs 621, withstanding a high voltage, respectively connected to a plurality of scanning electrodes through a drain electrode thereof, the scanning logic circuit 623 connected to the gate electrode of each MOSFET 621, and a push-pull circuit 622 having an output which is connected to the source electrode of each MOSFET 621 and the common line of the scanning logic circuit 623, the common line being the basis of the signal level in the scanning logic circuit 623. Accordingly, the output section withstanding a high voltage is of an open drain system, and thus the circuit configuration thereof is significantly simplified. Due to such a simple configuration, the scanning electrode driving circuit 600 can be formed into an IC easily, which reduces production cost. Even if a shortcircuit occurs between the scanning electrodes, the scanning electrode driving circuit 600 does not break down.

The scanning electrode driving circuit in the sixth example is applicable to a conventional AC-type PDP and also to the AC-type PDPs in the first through the third examples. The driving method described in this example may also be combined with the methods described in the fourth and the fifth examples.

In this example, the driving circuit is used for an AC-type PDP in which discharge occurs two dimensionally between the scanning electrodes and the sustaining electrodes provided on the same plane. The driving circuit in this example may be used for an AC-type PDP including a plurality of data electrodes and a plurality of scanning electrodes which are opposed three dimensionally to cross each other perpendicularly and discharge occurs between such data electrodes and scanning electrodes, and also for a DC-type PDP. The same effect is obtained.

In the above description, the MOSFET 621 including a parasitic diode, which is a reverse conductive diode, is used as a switching device for connecting the first main electrode thereof to each of the plurality of scanning electrodes SCN1 through SCNn separately. Even a switching device without a parasitic diode acting as a reverse conductive diode may be used if a reverse conductive diode is provided in parallel.

Figure 26:
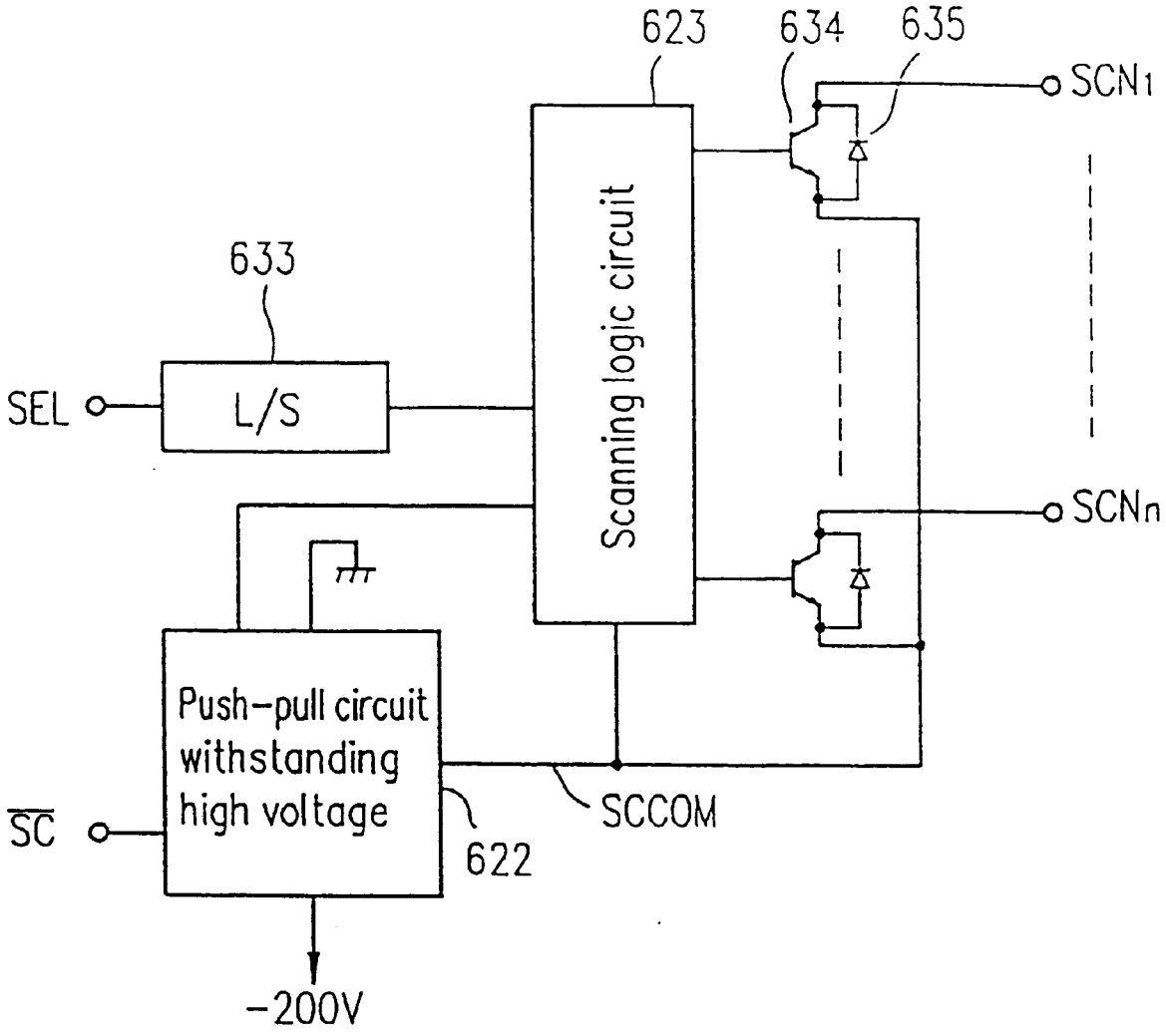
FIG. 26 is a diagram of a scanning electrode driving circuit in a modification of the sixth example.

FIG. 26 is a diagram of such a circuit. An npn bipolar transistor 634 withstanding a high voltage and a reverse conducive diode 635 connected to each other in parallel are used instead of the n-channel MOSFET 621. A collector electrode of the bipolar transistor 634 is connected to each of the scanning electrode SCN1 through SCNn, and a base electrode thereof is connected to the scanning logic circuit 623. An emitter electrode of the bipolar transistor 634 is connected to the output SCCOM of the push-pull circuit 622. Except for these points, the circuit shown in FIG. 26 has the same configuration with that of the circuit shown in FIG. 24.

In some cases, even a bipolar transistor obtains a parasitic diode during the production processes thereof in the same manner as in a MOSFET. In such a case, since the parasitic diode acts as a reverse conductive diode, provision of the reverse conductive diode is not necessary.

The MOSFET 621 or the combination of the bipolar transistor 634 and the reverse conductive diode 635 may be included in a monolithic IC with the scanning logic circuit 623 and the like. Alternatively, the MOSFET 621 or the combination of the bipolar transistor 634 and the reverse conductive diode 635 may be arranged on a substrate using discrete components in accordance with the circuit configuration.

As has been described, in the sixth example, a push-pull circuit withstanding a high voltage is provided, which is used in common to a plurality of scanning electrodes. The scanning electrodes are each connected to a first main electrode (for example, a drain electrode or a collector electrode) of a switching device withstanding a high voltage (for example, an n-channel MOSFET or an npn bipolar transistor) forming an output section. A control electrode (for example, a gate electrode or a base electrode) of the switching device is connected to a scanning logic circuit. An output of the push-pull circuit is connected to a second main electrode (for example, a source electrode or an emitter electrode) of the switching device and also to the common line of the scanning logic circuit which is the basis of the signal level therein.

Due to such a configuration, it is not necessary to provide a push-pull type output section withstanding a high voltage and a level shift circuit withstanding a high voltage for each scanning electrode as is necessary conventionally. Driving of a plurality of scanning electrodes is realized by simply providing a push-pull circuit, withstanding a high voltage, which is used in common for the plurality of scanning electrodes and a switching device withstanding a high voltage which is used for each of the plurality of scanning electrodes. As a result, the scanning electrode driving circuit has a configuration which is sufficiently simple to be formed as an IC. Thus, production cost is reduced. Further, due to the open drain system of the n-channel MOSFET or the open collector system of the npn bipolar transistor used as a switching device and connected to each of the plurality of scanning electrodes, the scanning electrode driving circuit does not break down even if a shortcircuit occurs between the scanning electrodes.

Example 7

Figure 27:
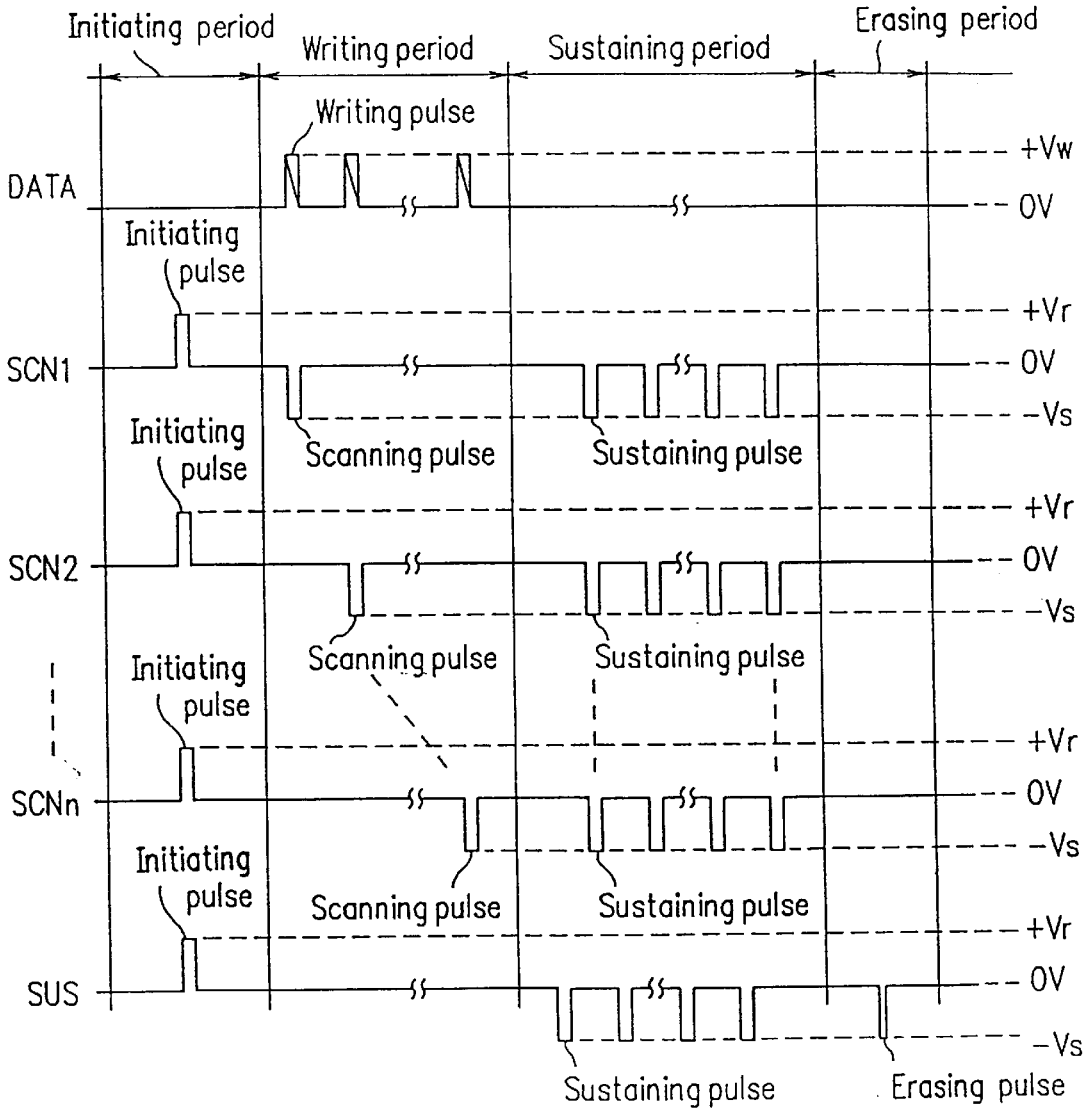
FIG. 27 is a timing chart illustrating a method for driving an AC-type PDP in a seventh example according to the present invention.

A method for driving an AC-type PDP in a seventh example according to the present invention will be described with reference to FIG. 27. The method in the seventh example includes an initiating period in addition to the writing, sustaining and erasing periods. FIG. 27 is a timing chart illustrating the operation in the seventh example.

First, in an initiating period, a positive initiating pulse having an amplitude of +Vr (V) is applied to all the scanning electrodes and all the sustaining electrodes simultaneously as is shown in waveforms SCN1 through SCNn and SUS. By such application, initiating discharge occurs between the data electrodes and the scanning electrodes and between the data electrodes and the sustaining electrodes.

In a writing period following the initiating period, a positive writing pulse having an amplitude of +Vw (V) shown in waveform DATA is applied to a prescribed data electrode. Simultaneously, a negative scanning pulse having an amplitude of −Vs (V) shown in waveform SCN1 is applied to a first scanning electrode (for example, the scanning electrode 102*a* in FIG. 9A). By such application, writing discharge occurs at the intersection of the prescribed data electrode and the first scanning electrode. Next, a positive writing pulse having an amplitude of +Vw (V) shown in waveform DATA is applied to a prescribed data electrode. Simultaneously, a negative scanning pulse having an amplitude of −Vs (V) shown in waveform SCN2 is applied to a second scanning electrode (for example, the scanning electrode 102*b* in FIG. 9A). By such application, writing discharge occurs at the intersection of the prescribed data electrode and the second scanning electrode.

Such operation is repeated, and finally a positive writing pulse having an amplitude of +Vw (V) shown in waveform DATA is applied to a prescribed data electrode. Simultaneously, a negative scanning pulse having an amplitude of −Vs (V) shown in waveform SCNn is applied to an "n"th scanning electrode (for example, the scanning electrode 102*n* in FIG. 9A). By such application, writing discharge occurs at the intersection of the prescribed data electrode and the "n"th scanning electrode.

In a sustaining period following the writing period, a negative sustaining pulse having an amplitude of −Vs (V) is applied to all the sustaining electrodes and all the scanning electrodes as is shown in waveforms SCN1 through SCN2 and SUS. By such application, sustaining discharge starts in a discharge cell including the intersection where the writing discharge occurred, and the sustaining discharge continues while application of the sustaining pulse is repeated.

In an erasing period following the sustaining period, a negative narrow erasing pulse having an amplitude of −Vs (V) shown in waveform SUS is applied to all the sustaining electrodes. By such application, erasing discharge occurs, thereby terminating the sustaining discharge.

Thus, in the method in this example, an initiating pulse having an opposite polarity to the polarity of the scanning pulse applied to the scanning electrodes is applied to the scanning electrodes and the sustaining electrodes. Hereinafter, effects obtained by the initiating pulse will be described with reference to movement of the wall charges in the discharge cell illustrated in FIGS. 28A through 28G.

FIGS. 28A through 28G are cross sectional views of the AC-type PDP according to the present invention, illustrating the movement of the wall charges in each step of the operation shown in FIG. 27.

Figure 28A:
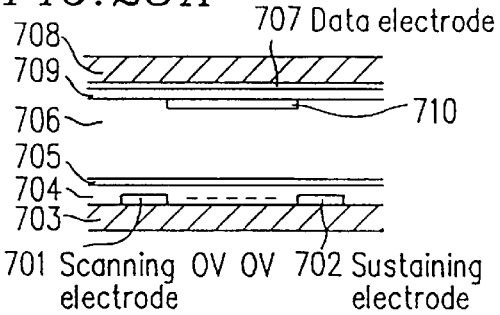
FIGS. 28A through 28G are cross sectional views of an AC-type PDP, illustrating the existing and moving state of charges in a discharge cell while the AC-type PDP is operating in the seventh example.

FIG. 28A shows an initial state before the AC-type PDP is turned on. The discharge cell in the AC-type PDP has no wall charge.

Figure 28B:
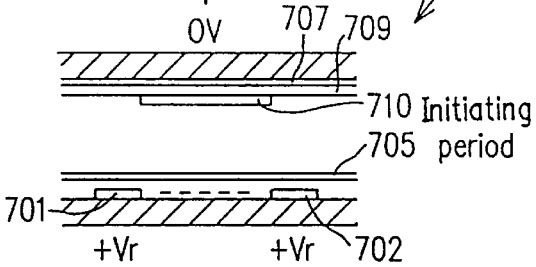

As is shown in FIG. 28B, in the initiating period after the AC-type PDP is turned on, an initiating pulse having an amplitude of +Vr (V) is applied to the scanning electrodes 701 and the sustaining electrodes 702. Since no wall charge is stored in the discharge cell, a voltage which is sufficient to cause discharge is not applied between areas of a surface of a dielectric layer 709 corresponding to the data electrodes 707 and areas of a surface of a protection layer 705 corresponding to the scanning electrodes 701 and between the areas of the surface of the dielectric layer 709 corresponding to the data electrodes 707 and the areas of the surface of the protection layer 705 corresponding to the sustaining electrodes 702. Accordingly, initiating discharge does not occur.

Figure 28C:
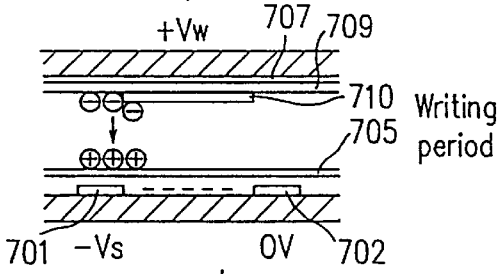

As is shown in FIG. 28C, in the following writing period, a writing pulse having an amplitude of +Vw (V) is applied to the data electrode 707 and a negative scanning pulse having an amplitude of −Vs (V) is applied to the scanning electrode 701. Then, writing discharge occurs at the intersection of the data electrode 707 and the scanning electrode 701. A negative wall charge is stored in the area of the surface of the dielectric layer 709 corresponding to the data electrode 707, and a positive wall charge is stored in the area of the surface of the protection layer 705 corresponding to the scanning electrode 701.

Figure 28D:
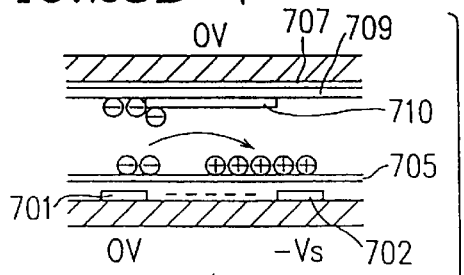

As is shown in FIG. 28D, in the following sustaining period, a negative sustaining pulse having an amplitude of −Vs (V) is applied to the sustaining electrode 702. Then, the voltage generated by the positive wall charge stored on the area of the surface of the protection layer 705 corresponding to the scanning electrode 701 is superimposed on the voltage of the sustaining pulse and applied between the area of the surface of the protection layer 705 corresponding to the scanning electrode 701 and the area of the protection layer 705 corresponding to the sustaining electrode 702. Accordingly, sustaining discharge occurs between the above-mentioned two areas. As a result, a negative wall charge is stored on the area of the protection layer 705 corresponding to the scanning electrode 701, and a positive wall change is stored on the area of the protection layer 570 corresponding to the sustaining electrode 702.

Figure 28E:
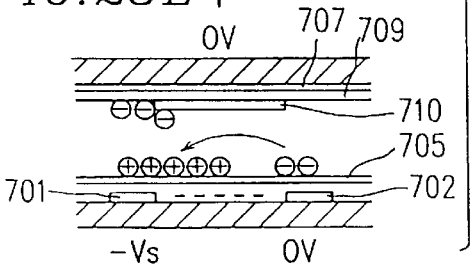

Further in the sustaining period, as is shown in FIG. 28E, a negative sustaining pulse having an amplitude of −Vs (V) is applied to the scanning electrode 701. Then, the voltage generated by the negative wall charge stored on the area of the protection layer 705 corresponding to the scanning electrode 701 by the sustaining discharge and the voltage generated by the positive wall charge stored on the area of the protection layer 705 corresponding to the sustaining electrode 702 are superimposed on the voltage of the sustaining pulse and applied between the area of the protection layer 705 corresponding to the scanning electrode 701 and the area of the protection layer 705 corresponding to the sustaining electrode 702. Thus, sustaining discharge occurs again between the above-mentioned two areas. As a result, a negative wall charge is stored on the area of the protection layer 705 corresponding to the sustaining electrode 702, and a positive wall charge is stored on the area of the protection layer 705 corresponding to the scanning electrode 701.

Still in the sustaining period, as is shown in FIG. 28D again, a sustaining pulse having an amplitude of −Vs (V) is applied to the sustaining electrode 702. Then, the voltage generated by the negative wall charge stored on the area of the protection layer 705 corresponding to the sustaining electrode 702 by the sustaining discharge and the voltage generated by the positive wall charge stored on the area of the protection layer 705 corresponding to the scanning electrode 701 are superimposed on the voltage of the sustaining pulse and applied between the area of the protection layer 705 corresponding to the scanning electrode 701 and the area of the protection layer 705 corresponding to the sustaining electrode 702. Accordingly, sustaining discharge occurs again between the above-mentioned two areas. As a result, a negative wall charge is stored on the area of the protection layer 705 corresponding to the scanning electrode 701, and a positive wall charge is stored on the area of the protection layer 705 corresponding to the sustaining electrode 702.

In this manner, a sustaining pulse having an amplitude of −Vs (V) is applied to all the sustaining electrodes 702 and all the scanning electrodes 701 alternately. By such application, sustaining discharge occurs repeatedly in the sustaining period as is shown in FIGS. 28D and 28E, and the phosphor layers 710 are excited by ultraviolet rays generated by the repeated sustaining discharge, thereby performing display.

Figure 28F:
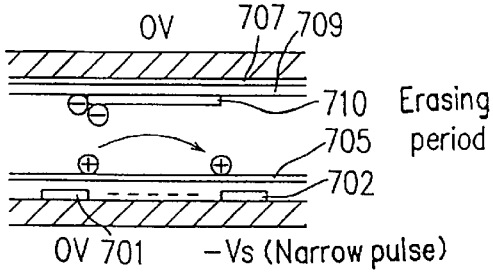

As is shown in FIG. 28F, in the following erasing period, a negative narrow erasing pulse having an amplitude of −Vs (V) is applied to the sustaining electrode 702. Then, the voltage generated by the negative wall charge stored on the area of the protection layer 705 corresponding to the sustaining electrode 702 by the sustaining discharge and the voltage generated by the positive wall charge stored on the area of the protection layer 705 corresponding to the scanning electrode 701 are superimposed on the voltage of the negative narrow erasing pulse and applied between the area of the protection layer 705 corresponding to the scanning electrode 701 and the area of the protection layer 705 corresponding to the sustaining electrode 702. Accordingly, erasing discharge occurs again between the above-mentioned two areas. However, since such erasing discharge is maintained for a short period of time due to the narrow pulse, the discharge is terminated midway. Accordingly, by setting the width of the narrow erasing pulse to be optimum, the wall charge on the area of the protection layer 705 corresponding to the sustaining electrode 702 and the wall charge on the area of the protection layer 705 corresponding to the scanning electrode 701 can be neutralized. Thereafter, sustaining discharge does not occur even if a sustaining pulse is applied unless a writing pulse is applied again. Accordingly, discharge is kept in a pause. The level of the residual wall charge in FIG. 28F is less than the level of the residual wall charge in FIG. 28C because the wall charge is partially extinguished during the sustaining discharge.

As is shown in FIG. 28B, in the initiating period, a positive pulse having an amplitude of +Vr (V) is applied to the scanning electrodes 701 and the sustaining electrodes 702. By such application, as is shown in FIG. 28F, the voltage generated by the negative wall charge remaining on the area of the dielectric layer 709 corresponding to the data electrode 707 and the voltage generated by the positive wall charge remaining on the area of the protection layer 705 corresponding to the scanning electrode 701 and the area of the protection layer 705 corresponding to the sustaining electrode 702 are superimposed on the voltage of the initiating pulse and applied between the area of the dielectric layer 709 corresponding to the data electrode 707 and the area of the protection layer 705 corresponding to the scanning electrode 701 and between the area of the dielectric layer 709 corresponding to the data electrode 707 and the area of the protection layer 705 corresponding to the sustaining electrode 702. By such application, initiating discharge occurs between the above-mentioned areas. As a result, the wall charges remaining in the discharge cell after the erasing operation is neutralized completely, and the discharge cell has no wall charge.

By repeating the operation illustrated in FIGS. 28B through 28F in this manner, an image is displayed.

As is described above, even if some wall charges remain in the discharge cell after the erasing operation, such remaining wall charges are neutralized completely since initiating discharge occurs by application of an initiating pulse. As a result, the discharge cell has no wall charge again, and thus the next writing discharge occurs more easily. The voltage generated by the wall charge stored on the area of the protection layer 705 corresponding to the scanning electrode 701 and the wall charge stored on the area of the protection layer 705 corresponding to the sustaining electrode 702, both stored by the writing discharge performed after the erasing operation, is larger than such a voltage which is obtained when no initiating pulse is applied. The larger voltage causes sustaining discharge more easily. Accordingly, the discharge is more stable, and thus the AC-type PDP shows no discharge cell in which light emission does not occur.

Figure 28G:
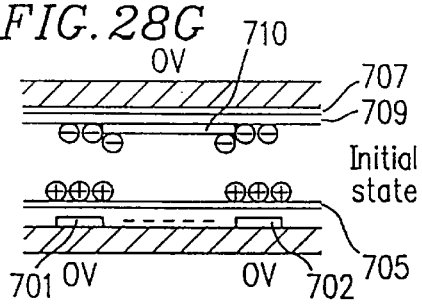

In the case that the AC-type PDP is turned on to start operating in the state where the wall charge has already been distributed as is shown in FIG. 28G, namely, in the state where a negative wall charge is stored on the area of the dielectric layer 709 corresponding to the data electrodes 707 and a positive wall charge is stored on the area of the protection layer 705 corresponding to the scanning electrodes 701 and the sustaining electrodes 702, the wall charges act in the direction of counteracting the voltage of the writing pulse. Accordingly, writing discharge and sustaining discharge are both difficult to be realized. However, when the initiating pulse is applied, the voltage of the initiating pulse is superimposed on the voltage generated by the above-mentioned charge distribution state, due to the polarity of the initiating pulse, and applied between the area of the dielectric layer 709 corresponding to the data electrode 707 and the area of the protection layer 705 corresponding to the scanning electrode 701 and between the area of the dielectric layer 709 corresponding to the data electrode 707 and the area of the protection layer 705 corresponding to the sustaining electrode 702. By such application, initiating discharge occurs, thereby completely neutralizing the wall charges distributed as is shown in FIG. 28G. As a result, the discharge cell returns to the state shown in FIG. 28B where no wall charge exists. Since the following writing discharge and sustaining discharge occur more easily, the rise time for display after the AC-type PDP is turned on, namely, the time period from the AC-type PDP is turned on until display is normally performed is shortened significantly.

In the above example, the initiating pulse is applied to both of the scanning electrodes 701 and the sustaining electrodes 702. In the case where the wall charges remaining on the area of the protection layer 705 corresponding to the scanning electrodes 701 and the area of the protection layer 705 corresponding to the sustaining electrodes 702 exist unbalanced, namely, more wall charges exist on either area, the initiating pulse may be applied only to either the scanning electrodes 701 or the sustaining electrodes 702.

Figure 29A:
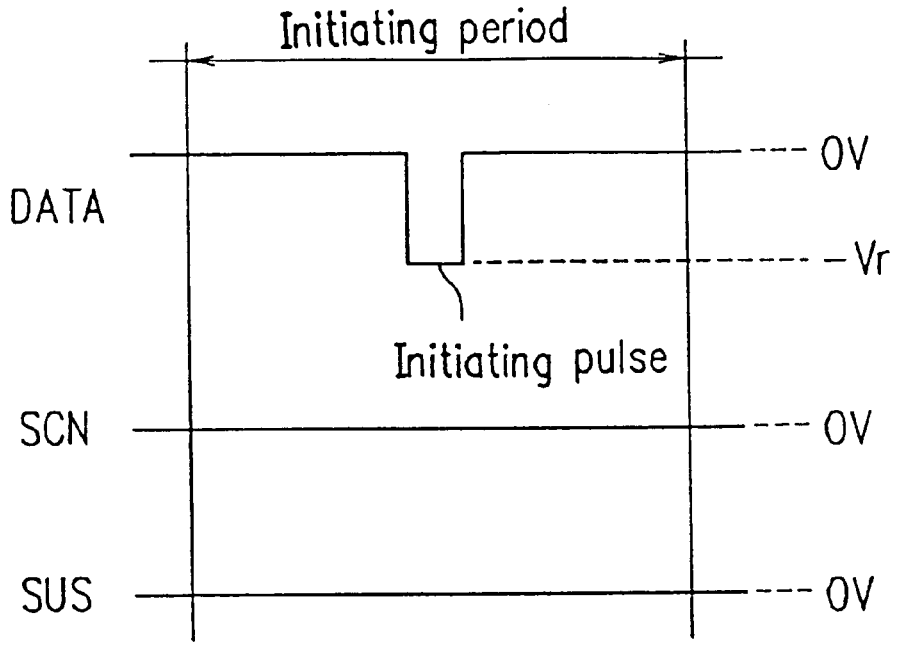
FIG. 29A is a timing chart illustrating a method for applying an initiating pulse in a modification of the seventh example.
Figure 29B:
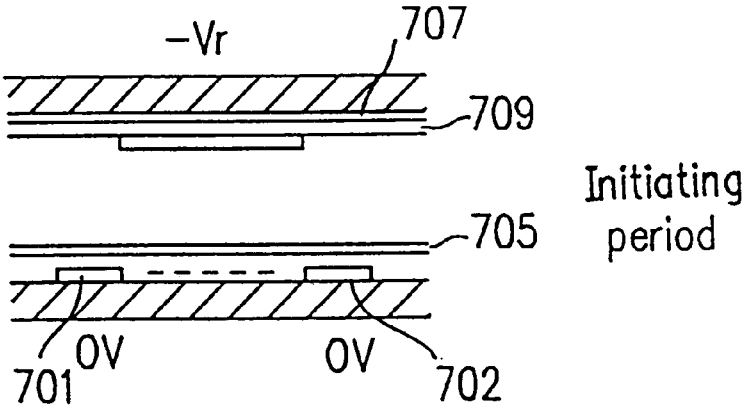
FIG. 29B is a cross sectional view illustrating the state of an electrode supplied with an initiating pulse shown in FIG. 29A.

With reference to FIGS. 29A and 29B, a method for driving an AC-type PDP in a modification of the seventh example will be described. FIG. 29A is a timing chart illustrating application of an initiating pulse. The method in this modification is the same as the method described with reference to FIG. 27 except for application of the initiating pulse.

As is shown in FIG. 29A, in the initiating period, an initiating pulse is applied to the data electrodes 707. Such an initiating pulse has an opposite polarity to the polarity of the writing pulse applied to the data electrode 707 in the writing period as is shown in waveform DATA. FIG. 29B schematically illustrates voltages in the scanning, sustaining and data electrodes after the application of the initiating pulse. The level and the polarity of the potential in each electrode are different from those of the case shown in FIGS. 28A through 28G, but the polarity of the voltage applied between the data electrode 707 and the scanning electrode 701 and between the data electrode 707 and the sustaining electrode 702 caused by the initiating pulse is the same as the case shown in FIGS. 28A through 28G. Accordingly, the AC-type PDP operates in the same manner and achieves the same effect.

Figure 30A:
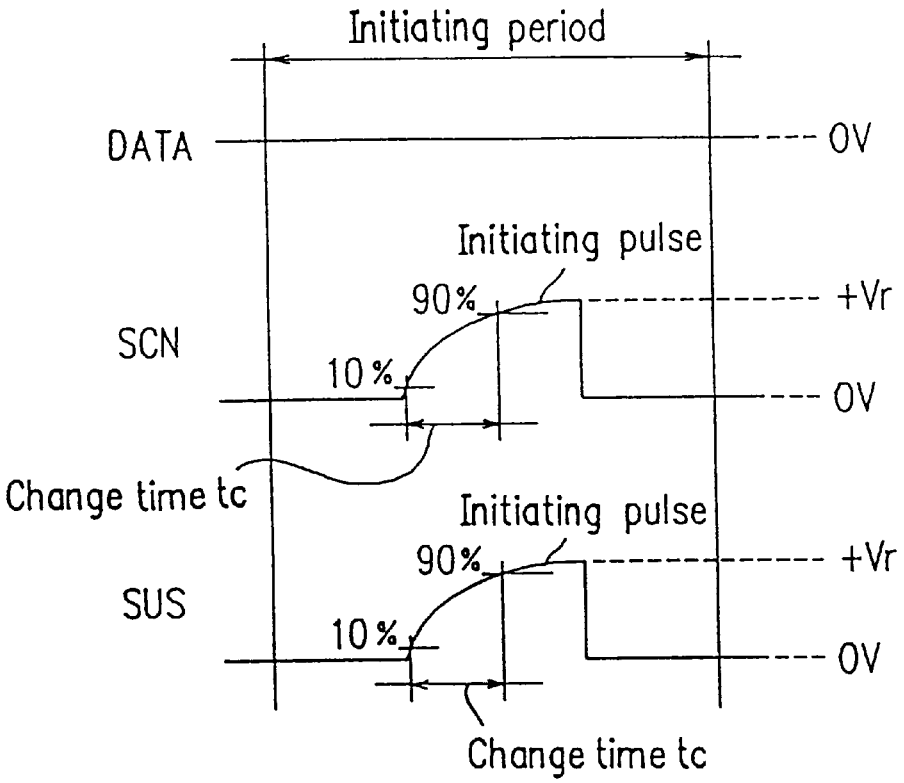
FIGS. 30A and 30B are timing charts illustrating a method for applying an initiating pulse in other modifications of the seventh example.
Figure 30B:
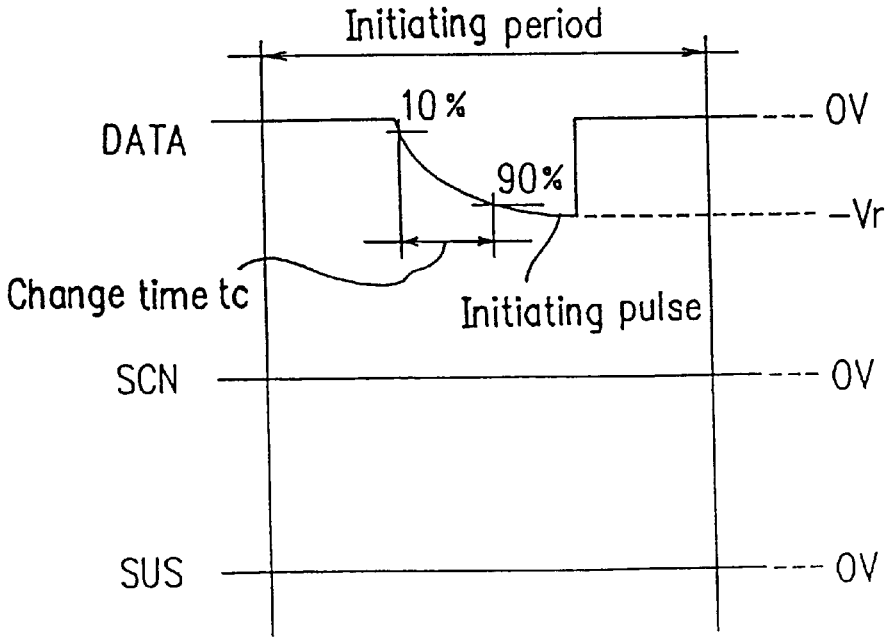

FIGS. 30A and 30B are timing charts illustrating application of an initiating pulse in different shapes. In FIG. 30A, the initiating pulse has a different shape from the pulse shown in FIG. 27. In FIG. 30B, the initiating pulse has a different shape from the pulse shown in FIG. 29A. The operation in the other periods is the same as described above.

In practice, the optimum voltage of the initiating pulse is different in each discharge cell for various factors. In the case that the waveform of the initiating pulse is square, each discharge cell is not supplied with an optimum voltage, but all the discharge cells are always supplied with a maximum voltage. By such a manner of application, the initiating discharge is performed insufficiently or excessively in some of the discharge cells. In such discharge cells, light emission does not occur or is unstable. As is appreciated from this, it is difficult to set the voltage of the initiating pulse so as to neutralize the wall charges in all the discharge cells completely thus to obtain the normal initiating operation.

In the case when an initiating pulse having an amplitude which changes gradually is applied, initiating discharge occurs in each discharge cell when the voltage of the initiating pulse reaches the optimum level for the discharge cell, due to the slow increase in the voltage. Accordingly, the wall charges can be neutralized completely in all the discharge cells in the initiating period. Thus, the initiating operation is performed more reliably. Further, normal initiating operation can be performed in a wider range of voltages of the initiating pulse.

Figure 31:
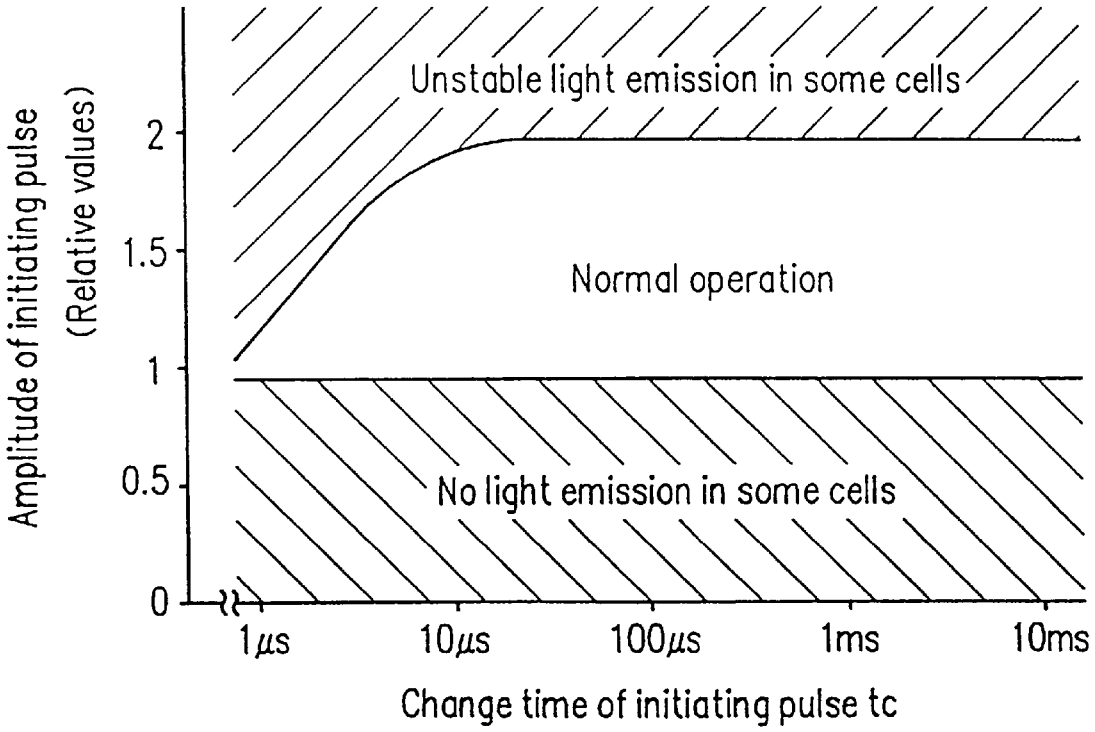
FIG. 31 is a graph illustrating discharge characteristics of the AC-type PDP in the seventh example with respect to a time period required for the voltage of an initiating pulse to change between certain levels.

An optimum value of a change time tc required for the voltage of the initiating pulse (shown in FIGS. 30A and 30B) to change from 10% to 90% of the amplitude thereof will be described. FIG. 31 illustrates the state of light emission with respect to the relationship between the voltage +Vr of the initiating pulse and the change time tc of the initiating pulse.

As is appreciated from FIG. 31, if the amplitude of the initiating pulse is too small, light emission does not occur; and if the amplitude of the initiating pulse is too large, unstable light emission occurs, both regardless of the change time tc. Such a phenomenon provides the range of voltages of the initiating pulse for obtaining a normal initiating operation.

If the change time tc is 1 $\mu$s or less, there is substantially no range of amplitude of the initiating pulse for providing the normal operation. If the change time tc is 5 $\mu$s or more, the range of amplitude of the initiating pulse for providing the normal operation is sufficiently wide. Accordingly, the change time tc is preferably 5 $\mu$s or more. The upper limit of the change time tc which is required to obtain the normal operation is not determined by FIG. 31. However, considering that the upper limit of a refreshing period of the display screen (sum of the writing, sustaining and erasing periods) is generally approximately 17 ms (1/60 seconds), the upper limit of the change time is approximately 10 ms in practical use. Accordingly, the preferable range of the change time tc which is practically usable is 5 $\mu$s to 10 ms inclusive.

As is appreciated from the above description, the wall charges in all the discharge cells are neutralized completely in the initiating period to perform the initiating operation more reliably by setting the change time tc which is required for the voltage of the initiating pulse from 10% to 90% of the amplitude thereof between 5 $\mu$s and 10 ms inclusive. Such a range is wider than the case where a square pulse is applied. The effect is the same.

In FIG. 30A, the initiating pulse is applied to both of the scanning electrodes 701 and the sustaining electrodes 702. In the case where the wall charges remaining on the area of the protection layer 705 corresponding to the scanning electrodes 701 and the area of the protection layer 705 corresponding to the sustaining electrodes 702 exist unbalanced, namely, more wall charges exist on either area, the initiating pulse may be applied only to either the scanning electrodes 701 or the sustaining electrodes 702.

Figure 32A:
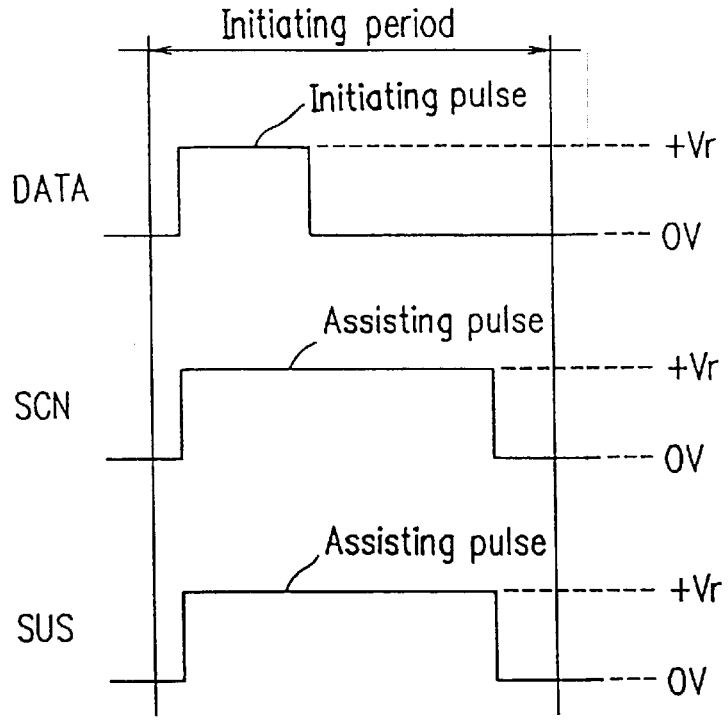
FIGS. 32A and 32B are timing charts illustrating a method for applying an initiating pulse in other modifications of the seventh example.
Figure 32B:
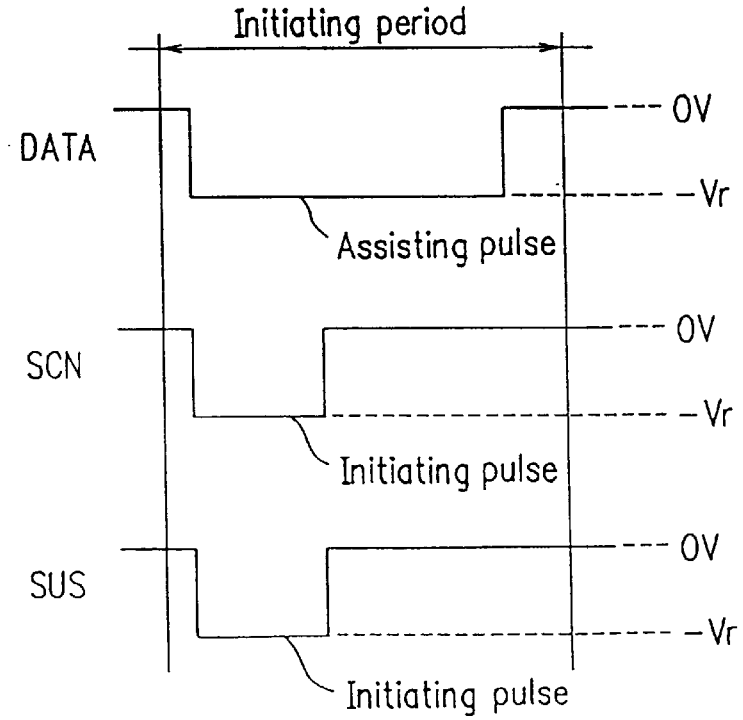

With reference to FIGS. 32A and 32B, methods for driving an AC-type PDP in other modifications of the seventh example will be described.

FIG. 32A is a timing chart illustrating application of an initiating pulse. The method in this modification is the same as the method described with reference to FIG. 27 except for application of the initiating pulse and the assisting pulse.

As is shown in FIG. 32A, in the initiating period, a positive initiating pulse having an amplitude of +Vr (V) is applied to the data electrodes. Simultaneously, an assisting pulse having the same amplitude +Vr (V) and the same polarity is applied to the scanning electrodes and the sustaining electrodes. Before the assisting pulse is terminated, the initiating pulse is terminated.

The initiating operation in this modification will be described, hereinafter.

First, as is shown in FIG. 32A, a positive assisting pulse and a positive initiating pulse both having an amplitude of +Vr (V) are applied to all the scanning electrodes, all the sustaining electrodes and all the data electrodes simultaneously. Then, the voltage in all the scanning electrodes, all the sustaining electrodes and all the data electrodes changes to +Vr. However, the voltage between the data electrodes and the scanning electrodes and the voltage between the data electrodes and the sustaining electrodes remains 0 V. When the initiating pulse is terminated while the assisting pulse is still applied, a voltage of +Vr is applied between the data electrodes and the scanning electrodes and between the data electrodes and the sustaining electrodes. The direction in which such a voltage is applied is the same as that of the voltage applied between the data electrodes 707 and the scanning electrodes 701 and between the data electrodes 707 and the sustaining electrodes 702 in the initiating period in FIG. 28B. The operation is the same as described with reference to FIG. 27, and the same effect is achieved.

In FIG. 32A, the assisting pulse is applied to both of the scanning electrodes 701 and the sustaining electrodes 702. In the case where the wall charges remaining on the area of the protection layer 705 corresponding to the scanning electrodes 701 and the area of the protection layer 705 corresponding to the sustaining electrodes 702 exist unbalanced, namely, more wall charges exist on either area, the assisting pulse may be applied only to either the scanning electrodes 701 or the sustaining electrodes 702.

FIG. 32B is a timing chart illustrating application of an initiating pulse. The method in this modification is the same as the method described with reference to FIG. 27 except for application of the initiating pulse and the assisting pulse.

As is shown in FIG. 32B, in the initiating period, a negative assisting pulse having an amplitude of −Vr (V) is applied to the data electrodes. Simultaneously, an initiating pulse having the same amplitude −Vr (V) and the same polarity is applied to the scanning electrodes and the sustaining electrodes. Before the assisting pulse is terminated, the initiating pulse is terminated.

The initiating operation in this modification will be described, hereinafter.

First, as is shown in FIG. 32B, a negative initiating pulse and a negative assisting pulse both having an amplitude of −Vr (V) are applied to all the scanning electrodes, all the sustaining electrodes and all the data electrodes simultaneously. Then, the voltage in all the scanning electrodes, all the sustaining electrodes and all the data electrodes changes to −Vr. However, the voltage between the data electrodes and the scanning electrodes and the voltage between the data electrodes and the sustaining electrodes remains 0 V. When the initiating pulse is terminated while the assisting pulse is still applied, a voltage of −Vr is applied between the data electrodes and the scanning electrodes and between the data electrodes and the sustaining electrodes. The direction in which such a voltage is applied is the same as that of the voltage applied between the data electrodes 707 and the scanning electrodes 701 and between the data electrodes 707 and the sustaining electrodes 702 in the initiating period in FIG. 28B. The operation is the same as described with reference to FIG. 27, and the same effect is achieved.

Figure 33A:
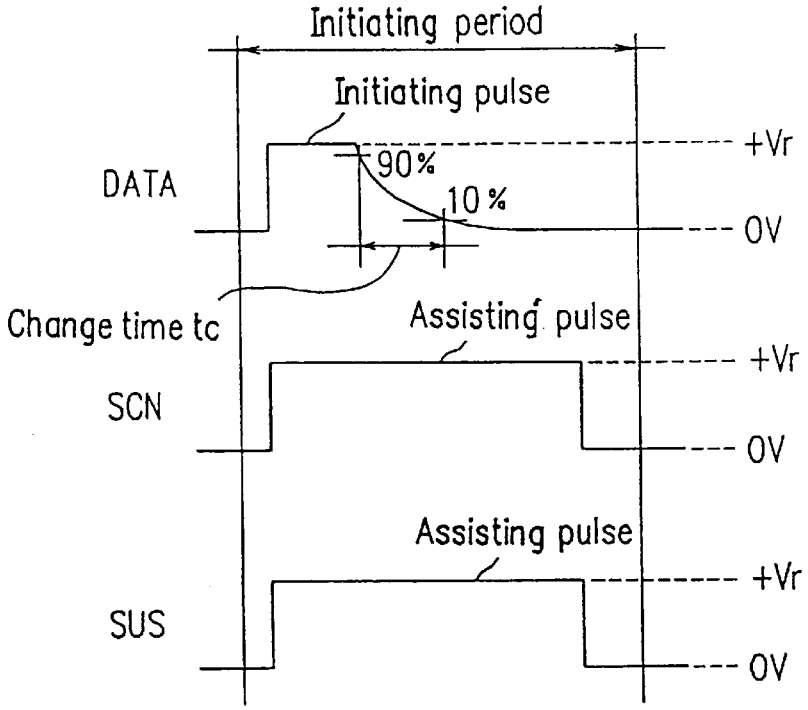
FIGS. 33A and 33B are timing charts illustrating a method for applying an initiating pulse in still other modifications of the seventh example.
Figure 33B:
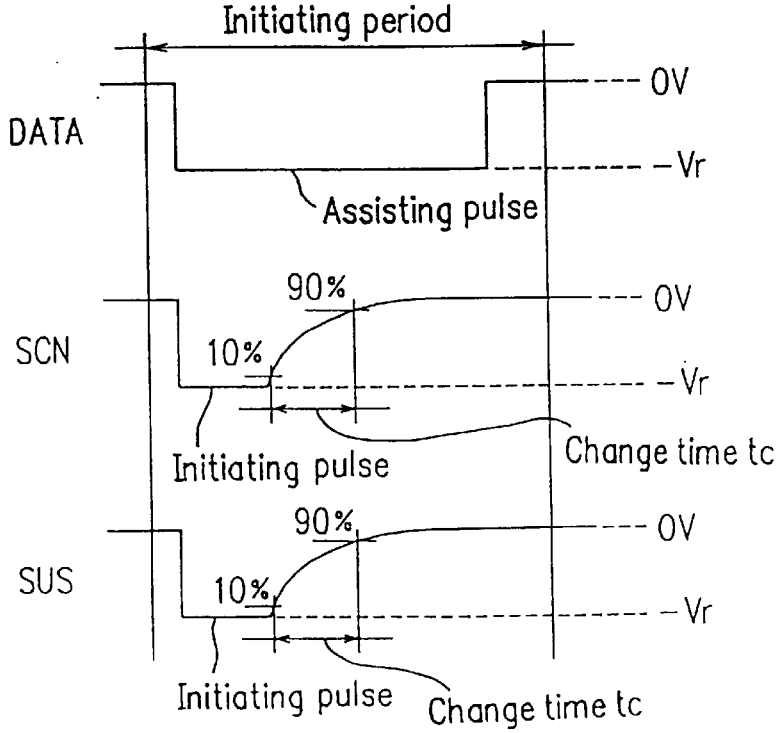

FIGS. 33A and 33B are timing charts illustrating application of an initiating pulse in different shapes. In FIG. 33A, the initiating pulse has a different shape from the pulse shown in FIG. 30A. In FIG. 33B, the initiating pulse has a different shape from the pulse shown in FIG. 30A. The operation in the other periods is the same as described above.

In FIG. 33A, the assisting pulse is applied to both of the scanning electrodes 701 and the sustaining electrodes 702. In the case where the wall charges remaining on the area of the protection layer 705 corresponding to the scanning electrodes 701 and the area of the protection layer 705 corresponding to the sustaining electrodes 702 exist unbalanced, namely, more wall charges exist on either area, the assisting pulse may be applied only to either the scanning electrodes 701 or the sustaining electrodes 702.

In FIGS. 32A, 32B, 33A and 33B, the assisting pulse is applied simultaneously with the initiating pulse. The initiating pulse may be applied prior to the assisting pulse.

In all the above-described cases in the seventh example, the initiating operation is rendered simultaneously to the scanning, sustaining and data electrodes. The same effect is obtained by rendering a plurality of groups of the initiating operation to the same plurality of groups of the scanning, sustaining and data electrodes with a delay.

In all the above-described cases in the seventh example, in the writing period, a writing pulse is applied to a prescribed data electrode and a scanning pulse is applied to the scanning electrodes one by one. The same effect is obtained by applying a writing pulse to all the data electrodes and applying a scanning pulse to all the scanning electrodes, thereby performing the writing operation in all the discharge cells simultaneously.

In all the above-described cases in the seventh example, the writing pulse is positive and the scanning pulse is negative. The same effect is obtained even if the polarities are opposite. In the case when the writing pulse is negative and the scanning pulse is positive, the initiating pulse and the assisting pulse also have the opposite polarities.

Figure 34:
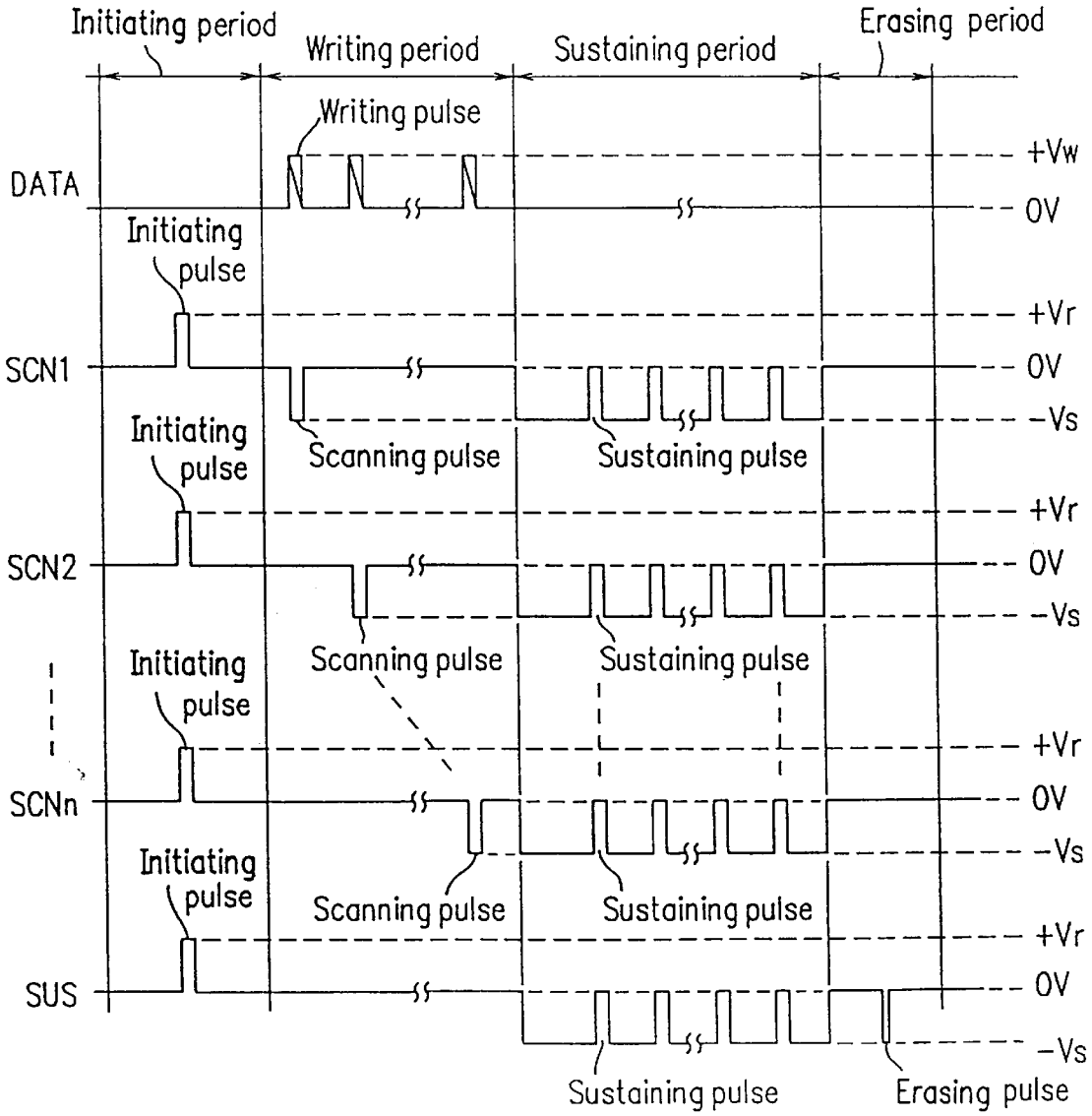
FIG. 34 is a timing chart illustrating a method for driving an AC-type PDP in still another modification in the seventh example.

In all the above-described cases in the seventh example, the scanning pulse and the sustaining pulse have the same polarity. The same effect is obtained even if the sustaining pulse is negative (−Vs) as is shown in FIG. 34.

Figure 35:
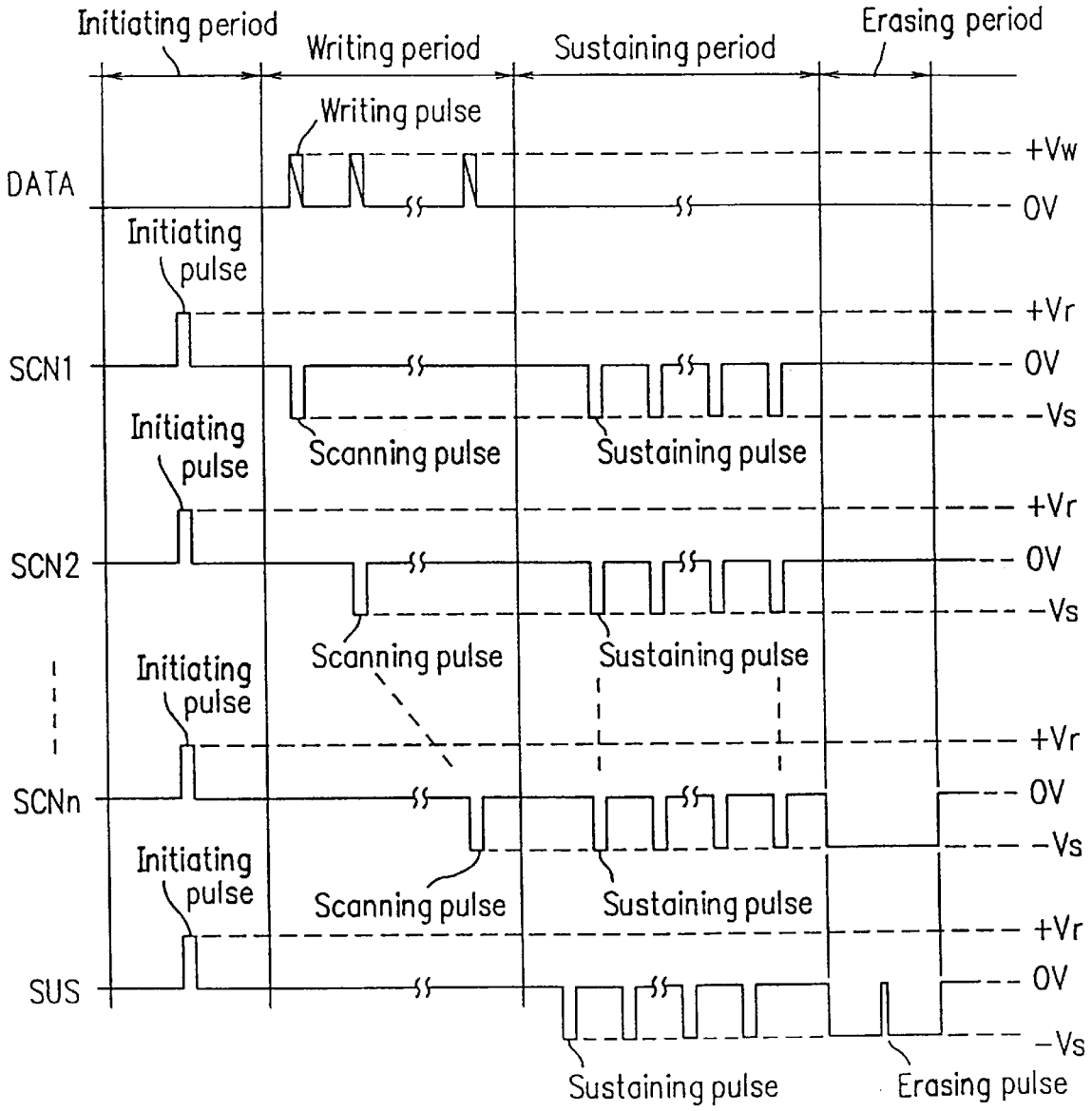
FIG. 35 is a timing chart illustrating a method for driving an AC-type PDP in still another modification in the seventh example.
Figure 36:
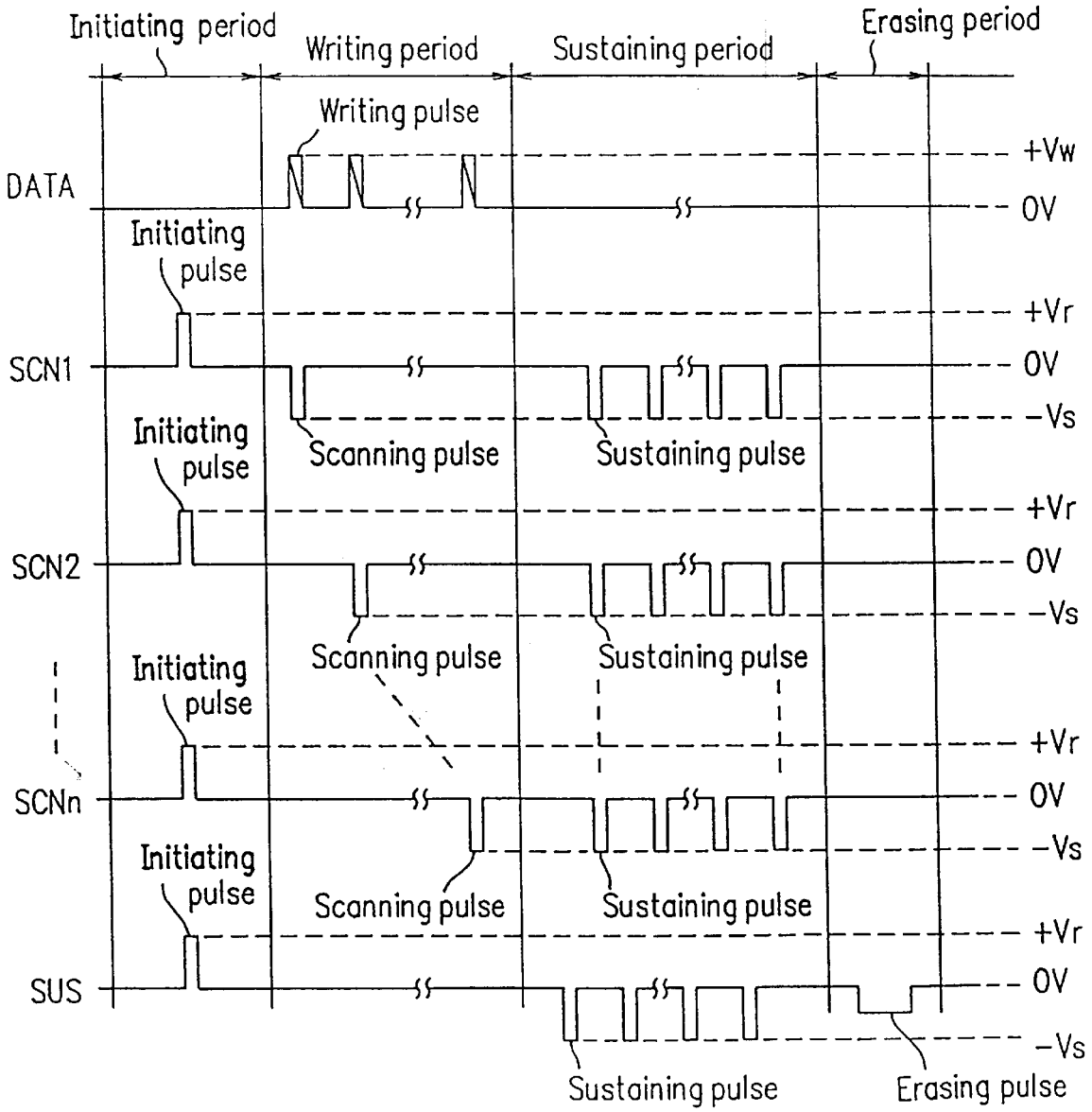
FIG. 36 is a timing chart illustrating a method for driving an AC-type PDP in still another modification in the seventh example.

In all the above-described first through seventh examples, the erasing pulse is a narrow pulse having the same polarity as the polarity of the sustaining pulse. The same effect is obtained even if the erasing pulse has an opposite polarity to that of the sustaining electrode as is shown in FIG. 35, or even if the erasing pulse has a larger width but a smaller amplitude as is shown in FIG. 36.

In all the above-described first through seventh examples, the erasing pulse is applied to the sustaining electrodes. The same effect is obtained by applying the erasing pulse to the scanning electrodes.

In all the above-described first through seventh examples, one initiating period is provided in one field of operation, namely, between the writing period and the erasing period. The same effect is obtained even if one initiating period is provided every several fields.

In the AC-type PDP used in the seventh example, the data electrodes 707 are covered with the second dielectric layer 710, and the phosphor layer 710 is provided on the second dielectric layer 709. The same method can be used for driving an AC-type PDP in which display is performed directly utilizing light emitted by discharge and thus has no phosphor layer 710. The same method can also be used for driving an AC-type PDP in which the data electrodes 707 are directly covered with a phosphor layer 710 without the second dielectric layer 709. In such a case, the phosphor layer acts in the same manner as the second dielectric layer 709. The same method can still be used for driving an AC-type PDP in which the data electrodes 707 are exposed to the discharge space 706 without the second dielectric layer 709, without the phosphor layer 710, or without the second dielectric layer 709 and the phosphor layer 710. In such a case, although no wall charge is stored on the area of the second dielectric layer 709 corresponding to the data electrodes 707, an equivalent wall charge is stored on the area of the protection layer 705 corresponding to the scanning electrode 701.

The pair of substrates on which the electrodes are located are formed of glass or ceramic. One of the substrates should be a transparent substrate in order to allow light emitted by discharge to transmit therethrough.

As has been described so far, by a driving method in the seventh example, an initiating period is provided before the writing, sustaining and erasing periods. In the initiating period, an initiating pulse having an opposite polarity to the polarity of the scanning pulse applied in the writing period is applied to at least one of the plurality of scanning electrodes and the plurality of sustaining electrodes. By the initiating pulse applied prior to the writing period, the wall charges remaining in the discharge cell after the erasing period can be neutralized completely. Since the discharge cell returns to the state of having no wall charge by the initiating discharge, defective writing discharge or defective sustaining discharge does not occur. Therefore, a series of operations in the writing, sustaining and erasing periods are performed reliably, and thus light is emitted in all the discharge cells. Even if the wall charges have already been distributed in the initial state before the AC-type PDP is turned on, such wall charges are neutralized completely by application of an initiating pulse performed in the initiating period, thereby returning the discharge cell to the state where no wall charge is stored. Accordingly, the rising time after the AC-type PDP is turned on is shortened, and thus the above-mentioned series of operations are performed reliably.

Example 8

Figure 37:
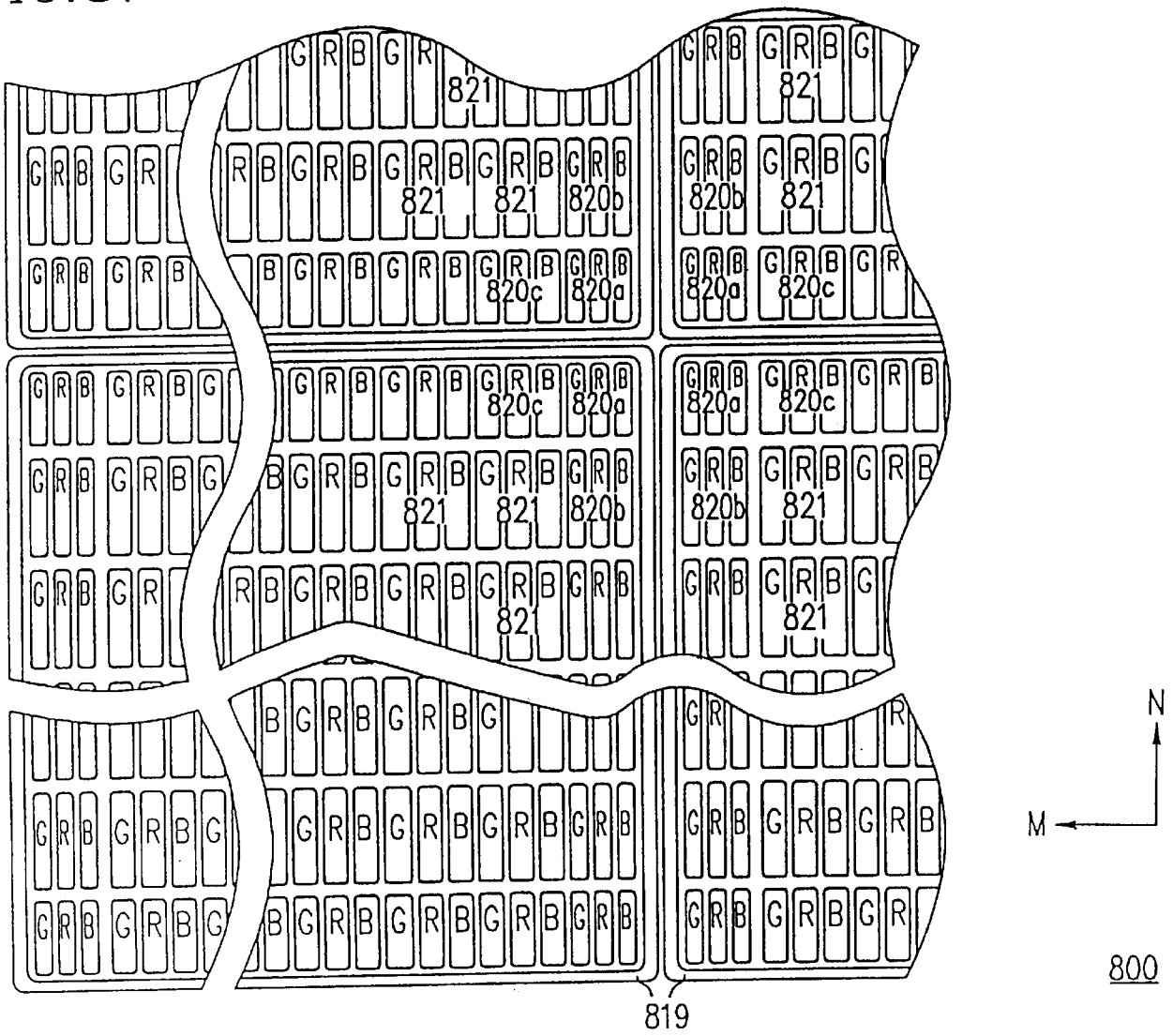
FIG. 37 is a partial plan view illustrating a structure of an image display apparatus in an eighth example according to the present invention.

With reference to FIG. 37, an image display apparatus in an eighth example according to the present invention will be described.

An image display apparatus in the eighth example includes a plurality of AC-type PDPs used as an image display panel arranged in a lattice, namely, in a plurality of lines and a plurality of columns. Each image display panel includes a plurality of display units (for example, 821, 820*a*, 820*b* and 820*c*) acting as a pixel. The plurality of display units are also arranged in a plurality of lines and a plurality of columns. As is shown in FIG. 37, the display units in a peripheral area of each image display panel are shorter than the other display units in at least one of a direction of lines M and a direction of columns N.

In detail, the display units in the top line and the bottom line of each image display panel are shorter than the other image display panel in the column direction N. The display units in the rightmost line and the leftmost line of each image display panel are shorter than the other image display panel in the line direction M. The display area of each image display panel is restricted by a non-display area which includes a rectangular frame surrounding the display panel and a glass layer having a low melting point provided at an end face of the frame.

In this example, display units 820*a*, 820*b* and 820*c* are smaller than the other display units. Accordingly, the area of each of the display units 820*a*, 820*b* and 820*c*, which includes the region actually contributing to the display and the non-display area, is substantially equal to the area of one pixel. Since the display units 820*a*, 820*b* and 820*c* are smaller, other display units 821 can be enlarged.

Due to such a structure, a pixel area including such a smaller display unit and a connection part between the image display panels is equal to the other pixel areas. As a result, the pitch between the pixels is uniformized in the entire display screen of the image display apparatus. Therefore, the non-light emitting connection parts between the image display panels are not conspicuous, and further generation of image distortion is prevented. Since the gap between the pixels need not be as wide as the width of the connection part, the area of each pixel can be enlarged, and thus an image having a high area luminance can be displayed.

Typically in such an image display apparatus, the external size is 224 mm×112 mm, the pitch between pixels is 7.0 mm, and the number of pixels is 32×16. Since the area of the pixel is smaller in the peripheral area of each image display panel, the luminance of light emitted in such an area is slightly lower than that in the other areas. However, the deterioration in display quality which is visually recognizable is significantly less than in the conventional image display apparatus having a non-uniform pixel arrangement. If necessary, the luminance of the peripheral area can be equal to the luminance of the other areas by correcting a circuit and the like.

In the above example, each pixel area includes three discharge spaces. If color display is not needed, each pixel area includes only one discharge space. The image display panel may be other types of PDPs instead of the AC-type PDP. A panel using a monochrome element, an LED, an EL lamp, or a liquid crystal display may also be used.

As is described above, in a large display screen in this example including a great number of image display panels arranged two dimensionally, the pitch between pixels can be uniformized in the entire screen even if the connection parts between the image display panels do not contribute to the actual display. The non-light emitting connection parts are not conspicuous, and thus an image having a high luminance with no distortion can be provided.

Example 9

In a ninth example, a rectangular transparent plate is located on an outer face of a rectangular front wall of a flat outer casing of an image display panel. Further, an outer peripheral area of the transparent plate which corresponds to the non-display area of the image display panel is shaped so as to act as a lens. By such a function of the outer peripheral area as a lens, the non-display area appears smaller through the transparent plate. As a result, in a mosaic-like large display screen including a great number of image display panels in a lattice, the extent to which the non-display appears as dark lines is reduced. Thus, a large image can be displayed on a large screen with low noise.

Figure 38:
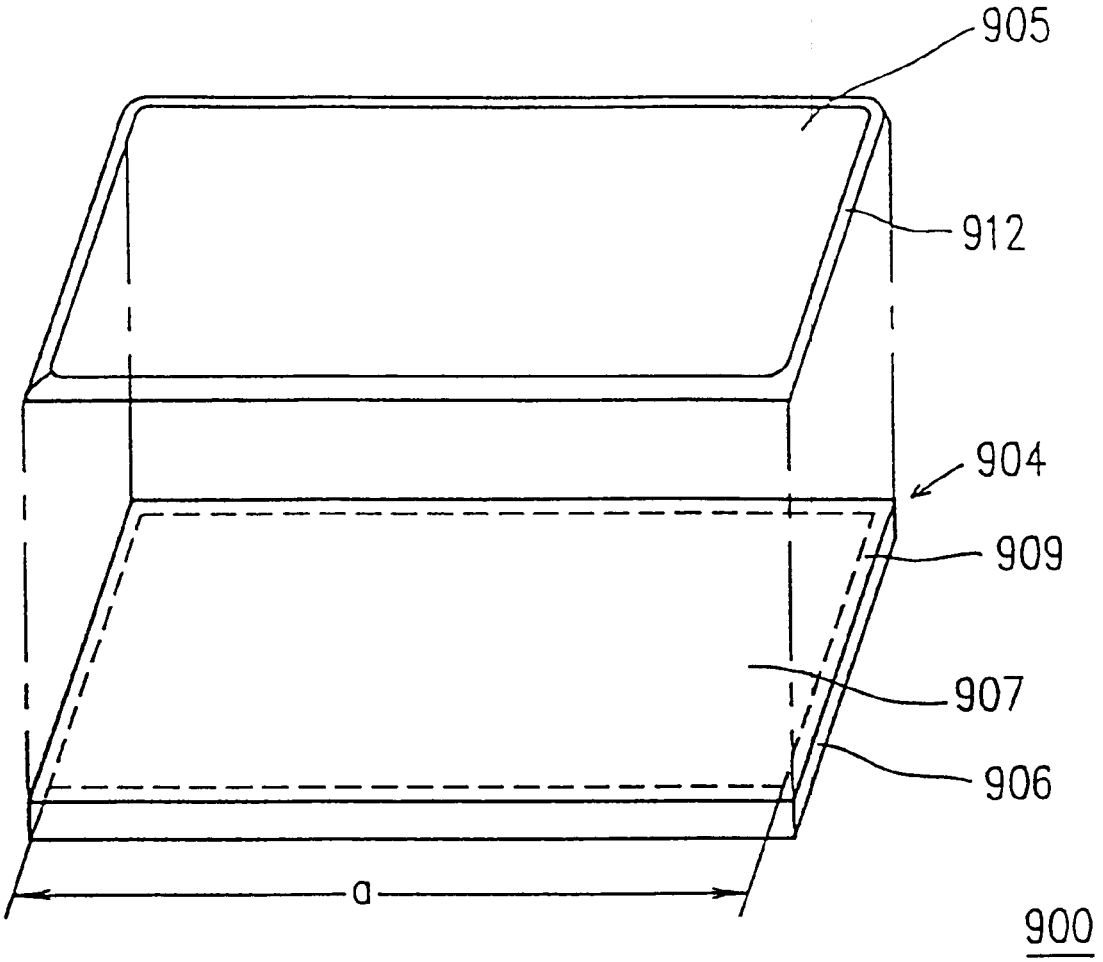
FIG. 38 is an isometric projectional view of an image display apparatus in a ninth example according to the present invention.
Figure 39:
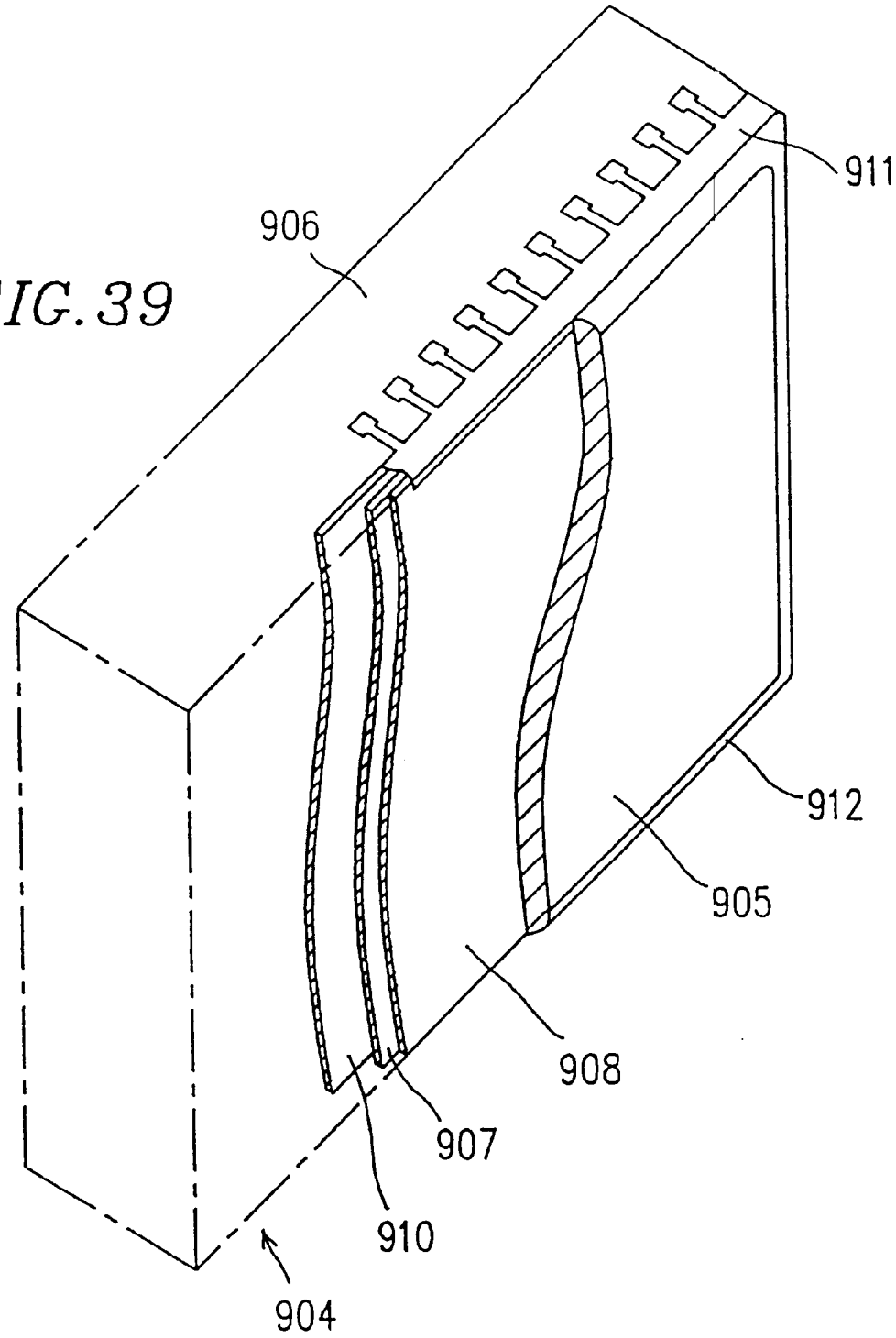
FIG. 39 is an isometric projectional view of an image display panel included in the image display apparatus shown in FIG. 38.

As is shown in FIGS. 38 and 39, a flat image display apparatus 900 includes an image display panel 904 and a rectangular transparent plate 905. The image display panel 904 includes a PDP. The image display apparatus 900 also includes an outer casing 906 having a rectangular light-transmitting front wall 907 sealing the electrodes included in the outer casing 906. The front wall 907 is formed of a flat glass plate covered with a reflection preventing layer 908. A side wall of the outer casing 906 and a sealing material such as frit glass can be seen through the front wall 907. In other words, an image display area a which is set on the front wall 907 is visually surrounded by a non-display area 909 having a shape of a rectangular frame which is seen through the front wall 907. The image display apparatus 900 further includes a color filter 910 and a frame 911.

Figure 40:
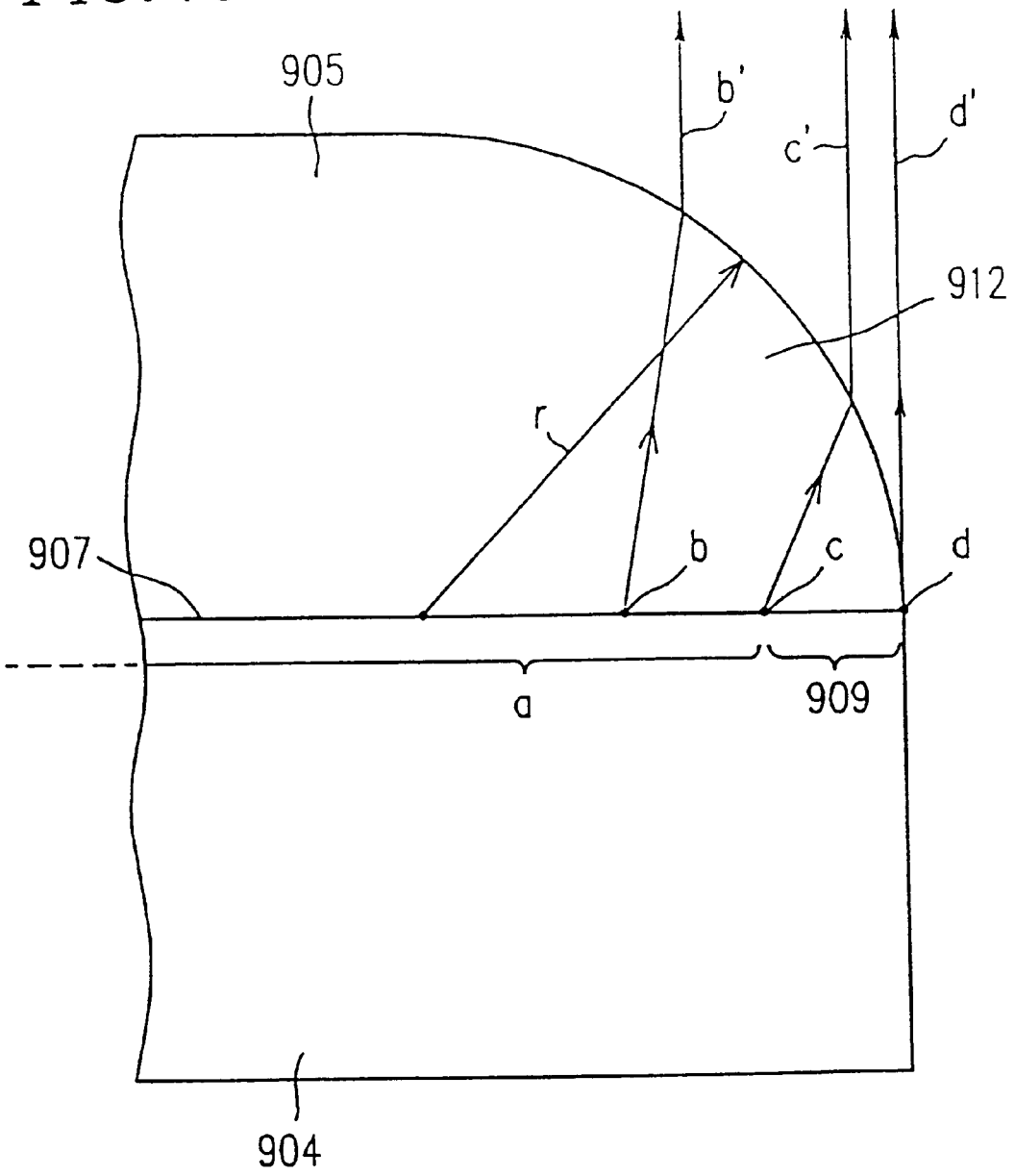
FIG. 40 is a cross sectional view illustrating a structure of the image display panel shown in FIG. 39.

The transparent plate 905 is formed of glass and is laminated on the outer face of the front wall 907 covered with the reflection preventing layer 908. As is also shown in FIG. 40, the peripheral area of the transparent plate 905 corresponding to the non-display area 909 is formed so as to have a lens area 912 having a shape so as to act as a lens. The cross section of the lens area 912 has a shape of a quarter circle, the quarter circle having a radius r which is the thickness of the transparent plate 905. Here, a convex lens is formed.

In FIG. 40, light emitted from points b, c and d of the image display panel 40 is collimated to parallel light beams b', c' and d' by the transparent plate 905. Accordingly, when a viewer looks at the front wall 907 of the image display panel 904 through the transparent plate 905, the distance between points b and c seems to be enlarged to the distance between the parallel light beams b' and c', and the distance between points c and d seems to be reduced to the distance between the parallel light beams c' and d'. By simply setting the thickness of the transparent plate 905 so that the distance between points c and d will be equal to the width of the non-display area 909, the non-display area 909 is reduced. If the thickness of the transparent plate 909 is set to be approximately three times or more the width of the non-display area 909, visual obstruction of the non-display area is eliminated substantially completely for all practical purposes.

Figure 41:
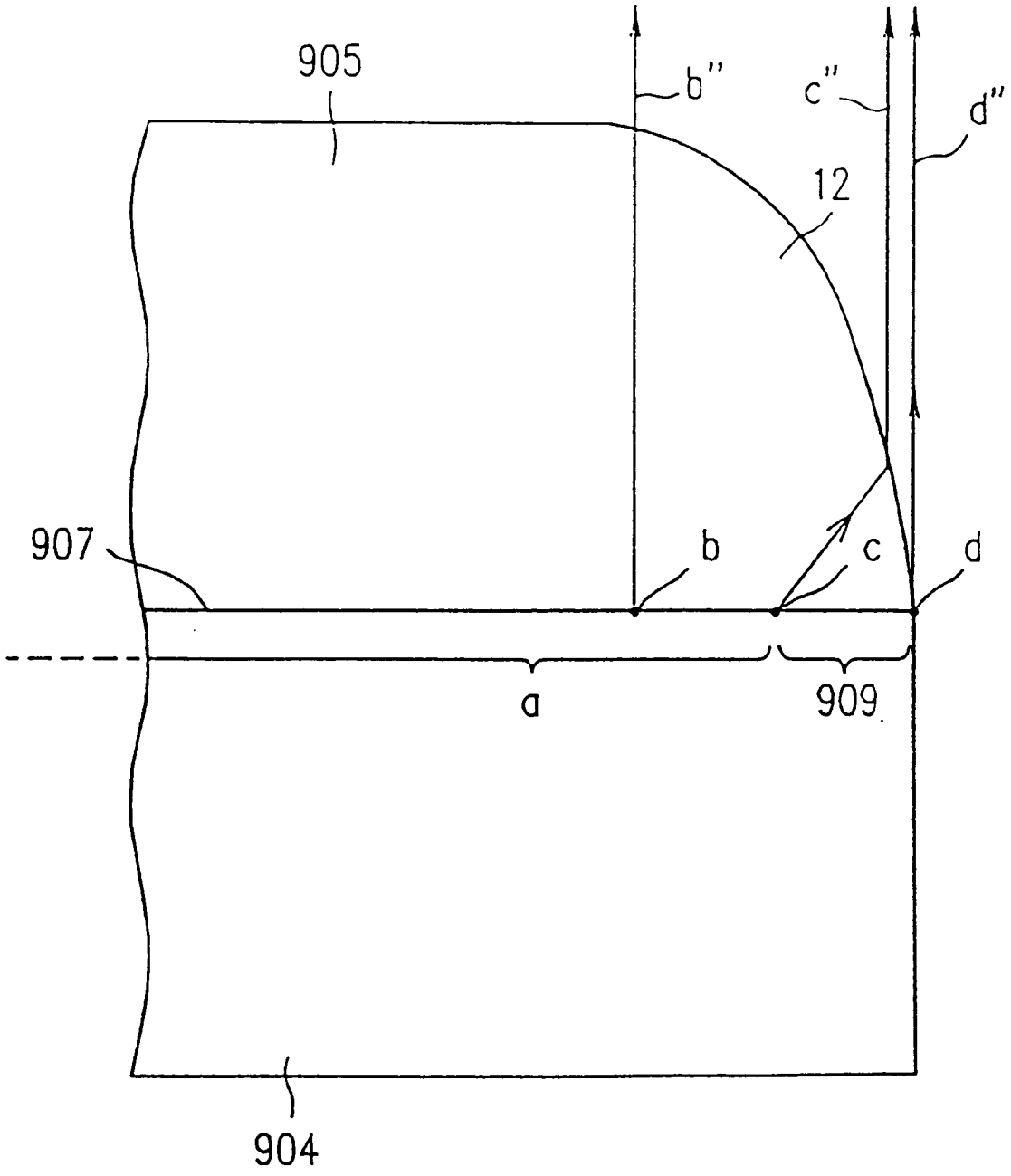
FIG. 41 is a cross sectional view illustrating a structure of an image display panel in a modification of the ninth example.

FIG. 41 shows a structure in a modification of the ninth example. The structure in FIG. 41 is the same as the structure in FIG. 40 except for the radius of curvature of the outer peripheral area of the transparent plate 905. The cross section of the transparent plate 905 has a shape of a quarter ellipse, the quarter ellipse having a longer diameter which is the thickness of the transparent plate 905 and a shorter diameter which is 0.8 times the longer diameter. The planar shape of the transparent plate 905 is the same as the planar shape of the front wall 907.

In the structure shown in FIG. 41, light emitted from points b, c and d is collimated into parallel light beams b", c" and d" by the transparent plate 905. Accordingly, when a viewer looks at the front wall 907 of the image display panel 904 through the transparent plate 905, the distance between points b and c seems to be enlarged to the distance between the parallel light beams b" and c", and the distance between points c and d seems to be reduced to the distance between the parallel light beams c" and d". By simply setting the thickness of the transparent plate 905 so that the distance between points c and d will be equal to the width of the non-display area 909, the non-display area 909 is reduced more. If the thickness of the transparent plate 905 is set to be approximately twice or more the width of the non-display area 909, the non-display area 909 seems to be reduced to ⅕ or less.

Figure 42:
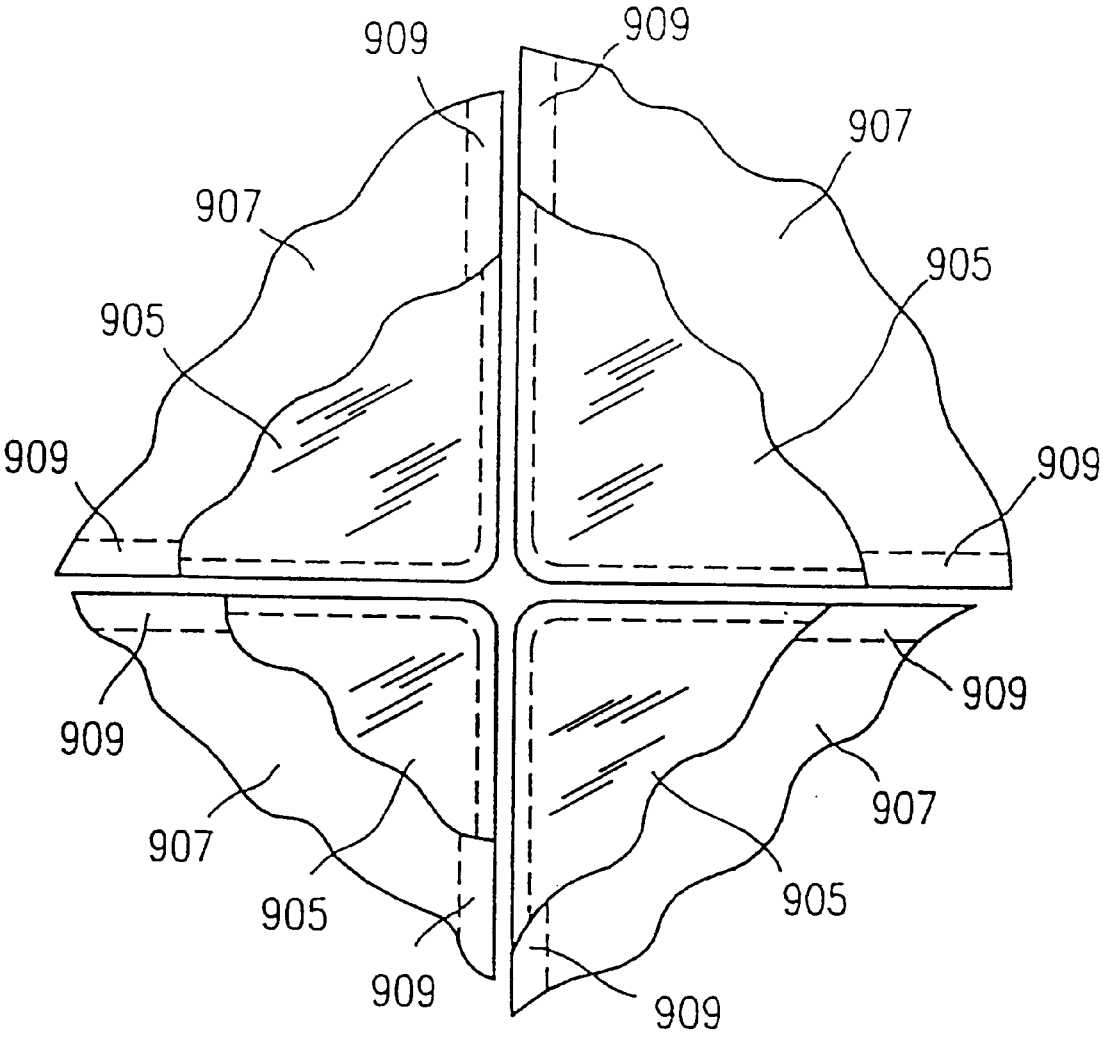
FIG. 42 is a partial plan view illustrating the structure of the image display panel in the ninth example.

In a mosaic-like large display screen including a great number of such flat image display panels in a lattice, as is shown in FIG. 42, the non-display area 909 at the connecting parts between the image display panels seems to be reduced by the function as a lens of the peripheral area of the transparent plate 905 of each image display panel. As a result, the visual obstruction of the disturbing dark lines in a lattice appearing on the large screen is eliminated, and thus a high quality large image is displayed.

The lens may have polygonal or other shapes if the function as the lens, namely, enlargement and reduction, is obtained. The image display panel may be a panel using an LCD or an EL lamp instead of a PDP.

As is described above, in the ninth example, the peripheral area of the transparent plate provided on the front wall of the image display panel is formed to have a shape so as to have a lens region acting as a lens. By the lens function, the non-display area is visually reduced, thereby visually enlarging the image display area. Accordingly, the extent at which the non-display area appears as disturbing dark lines in a large screen including a great number of image display panels in a lattice is reduced. As a result, a TV image or an advertizing image can be displayed on a large screen with low noise.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A gas discharge display apparatus, comprising:

a first substrate and a second substrate located opposed to each other with a discharge space interposed therebetween to form an outer casing;

a first electrode group including a plurality of scanning electrodes and a plurality of sustaining electrodes located parallel to each other on an inner face of the first substrate, each of the plurality of scanning electrodes and each of the plurality of sustaining electrodes forming a pair;

a dielectric layer covering the first electrode group; and a second electrode group including a plurality of data electrodes and a plurality of erasing electrodes located parallel to each other on an inner face of the second substrate in a direction perpendicular to the first electrode group, each of the plurality of data electrodes and each of the plurality of erasing electrodes forming a pair.

2. A method for driving a gas discharge display apparatus including a first substrate and a second substrate located opposed to each other with a discharge space interposed therebetween to form an outer casing; a first electrode group including a plurality of scanning electrodes and a plurality of sustaining electrodes located parallel to each other on an inner face of the first substrate, each of the plurality of scanning electrodes and each of the plurality of sustaining electrodes forming a pair; a dielectric layer covering the first electrode group; and a second electrode group including a plurality of data electrodes and a plurality of erasing electrodes located parallel to each other on an inner face of the second substrate in a direction perpendicular to the first electrode group, each of the plurality of data electrodes and each of the plurality of erasing electrodes forming a pair, the method comprising the steps of:

applying a voltage pulse to the plurality of scanning electrodes and the plurality of sustaining electrodes included in the first electrode group alternately, thereby causing sustaining discharge between each pair of scanning electrode and sustaining electrode; and causing erasing discharge between the plurality of sustaining electrodes and the plurality of erasing electrodes, thereby erasing a residual charge.

* * * * *